US011426620B2

(12) United States Patent
Park et al.

(10) Patent No.: US 11,426,620 B2
(45) Date of Patent: Aug. 30, 2022

(54) INFLATABLE PLYOMETRIC BOX

(71) Applicants: Chad Chaehong Park, Dallas, TX (US); Csaba Andrasfi, Oakdale, MN (US)

(72) Inventors: Chad Chaehong Park, Dallas, TX (US); Csaba Andrasfi, Oakdale, MN (US)

(73) Assignee: Chad Chaehong Park, Dallas, TX (US)

( * ) Notice: Subject to any disclaimer, the term of this patent is extended or adjusted under 35 U.S.C. 154(b) by 10 days.

(21) Appl. No.: 17/091,685

(22) Filed: Nov. 6, 2020

(65) Prior Publication Data

US 2021/0052936 A1 Feb. 25, 2021

Related U.S. Application Data

(63) Continuation-in-part of application No. 16/287,423, filed on Feb. 27, 2019, now Pat. No. 11,040,237.
(Continued)

(51) Int. Cl.
*A63B 21/00* (2006.01)
*A63B 23/04* (2006.01)
(Continued)

(52) U.S. Cl.
CPC ..... *A63B 21/4033* (2015.10); *A63B 21/0085* (2013.01); *A63B 23/0405* (2013.01); *A63B 71/04* (2013.01)

(58) Field of Classification Search
CPC ..... A63B 21/0442; A63B 21/0004; A63B 21/026; A63B 21/06; A63B 21/0618;
(Continued)

(56) References Cited

U.S. PATENT DOCUMENTS 2,978,243 A * 4/1961 Gabrielson ..... A63G 23/00 472/135
3,391,414 A * 7/1968 Gordon ..... A47B 27/08 182/139
(Continued)

OTHER PUBLICATIONS

U.S. Non-Final Office Action for Corresponding U.S. Appl. No. 16/287,423, dated Nov. 13, 2020.
(Continued)

*Primary Examiner* — Garrett K Atkinson

(57) ABSTRACT

An inflatable plyometric box having a first inflatable member adapted to be inflated to a pressure, a second inflatable member on top of the first inflatable member and adapted to be inflated to a pressure, and a connecting member connected to the first inflatable member and the second inflatable member which secures the first inflatable member to the second inflatable member. The first and second inflatable members incorporate drop stitch technology which provides substantial rigidity to first and second inflatable members when the first and second inflatable members are inflated to the pressures. Thus the inflatable plyometric box is substantially rigid to support a user landing on the top of the inflatable plyometric box. The inflatable plyometric box may include a stabilizing member which may be connected to the bottom of the inflatable plyometric box, wherein the stabilizing member is adapted to increase the stability of the inflatable plyometric box.

20 Claims, 29 Drawing Sheets

Related U.S. Application Data

(60) Provisional application No. 62/635,883, filed on Feb. 27, 2018.

(51) Int. Cl.
*A63B 71/04* (2006.01)
*A63B 21/008* (2006.01)

(58) Field of Classification Search
CPC ..... A63B 21/4005; A63B 21/4007; A63B 23/047; A63B 21/0552; A63B 23/03525; A63B 23/1245; A63B 2071/027; F41A 33/00
See application file for complete search history.

(56) References Cited

U.S. PATENT DOCUMENTS 3,399,407 A * 9/1968 Olsen ..... A63B 6/02 182/139
3,627,314 A * 12/1971 Brown ..... A63B 25/08 482/77
3,840,922 A * 10/1974 Morrison ..... A63B 6/02 5/420
4,108,428 A * 8/1978 Winterbottom ..... A63B 69/20 482/84
4,126,326 A * 11/1978 Phillips ..... A63B 26/003 280/220
4,516,768 A * 5/1985 Gallaro ..... A63B 21/0004 482/145
4,787,630 A * 11/1988 Watson ..... A63B 22/14 482/146
5,033,742 A * 7/1991 Johnson ..... A63B 21/4037 441/130
5,092,586 A * 3/1992 Tuthill ..... A63B 22/18 482/146
5,112,045 A * 5/1992 Mason ..... A63B 22/18 482/901
5,613,690 A * 3/1997 McShane ..... G06F 3/0334 428/902
5,637,057 A * 6/1997 Collura ..... A63B 5/11 482/77
5,690,389 A * 11/1997 Ekman ..... A47C 9/002 297/452.41
5,897,474 A * 4/1999 Romero ..... A63B 22/14 482/79
5,924,144 A 7/1999 Peterson
6,223,673 B1 * 5/2001 Mears ..... B63B 34/52 482/29
6,872,175 B2 * 3/2005 Lin ..... A63B 26/003 482/121
D505,460 S * 5/2005 Dalebout ..... D21/688
7,008,359 B2 * 3/2006 Fan ..... A63B 22/18 482/146
7,044,558 B2 * 5/2006 Chiu ..... A47C 4/54 297/452.41
7,297,089 B2 * 11/2007 Chen ..... A63B 69/0053 482/1
7,303,512 B1 * 12/2007 Goldman ..... A63B 25/08 482/77
7,357,766 B2 * 4/2008 Langer ..... A63B 22/18 482/146
7,431,681 B1 * 10/2008 St. Cyr ..... A63B 21/0552 482/121
7,438,696 B2 * 10/2008 Koonar ..... A61H 9/0078 601/49
7,563,216 B1 * 7/2009 Kest ..... A63B 23/03533 482/141
7,575,540 B1 * 8/2009 Dobrow ..... A63B 21/0004 482/142
7,601,107 B2 * 10/2009 Maloy ..... A63B 23/1245 482/79
7,985,164 B2 * 7/2011 Ashby ..... A63B 24/0062 482/901
8,460,161 B2 * 6/2013 Cole ..... A63B 21/4035 482/52
8,632,440 B2 * 1/2014 Pratson ..... A63B 21/4035 273/458
9,095,738 B2 * 8/2015 Senegal ..... A63B 22/18
9,364,699 B2 * 6/2016 Gordon ..... A63B 5/11
9,724,586 B2 * 8/2017 Smith ..... A63B 69/0093
9,776,030 B1 * 10/2017 Louis ..... A63B 5/11
9,919,185 B1 * 3/2018 Qiubo ..... A47C 9/002
10,045,647 B2 * 8/2018 Publicover ..... A63B 21/023
10,335,694 B2 * 7/2019 Koide ..... A63G 31/007
2004/0018924 A1 * 1/2004 Szydlowski ..... A63B 22/18 482/146
2004/0023766 A1 * 2/2004 Slone ..... A63B 26/003 482/146
2004/0087421 A1 * 5/2004 Lin ..... A63B 26/003 482/148
2005/0049123 A1 * 3/2005 Dalebout ..... A63B 21/0552 482/142
2005/0170939 A1 * 8/2005 Lin ..... A63B 26/003 482/121
2006/0030795 A1 * 2/2006 Luberski ..... A63B 26/003 601/1
2006/0135321 A1 * 6/2006 Chen ..... A63B 69/0053 482/8
2007/0265138 A1 * 11/2007 Ashby ..... A63B 71/0054 482/8
2007/0275832 A1 * 11/2007 Goldman ..... A63B 26/003 482/77
2008/0280740 A1 * 11/2008 Knecht ..... A63B 26/003 482/146
2010/0120587 A1 * 5/2010 Alexander ..... A63B 69/0053 482/52
2011/0143896 A1 * 6/2011 Senegal ..... A63B 22/18 482/146
2011/0218077 A1 9/2011 Fernandez et al.
2013/0210590 A1 * 8/2013 Publicover ..... A63B 67/002 482/110
2013/0260971 A1 * 10/2013 Cole ..... A63B 23/12 482/142
2014/0081177 A1 * 3/2014 Eguibar ..... A61B 5/4023 600/595
2014/0302974 A1 * 10/2014 Cole ..... A63B 26/003 482/142
2015/0108803 A1 * 4/2015 Bay ..... A47C 3/00 297/411.3
2015/0157888 A1 * 6/2015 Gordon ..... A63G 29/00 482/27
2015/0231436 A1 * 8/2015 Januszek ..... A63B 23/0458 482/142
2016/0151655 A1 * 6/2016 Gilley ..... A63B 5/16 482/142
2016/0310792 A1 * 10/2016 Smith ..... A63B 69/0093
2017/0050101 A1 * 2/2017 Ruscombe-King ..... A63B 21/00047
2017/0136372 A1 * 5/2017 Koide ..... A63G 31/007
2017/0172331 A1 * 6/2017 Publicover ..... B32B 7/022
2018/0085623 A1 * 3/2018 Flook ..... A63B 21/4027
2018/0229098 A1 * 8/2018 McCorkle ..... A63B 23/0458
2018/0271735 A1 * 9/2018 Drucker ..... A63B 21/4037
2018/0360250 A1 * 12/2018 Publicover ..... A63B 23/10
2019/0318673 A1 10/2019 Newton et al.
2019/0336813 A1 11/2019 Park
2020/0306574 A1 * 10/2020 Hjerpe ..... A63B 5/11

OTHER PUBLICATIONS

"The 2020 Home Line," us.airtrackfactory.com, Feb. 24, 2018 (WayBack Machine), 5 pages (retrieved on Jul. 28, 2020).
"ibigbean Air Track Tumbling Mat Inflatable Gymnastics Cheer Mats for Home Gymnastics, Cheerleading, Beach, on Water (8 inch thick)," www.amazon.com, Jul. 28, 2020, 5 pages (retrieved on Jul. 28, 2020).

(56) References Cited

OTHER PUBLICATIONS

International Search Report and Written Opinion Corresponding to Application No. PCT/US21/72200, dated Mar. 24, 2022.

* cited by examiner

INFLATABLE PLYOMETRIC BOX

CROSS-REFERENCE TO RELATED APPLICATIONS

This application is a continuation-in-part of U.S. patent application Ser. No. 16/287,423, filed on 27 Feb. 2019, and which claims the benefit of U.S. provisional application No. 62/635,883, filed 27 Feb. 2018, all of which are hereby incorporated by reference as though fully set forth herein.

BACKGROUND a. Field

The present disclosure relates to plyometric boxes. In particular, the instant disclosure relates to an inflatable plyometric box.

b. Background

Plyometrics or jump training is a type of exercise that includes repeated and rapid stretching and contracting of the muscles to increase muscular power and explosiveness. Plyometrics have become a popular component of strength and conditioning programs and are integral components of high intensity interval training (HIIT) programs, such as CrossFit®.

Jumping is a typical example of the kinds of exercises used in plyometrics. As such, a plyometric box, or "plyo box," is an exercise device that is intended for use as a platform for performing plyometric exercise, such as box jumps, depth jumps, step ups, step ups with barbells, and burpee box jump overs, among others. A box jump, for example, involves a person standing on the floor facing a plyometric box and jumping with both feet onto the top surface of the plyometric box. The box jump typically involves repeatedly jumping onto and off the plyometric box. A depth jump involves jumping or falling off a short plyometric box onto the floor and then quickly jumping onto a taller plyometric box.

Typical plyometric boxes comprise wooden or metal frames or boxes. However, typical plyometric boxes present a high risk of injury to a user if they fail to land properly on the plyometric box and/or if they slip off the edge of the plyometric box. As users rapidly and repeatedly attempt to jump onto the plyometric box, the risk of injury increases due to fatigue and/or lack of concentration. For example, if a user fails to clear the top edge of the typical plyometric box, the user can catch their shin on the metal or wooden edge of the typical plyometric box. This often leads to scratches or to more serious deep wounds or gashes requiring medical treatment. The same injury can occur if the user fails to land squarely on the top of the typical plyometric box and slips off an edge of the typical plyometric box. Additionally, if a user fails to land properly on the typical plyometric box, they can also potentially injure other parts of their body, including their chest, arms and/or head by hitting the plyometric box.

In addition to the potential for injury presented by typical plyometric boxes, they are difficult to store and transport. Typical plyometric boxes are large and heavy and awkward to move around. While some typical plyometric boxes can be nested within one another, they often are too big to fit into an automobile, thus limiting the ability to move plyometric boxes from gym to gym or from a gym to a park, or to another location where a user desires to engage in plyometric exercises. For example, a personal trainer is unlikely to transport typical plyometric boxes to a park for an outdoor training session or into the home of an individual. Therefore, due to the difficulty in transporting typical plyometric boxes, plyometric jumping exercises are limited to the gym.

The foregoing discussion is intended only to illustrate the present field and should not be taken as a disavowal of claim scope.

BRIEF SUMMARY

The present disclosure relates to an inflatable plyometric box. In particular, the instant disclosure relates to an inflatable plyometric box having a first inflatable member adapted to be inflated to a pressure, a second inflatable member on top of the first inflatable member and adapted to be inflated to a pressure, and a connecting member connected to the first inflatable member and the second inflatable member which secures the first inflatable member to the second inflatable member. The first and second inflatable members incorporate drop stitch technology which provides a high degree of rigidity to first and second inflatable members when the first and second inflatable members are inflated to the pressures. Thus, when the first and second inflatable members are inflated to the pressures, the inflatable plyometric box is substantially rigid to support a user landing on the top of the inflatable plyometric box.

In another aspect of the disclosure, the inflatable plyometric box may additionally include a stabilizing member which may be connected to the bottom of the inflatable plyometric box, wherein the stabilizing member is adapted to increase the stability of the inflatable plyometric box.

In other aspects of the disclosure, the stabilizing member may be releasably connected to the inflatable plyometric box.

In other aspects of the disclosure, the stabilizing member may be integrally formed with the inflatable plyometric box.

Another aspect of the disclosure is directed to an inflatable plyometric box, comprising a first inflatable member adapted to be inflated to a first pressure, a second inflatable member above the first inflatable member, the second inflatable member adapted to be inflated to a second pressure, and a connecting member connected to the first inflatable member and the second inflatable member which secures the first inflatable member to the second inflatable member. The first inflatable member comprises a first lower surface, a first upper surface, and a first population of drop stitch threads connected to and extending between the first lower surface and the first upper surface. The second inflatable member comprises a second lower surface, a second upper surface, and a second population of drop stitch threads connected to and extending between the second lower surface and the second upper surface.

Yet another aspect of the disclosure is directed to an inflatable plyometric box comprising a first inflatable member adapted to be inflated to a first pressure, a second inflatable member above the first inflatable member, the second inflatable member adapted to be inflated to a second pressure, and a connecting member connected to the first inflatable member and the second inflatable member which secures the first inflatable member to the second inflatable member. The first inflatable member comprises a first lower surface, a first upper surface, a first population of drop stitch threads connected to and extending between the first lower surface and the first upper surface, a first sidewall extending from the first lower surface to the first upper surface, and a first inflation valve. The second inflatable member comprises a second lower surface, a second upper surface, a second population of drop stitch threads connected to and extending between the second lower surface and the second upper surface, a second sidewall extending from the second lower surface to the second upper surface, and a second inflation valve. When the first inflatable member is inflated to the first pressure and the second inflatable member is inflated to the second pressure, the first upper surface of the first inflatable member is in contact with the second lower surface of the second inflatable member, and the inflatable plyometric box is substantially rigid to support a user landing on the second upper surface.

Yet another aspect of the disclosure is directed to an inflatable plyometric box comprising a first inflatable member adapted to be inflated to a first pressure, a second inflatable member above the first inflatable member, the second inflatable member adapted to be inflated to a second pressure, a third inflatable member between the first inflatable member and second inflatable member, the third inflatable member adapted to be inflated to a third pressure, and an expandable connecting member connected to the first inflatable member and the second inflatable member. The first inflatable member comprises a first lower surface, a first upper surface, and a first population of drop stitch threads connected to and extending between the first lower surface and the first upper surface. The second inflatable member comprises a second lower surface, a second upper surface, and a second population of drop stitch threads connected to and extending between the second lower surface and the second upper surface. The third inflatable member comprises a third lower surface, a third upper surface, and a third population of drop stitch threads connected to and extending between the third lower surface and the third upper surface. The expandable connecting member comprises a zipper which is adapted to be in a closed position when the third inflatable member is deflated and is adapted to be in an open position when the third inflatable member is inflated to the third pressure.

Yet another aspect of the disclosure is directed to an inflatable plyometric box comprising an inflatable member adapted to be inflated to a pressure, wherein the inflatable member comprises a lower surface, an upper surface, and a population of drop stitch threads connected to an extending between the lower surface and the upper surface. When the inflatable member is inflated to the pressure, the inflatable member is substantially rigid to support a user landing on the upper surface of the inflatable member, the inflatable member has a height from the lower surface to the upper surface, a length, and a width, and the height is no less than 15 inches.

Yet another aspect of the disclosure is directed to an inflatable plyometric box having an inflatable member and a stabilizing member. The inflatable member is configured to be inflated to a pressure and includes a lower surface, an upper surface, and drop stitch threads connected to and extending between the lower surface and the upper surface. The stabilizing member is configured to be releasably coupled to the lower surface of the inflatable member. The stabilizing member is configured to fold.

Yet another aspect of the disclosure is directed to a stabilizing member for use with an inflatable member of an inflatable plyometric box. The stabilizing member includes a base, a first hinge, and a second hinge. The base includes a first base portion, a second base portion, and a third base portion. The first base portion is coupled to the second base portion by the first hinge and the second base portion is coupled to the third base portion by the second hinge.

Yet another aspect of the disclosure is directed to an inflatable plyometric box having an inflatable member and a foldable stabilizing member. The inflatable member is configured to be inflated to a pressure, and the inflatable member includes one or more rings. The foldable stabilizing member includes a base having two or more base portions coupled together by one or more hinges. The two or more base portions are configured to rotate with respect to each other about the one or more hinges. The foldable stabilizing member further includes one or more hooks configured to receive the one or more rings on the inflatable member to releasably couple the inflatable member to the foldable stabilizing member.

The foregoing and other aspects, features, details, utilities, and advantages of the present disclosure will be apparent from reading the following description and claims, and from reviewing the accompanying drawings.

BRIEF DESCRIPTION OF THE DRAWINGS

Like reference numbers may refer to like or equivalent parts in the several views.

DETAILED DESCRIPTION

Several embodiments of a plyometric box, such as an inflatable plyometric box are disclosed herein. Details of the various embodiments of the present disclosure are described below with specific reference to the figures. Although many of the examples described below make reference to an exercise box, such as an inflatable plyometric box, the present inventor also contemplates the examples herein may also be applicable to other apparatuses. For example, the examples disclosed herein may be applicable to an exercise box, a stool, a bench, a table, a step ladder, or a combination thereof (e.g., a multifunctional device).

Figure 1:
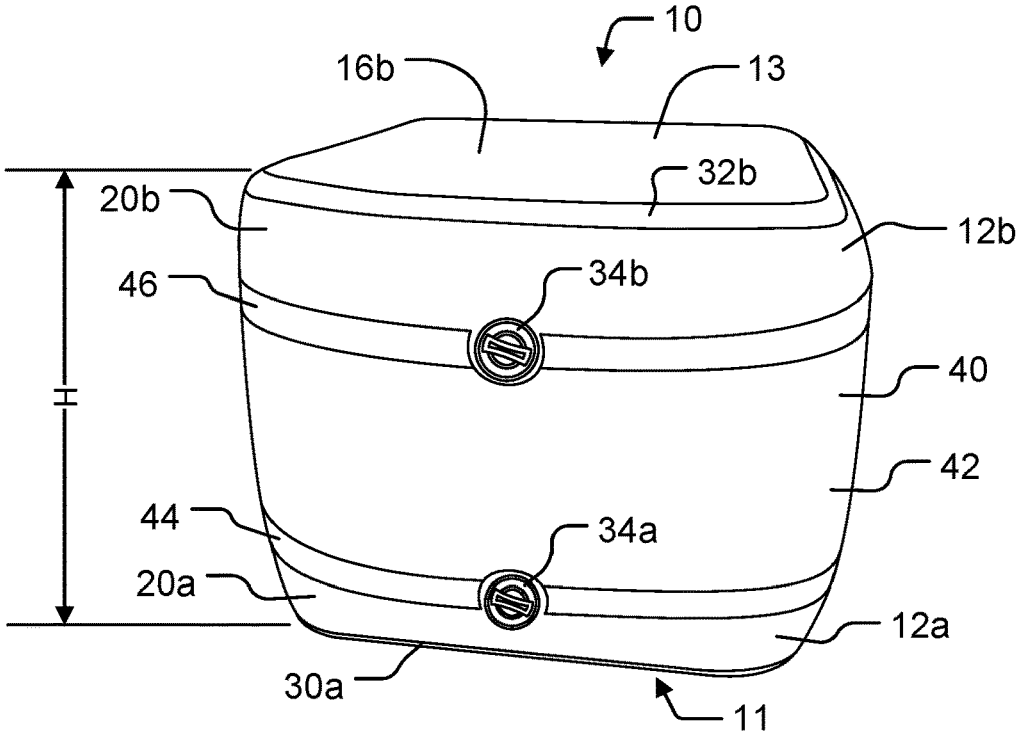
FIG. 1 is a front perspective view of an inflatable plyometric box according to a first embodiment of the disclosure.
Figure 2:
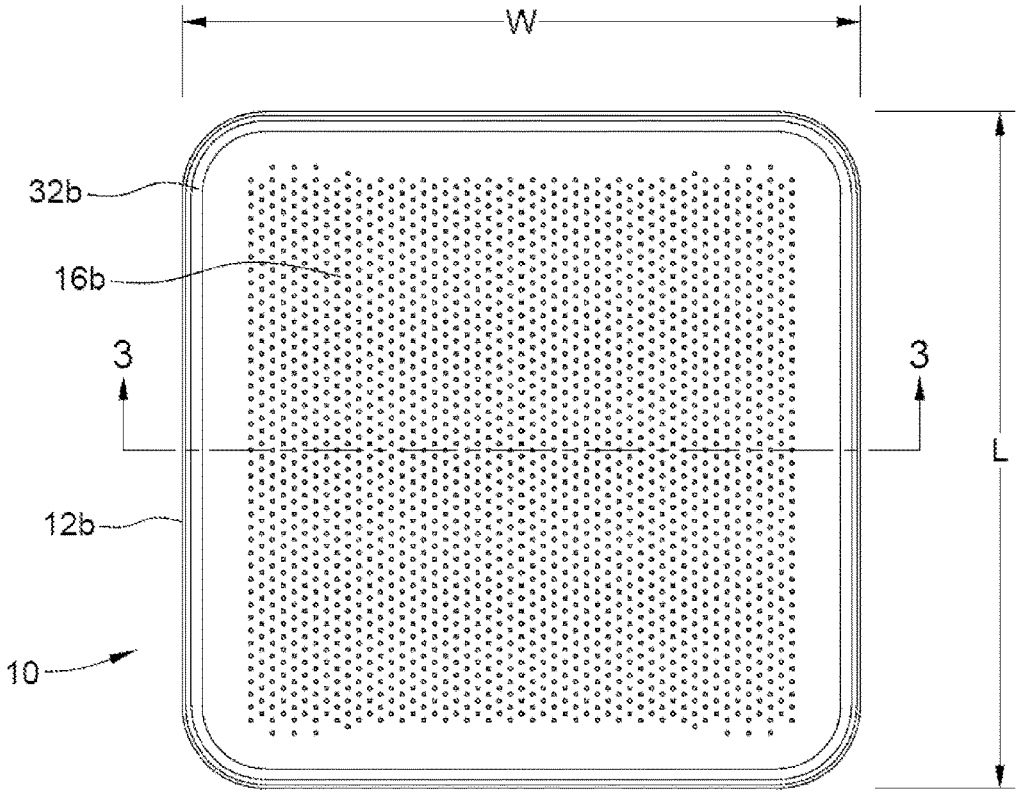
FIG. 2 is a top plan view of an inflatable plyometric box according to the first embodiment of the disclosure.
Figure 3:
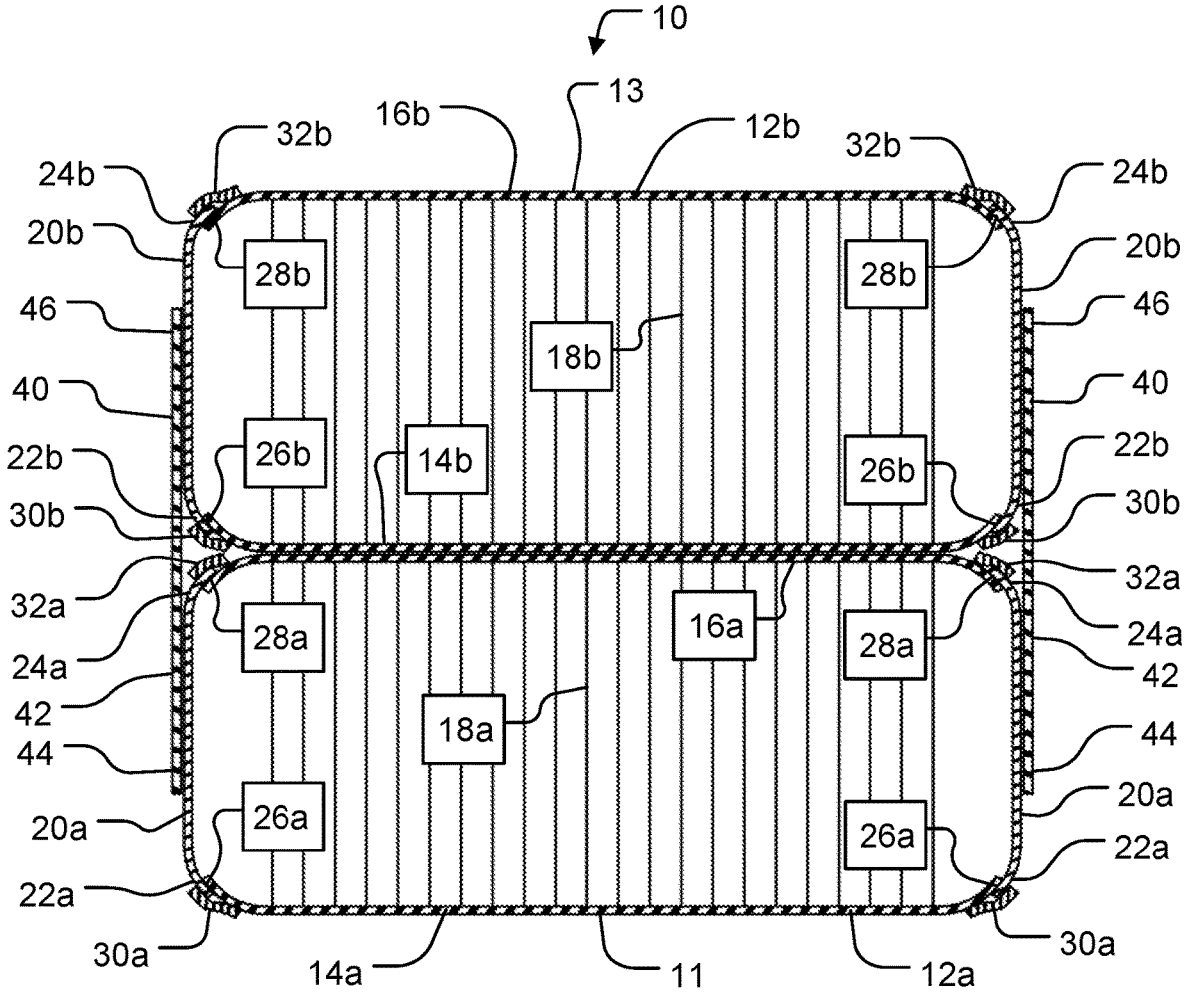
FIG. 3 is a cross-sectional view of the inflatable plyometric box of FIG. 2, taken along line 3-3 in FIG. 2.

With reference to FIGS. 1, 2 and 3, one embodiment of an inflatable plyometric box 10 of the disclosure is shown and described. Inflatable plyometric box 10 has a bottom side 11 for placing on the floor or ground and a top side 13 for a user to land upon. Inflatable plyometric box 10 comprises a first inflatable member 12*a*, a second inflatable member 12*b* located above first inflatable member 12*a*, and a connecting member 40 which is connected to first inflatable member 12*a* and second inflatable member 12*b*. Connecting member 40 secures or connects first inflatable member 12*a* to second inflatable member 12*b*. First and second inflatable members 12*a*, 12*b* are substantially similar or identical and each have an enclosed interior or chamber which is adapted to be airtight and hold air (or any gas) at a desired pressure. As is described more fully below, each of first and second inflatable members 12*a*, 12*b* incorporate drop stitch technology which allows first and second inflatable members 12*a*, 12*b* to hold air (or any gas) at higher pressures and provides a high degree of rigidity to each of first and second inflatable members 12*a*, 12*b* when first and second inflatable members 12*a*, 12*b* are inflated. Inflatable plyometric box 10 is described herein with second inflatable member 12*b* being on top of first inflatable member 12*a*. Thus, part of first inflatable member 12*a* is proximate to and forms the bottom side 11 of inflatable plyometric box 10 and part of second inflatable member 12*b* is proximate to and forms the top side 13 of inflatable plyometric box 10. However, with first and second inflatable members 12*a*, 12*b* being substantially similar or identical, inflatable plyometric box 10 may be used right side up or upside down. Thus, inflatable plyometric box 10 may be used with first inflatable member 12*a* on top of second inflatable member 12*b*.

When first inflatable member 12*a* and second inflatable member 12*b* are each inflated to a desired pressure, first inflatable member 12*a* and second inflatable member 12*b* touch each other, with first inflatable member 12*a* below and supporting second inflatable member 12*b*. Connecting member 40 is connected to both first inflatable member 12*a* and second inflatable member 12*b* and connects first inflatable member 12*a* to second inflatable member 12*b*. Connecting member 40 prevents relative movement between first and second inflatable members 12*a*, 12*b* when first and second inflatable members 12*a*, 12*b* are inflated to the desired pressure. That is, connecting member 40 prevents first and second inflatable members 12*a*, 12*b* from moving side-to-side (or laterally) relative to one another when inflated to the desired pressure. Additionally, connecting member 40 prevents first and second inflatable members 12*a*, 12*b* from moving away from one another when inflated to the desired pressure. When first and second inflatable members 12*a*, 12*b* are inflated to the desired pressure, they provide an inflatable plyometric box 10 which can be jumped on by a user engaging in physical activity or exercise. The desired pressures to which first and second inflatable members 12*a*, 12*b* may be inflated range from about 8 psi (about 55.2 kPa) to about 20 psi (about 137.9 kPa). In various embodiments, for example only and without limitation, the desired pressures to which first and second inflatable members 12*a*, 12*b* may be inflated are about 15 psi (about 103.4 kPa).

Each component of an embodiment of inflatable plyometric box 10 will now be described in turn, beginning with first inflatable member 12*a*, followed by second inflatable member 12*b*, and then connecting member 40.

As described above, in various embodiments, first and second inflatable members 12*a*, 12*b* are substantially similar or identical. Therefore, like portions of first and second inflatable members 12*a*, 12*b* are hereinafter designated by the same reference numerals, for example, first upper surface 16*a* of first inflatable member 12*a* being differentiated from the second upper surface 16*b* of second inflatable member 12*b* by replacing "a" with "b". Where there are differences between the first and second inflatable members 12*a*, 12*b*, those differences will be noted.

Referring now to FIG. 1, first inflatable member 12*a* includes a first lower surface 14*a*, a first upper surface 16*a*, a population of drop stitch threads 18*a* connected to and extending there between, and a first sidewall 20*a* extending around the perimeter of both first lower surface 14*a* and first upper surface 16*a*. First lower surface 14*a* forms the bottom of first inflatable member 12*a* as well as the bottom side 11 of inflatable plyometric box 13. First upper surface 16*a* forms the top of first inflatable member 12*a*. First lower and upper surfaces 14*a*, 16*a* are rectangular in shape with rounded corners; however, it will be understood that first lower and upper surfaces 14*a*, 16*a* may have any shape without departing from the scope of the disclosure. For example only and without limitation, first lower and upper surfaces 14*a*, 16*a* may be circular, rectangular, ovular, hexagonal, octagonal, pentagonal, etc.

A first population of drop stitch threads 18*a* are connected to and extend between first lower surface 14*a* and first upper surface 16*a*. The first population of drop stitch threads 18*a* extends substantially throughout first inflatable member 12*a*. That is, first lower and upper surfaces 14*a*, 16*a* are interconnected by regularly-spaced yarns or threads 18*a* that are arranged across some or all of the surface areas of first lower and upper surfaces 14*a*, 16*a*. Each of the drop stitch threads 18*a* have lower and upper end portions which connect to, respectively, the first lower and upper surfaces 14*a* and 16*a*. First lower surface 14*a* and first upper surface 16*a* are both water and air impervious and are quite flexible in their non-inflated condition.

The lower and upper ends of the drop stitch threads 18*a* are embedded within the first lower surface 14*a* and first upper surface 16*a*, respectively. This is done in a manner such that first inflatable member 12*a* is able to withstand rather heavy loads. Thus, when first inflatable member 12*a* is inflated, first lower surface 14*a* and first upper surface 16*a* tend to move apart, but are restrained by the drop stitch threads 18*a* which become taut due to the inflation. The tension in first lower and upper surfaces 14*a*, 16*a* from the inflation pressure, in combination with the tension in drop stich threads 18*a*, gives rise to a hard, rigid structure, which can be jumped and landed upon by a user.

The population of drop stitch threads 18*a* may be arranged in any pattern along first lower and upper surfaces 14*a*, 16*a* known in the art without departing from the scope of the disclosure. For example only and without limitation, in various embodiments, the drop stitch threads 18*a* may be in a linear, zigzag, random or other pattern, including, but not limited to "X" and "V" patterns. The use of drop stitch threads 18*a* in first inflatable member 12*a* allows first inflatable member 12*a* to be inflated to a pressure of about 15 psi (about 103.4 kPa).

First sidewall 20*a* extends around the perimeter of both first lower surface 14*a* and first upper surface 16*a* and forms the sides of first inflatable member 12*a*. First sidewall 20*a* has a bottom end 22*a* which is adhered or fused to the perimeter of first lower surface 14*a* forming first lower seam 26*a*. Additionally, first sidewall 20*a* has a top end 24*a* which is adhered or fused to the perimeter of first upper surface 16*a* forming first upper seam 28*a*. First lower surface 14*a*, first sidewall 20*a* and first upper surface 16*a* cooperate to form an enclosed interior or chamber which is adapted to be airtight and hold air (or any gas) at a desired pressure. While first sidewall 20*a* is shown as a single sheet of material extending around the perimeter of first lower and upper surfaces 14*a*, 16*a*, it will be understood that in various embodiments, first sidewall 20*a* may be made of more than one sheet of material (e.g., 2 sheets, 3 sheets, 4 sheets, 5, sheets, or more) without departing from the scope of the disclosure.

Located in first sidewall 20*a* is a first inflation valve 34*a* through which air (or any gas) may be directed to inflate first inflatable member 12*a* (see FIG. 1). In various embodiments, first inflation valve 34*a* may be a one-way valve which prevents blow back during inflation. First inflation valve 34*a* may be locked in an open position for fast deflation prior to storage and/or transportation. Although first inflation valve 34*a* is described as a one-way valve, it will be understood that any type of inflation valve known in the art may be used without departing from the scope of the disclosure.

First inflatable member 12*a* may also optionally include two narrow strips of material proximate to or on top of first lower and upper seams 26*a*, 28*a*. That is, a first lower strip 30*a* may be adhered to or fused to first inflatable member 12*a* proximate to or on top of first lower seam 26*a* and a first upper strip 32*a* may be adhered to or fused to first inflatable member 12*a* proximate to or on top of first upper seam 28*a*. First lower and upper strips 30*a*, 32*a* may each serve: (1) to reinforce first lower and upper seams 26*a*, 28*a*; and/or (2) as a visual indicator.

Thus first lower and upper seams 26*a*, 28*a* may optionally be reinforced with first lower and upper strips 30*a*, 32*a*. First lower and upper strips 30*a*, 32*a* may be narrow strips of material that may be adhered or fused to first inflatable member 12*a* and overlap first lower and upper seams 26*a*, 28*a*, respectively. That is, first lower and upper strips 30*a*, 32*a* cover first lower and upper seams 26*a*, 28*a*, respectively, along their perimeters and serve to reduce or eliminate the degradation or failure of first lower and upper seams 26*a*, 28*a* due to inflatable plyometric box 10 being repeatedly jumped on by a user. First upper strip 32*a* is covered by connecting member 40; however, first lower strip 30*a* is exposed. Therefore, first lower strip 30*a* further protects first lower seam 26*a* from wear-and-tear from repeated contact with the floor, a user's apparel (e.g., shoes, clothing), a user's body or parts thereof (e.g., hands, feet, legs, etc.), and/or other objects.

In various embodiments, for example only and without limitation, in addition to providing reinforcement and wear resistance, first lower strip 30*a* may have a contrasting color from the color of first sidewall 20*a* and/or first lower surface 14*a*. Thus first lower strip 30*a* may visually stand out to a user such that a user can easily distinguish the boundary of first lower surface 14*a*. First lower strip 30*a* may be, including but not limited to, a bright color, a fluorescent color, alternating in color (e.g., black and white, black and yellow), reflective, phosphorescent, "glow-in-the-dark", or any combination thereof. In some embodiments, first upper strip 32*a* may also have a contrasting color in the same manner as first lower strip 30*a*; however, as first upper strip 32*a* is covered by connecting member 40, a user will not be able to see first upper strip 32*a*.

It will be understood that in other embodiments, for example only and without limitation, first lower strip 30*a* and/or first upper strip 32*a* may be located proximate to first lower and upper seams 26*a*, 28*a*, respectively, but not on top of first lower and upper seams 26*a*, 28*a*. In such embodiments, first lower and upper strips 30*a*, 32*a* may not provide any reinforcement or wear protection, but one or both of first lower and upper strips 30*a*, 32*a* may have a contrasting color as described above. Thus, first lower strip 30*a* and/or first upper strip 32*a* may visually stand out to a user.

As shown, first lower surface 14*a* of inflatable plyometric box 10, is intended to be in contact with a floor during use. Therefore, in various embodiments, for example only and without limitation, first lower surface 14*a* may include an anti-skid or non-slip surface to reduce or eliminate the possibility of inflatable plyometric box 10 moving along the floor during use.

First inflatable member 12*a* may be constructed of a variety of materials known in the art, including but not limited to, polyester, polyurethane, vinyl, polyvinyl chloride (PVC), neoprene, other synthetic or natural materials known in the art, or any combination thereof. Thus for example only and without limitation, first lower surface 14*a*, first upper surface 16*a*, first sidewall 20*a*, first lower reinforcement strip 30*a*, and first upper reinforcement strip 32*a* of first inflatable member 12*a* are all constructed of PVC. For example only and without limitation, first lower surface 14*a* and first upper surface 16*a* may be made of 1000 denier polyester fabric; however stronger or weaker fabrics may be used without departing from the scope of the present disclosure. These components may all be adhered or fused together in a variety of ways known in the art, including but not limited to, adhesives, stitching, radiofrequency (RF) welding, heat welding, or any combination thereof.

Second inflatable member 12*b* of inflatable plyometric box 10 will now be described. In certain embodiments, second inflatable member 12*b* is substantially similar or identical to first inflatable member 12*a*. Second inflatable member 12*b* is above first inflatable member 12*a* and is connected to first inflatable member 12*a* via connecting member 40 (described in greater detail elsewhere herein).

With continued reference to FIG. 2, second inflatable member 12*b* includes a second lower surface 14*b*, a second upper surface 16*b*, a population of drop stitch threads 18*b* connected to and extending there between, and a second sidewall 20*b* extending around the perimeter of both second lower surface 14*b* and second upper surface 16*b*. Second lower surface 14*b* forms the bottom of second inflatable member 12*b* and second upper surface 16*b* forms the top of second inflatable member 12*b* as well as the top side 13 of inflatable plyometric box 10. As shown, when inflatable plyometric box 10 is inflated to the desired pressure, second lower surface 14*b* of second inflatable member 12*b* contacts first upper surface 16*a* of first inflatable member 12*a*, and second upper surface 16*b* forms the top of inflatable plyometric box 10 onto which a user may jump and land upon. Second lower and upper surfaces 14*b*, 16*b* are rectangular in shape with rounded corners; however, it will be understood that second lower and upper surfaces 14*b*, 16*b* may have any shape without departing from the scope of the disclosure. For example only and without limitation, second lower and upper surfaces 14*b*, 16*b* may be circular, rectangular, ovular, hexagonal, octagonal, pentagonal, etc.

A second population of drop stitch threads 18*b* are connected to and extend between second lower surface 14*b* and second upper surface 16*b*. The second population of drop stitch threads 18*b* extends substantially throughout second inflatable member 12*b*. That is, second lower and upper surfaces 14*b*, 16*b* are interconnected by regularly-spaced yarns or threads 18*b* that are arranged across some or all of the surface areas of second lower and upper surfaces 14*b*, 16*b*. Each of the drop stitch threads 18*b* have lower and upper end portions which connect to, respectively, the second lower and upper surfaces 14*b* and 16*b*. Second lower surface 14*b* and first upper surface 16*b* are both water and air impervious and are quite flexible in their non-inflated condition.

The lower and upper ends of the drop stitch threads 18*b* are embedded within second lower surface 14*b* and second upper surface 16*b*, respectively. This is done in a manner such that second inflatable member 12*b* is able to withstand rather heavy loads. Thus, when second inflatable member 12*b* is inflated, second lower surface 14*b* and second upper surface 16*b* tend to move apart, but are restrained by drop stitch threads 18*b* which become taut due to the inflation. The tension in second lower and upper surfaces 14*b*, 16*b* from the inflation pressure, in combination with the tension in drop stich threads 18*b*, gives rise to a hard, substantially rigid structure, which can be jumped and landed upon by a user.

The population of drop stitch threads 18*b* may be arranged in any pattern along second lower and upper surfaces 14*b*, 16*b* known in the art without departing from the scope of the disclosure. For example only and without limitation, in various embodiments, the drop stitch threads 18*b* may be in a linear, zigzag, random or other pattern, including, but not limited to "X" and "V" patterns. The use of drop stitch threads 18*b* in second inflatable member 12*b* allows second inflatable member 12*b* to be inflated to a desired pressure of about 15 psi (about 103.4 kPa).

Second sidewall 20*b* extends around the perimeter of both second lower surface 14*b* and second upper surface 16*b* and forms the sides of second inflatable member 12*b*. Second sidewall 20*b* has a bottom end 22*b* which is adhered or fused to the perimeter of second lower surface 14*b* forming second lower seam 26*b*. Additionally, second sidewall 20*b* has a top end 24*b* which is adhered or fused to the perimeter of second upper surface 16*b* forming second upper seam 28*b*. Second lower surface 14*b*, second sidewall 20*b* and second upper surface 16*b* cooperate to form an enclosed interior or chamber which is adapted to be airtight and hold air (or any gas) at a desired pressure. While second sidewall 20*b* is shown as a single sheet of material extending around the perimeter of second lower and upper surfaces 14*b*, 16*b*, it will be understood that in various embodiments, second sidewall 20*b* may be made of more than one sheet of material (e.g., 2 sheets, 3 sheets, 4 sheets, 5, sheets, or more) without departing from the scope of the disclosure.

Located in second sidewall 20*b* is a second inflation valve 34*b* through which air (or any gas) may be directed to inflate second inflatable member 12*b* (see FIG. 1). In various embodiments, second inflation valve 34*b* may be a one-way valve which prevents blow back during inflation. Second inflation valve 34*b* may be locked in an open position for fast deflation prior to storage and/or transportation. Although second inflation valve 34*b* is described as a one-way valve, it will be understood that any type of inflation valve known in the art may be used without departing from the scope of the disclosure.

Second inflatable member 12*b* may also optionally include two narrow strips of material proximate to or on top of second lower and upper seams 26*b*, 28*b*. That is, a second lower strip 30*b* may be adhered to or fused to second inflatable member 12*b* proximate to or on top of second lower seam 26*b* and a second upper strip 32*b* may be adhered to or fused to second inflatable member 12*b* proximate to or on top of second upper seam 28*b*. Second lower and upper strips 30*b*, 32*b* may each serve: (1) to reinforce second lower and upper seams 26*b*, 28*b*; and/or (2) as a visual indicator.

Thus second lower and upper seams 26*b*, 28*b* may optionally be reinforced with second lower and upper strips 30*b*, 32*b*. Second lower and upper strips 30*b*, 32*b* may be narrow strips of material that may be adhered or fused to second inflatable member 12*b* and overlap second lower and upper seams 26*b*, 28*b*, respectively. That is, second lower and upper strips 30*b*, 32*b* cover second lower and upper seams 26*b*, 28*b*, respectively, along their perimeters and serve to reduce or eliminate the degradation or failure of second lower and upper seams 26*b*, 28*b* due to inflatable plyometric box 10 being repeatedly jumped on by a user. Second lower strip 30*b* is covered by connecting member 40; however, second upper strip 32*b* is exposed (this is the mirror opposite of first inflatable member 12*a*, where first upper strip 32*a* is covered by connecting member 40 and first lower strip 30*a* is exposed). Therefore, second upper strip 32*b* further protects second upper seam 28*b* from wear-and-tear from repeated contact with a user's apparel (e.g., shoes, clothing), a user's body or parts thereof (e.g., hands, feet, legs, etc.), the floor, and/or other objects.

In various embodiments, for example only and without limitation, in addition to providing reinforcement and wear resistance, second upper strip 32*b* may have a contrasting color from the color of second sidewall 20*b* and/or second upper surface 16*b*. Thus second upper strip 32*b* may visually stand out to a user such that a user can easily distinguish the boundary of second upper surface 16*b*. This may be particularly helpful on the top of inflatable plyometric box 10 as it will aid a user in gauging the height and location of the top of inflatable plyometric box 10. Second upper strip 32*b* may be, including but not limited to, a bright color, a fluorescent color, alternating in color (e.g., black and white, black and yellow), reflective, phosphorescent, "glow-in-the-dark", or any combination thereof. In some embodiments, second lower strip 30*b* may also have a contrasting color in the same manner as second upper strip 32*b*; however, as second lower strip 30*b* is covered by connecting member 40, a user will not be able to see second lower strip 30*b*.

It will be understood that in other embodiments, for example only and without limitation, second lower strip 30*b* and/or second upper strip 32*b* may be located proximate to second lower and upper seams 30*b*, 28*b*, respectively, but not on top of second lower and upper seams 26*b*, 28*b*. In such embodiments, second lower and upper strips 30*b*, 32*b* may not provide any reinforcement or wear protection, but one or both of second lower and upper strips 30*b*, 32*b* may have a contrasting color as described above. Thus, second upper strip 32*b* and/or second lower strip 30*b* may visually stand out to a user.

As shown, second upper surface 16*b* of inflatable plyometric box 10, is intended to be the surface that a user jumps and lands upon during use. Therefore, in various embodiments, for example only and without limitation, second upper surface 16*b* may include an anti-skid or non-slip surface to reduce or eliminate the possibility of the user slipping or sliding off of second upper surface 16*b* after they have landed upon inflatable plyometric box 10.

Second inflatable member 12*b* may be constructed of a variety of materials known in the art, including but not limited to, polyester, polyurethane, vinyl, polyvinyl chloride (PVC), neoprene, other synthetic or natural materials known in the art, or any combination thereof. Thus for example only and without limitation, second lower surface 14*b*, second upper surface 16*b*, second sidewall 20*b*, second lower reinforcement strip 30, and second upper reinforcement strip 32*b* of second inflatable member 12*b* are all constructed of PVC. For example only and without limitation, second lower surface 14*b* and second upper surface 16*b* may be made of 1000 denier polyester fabric; however stronger or weaker fabrics may be used without departing from the scope of the present disclosure. These components may all be adhered or fused together in a variety of ways known in the art, including but not limited to, adhesives, stitching, radiofrequency (RF) welding, heat welding, or any combination thereof.

As referenced above, second inflatable member 12*b* is located directly above and comes into contact with first inflatable member 12*a*, when first and second inflatable members 12*a*, 12*b* are inflated to their desired pressures. That is, when first inflatable member 12*a* and second inflatable member 12*b* are inflated to a desired pressure, first upper surface 16*a* of first inflatable member 12*a* is in contact with second lower surface 14*b* of second inflatable member 12*b*. First and second inflatable members 12*a*, 12*b* are connected via connecting member 40. In this embodiment, connecting member 40 comprises a sheet 42 of material which has a bottom end 44 adhered or fused to the perimeter of first sidewall 20*a* of first inflatable member 12*a* and a top end 46 adhered or fused to the perimeter of second sidewall 20*b* of second inflatable member 12*b*. For example only and without limitation, bottom end 44 of sheet 42 is adhered or fused at generally the midpoint along the vertical length of first sidewall 20*a* of first inflatable member 12*a*. Additionally, for example only and without limitation, top end 46 of sheet 42 is adhered or fused at generally the midpoint along the vertical length of second sidewall 20*b* of second inflatable member 12*b*.

The dimension and placement of sheet 42 on first and second inflatable members 12*a*, 12*b* is such that when first and second inflatable members 12*a*, 12*b* are inflated to a desired pressure, first and second inflatable members 12*a*, 12*b* contact one another. The inflation of first and second inflatable members 12*a*, 12*b* to their desired pressures, sheet 42 connecting the inflated first and second inflatable members 12*a*, 12*b*, the contact of first upper surface 16*a* with second lower surface 14*b*, and the drop stitch structure of first and second inflatable members 12*a*, 12*b* produces a substantially rigid structure which is able to support a user landing upon second upper surface 16*b* of second inflatable member 12*b* Thus when first and second inflatable members 12*a*, 12*b*, inflatable plyometric box 10 is substantially rigid such that it can support a user jumping on and landing upon inflatable plyometric box 10.

Thus, sheet 42 serves as connecting member 40 and prevents relative movement between first and second inflatable members 12*a*, 12*b* when first and second inflatable members 12*a*, 12*b* are inflated to the desired pressure. That is, sheet 42 prevents first and second inflatable members 12*a*, 12*b* from moving side-to-side (or laterally) relative to one another when inflated to the desired pressure. Additionally, sheet 42 prevents first and second inflatable members 12*a*, 12*b* from moving away from one another when inflated to the desired pressure. While sheet 42 is shown as a single sheet of material extending around the perimeter of first and second inflatable members 12*a*, 12*b*, it will be understood that in various embodiments, sheet 42 may be made of more than one sheet of material (e.g., 2 sheets, 3 sheets, 4 sheets, 5, sheets, or more) without departing from the scope of the disclosure. Additionally, in various embodiments, for example only and without limitation, the multiple sheets may be discontinuous from one another. That is, connecting member 40 may comprise two separate sheets with one on each opposite side of inflatable plyometric box 10 or four separate sheets with one on each side of inflatable plyometric box.

Sheet 42 may be constructed of a variety of materials known in the art, including but not limited to, polyester, polyurethane, vinyl, polyvinyl chloride (PVC), neoprene, other synthetic or natural materials known in the art, or any combination thereof. For example only and without limitation, sheet 42 may be made of 1000 denier polyester fabric; however stronger or weaker fabrics may be used without departing from the scope of the present disclosure. Sheet 42 may be adhered or fused to first and second inflatable members 12*a*, 12*b* in a variety of ways known in the art, including but not limited to, adhesives, stitching, radiofrequency (RF) welding, heat welding, or any combination thereof.

Standard plyometric boxes range in size from about 6 inches tall to about 48 inches tall and many are sold in set sizes, such as, for example, 6 inches tall, 12 inches tall, 18 inches tall, 20 inches tall, 24 inches tall, 30 inches tall, 36 inches tall, 40 inches tall, 42 inches tall, and 48 inches tall. It will be understood that inflatable plyometric box 10 can be made to any desired height H (see FIG. 1). For example only and without limitation, various embodiments of inflatable plyometric box 10 may have a height from about 6 inches (about 15.24 cm) to about 48 inches (about 121.92 cm) (e.g., about 6 inches (about 15.24 cm), about 12 inches (about 30.48 cm), about 15 inches (about 38.1 cm), about 18 inches (about 45.72 cm), about 20 inches (about 50.8 cm), about 24 inches (about 60.96 cm), about 30 inches (about 76.2 cm), about 36 inches (about 91.44 cm), about 40 inches (about 101.6 cm), about 42 inches (about 106.68), about 48 inches (about 121.92 cm)). In certain embodiments, for example only and without limitation, inflatable plyometric box 10 may have a height equal to or greater than about 15 inches (about 38.1 cm). In other embodiments, for example only and without limitation, inflatable plyometric box 10 may have a height equal to or greater than about 20 inches (about 50.8 cm). In other embodiments, for example only and without limitation, inflatable plyometric box 10 may have a height equal to or greater than about 24 inches (about 60.96 cm). In yet other embodiments, for example only and without limitation, inflatable plyometric box 10 may have a height equal to or greater than about 30 inches (about 76.2 cm). In yet other embodiments, for example only and without limitation, inflatable plyometric box 10 may have a height equal to or greater than about 48 inches (about 121.92 cm). In yet other embodiments, for example only and without limitation, inflatable plyometric box 10 may have a height from about 15 inches (about 38.1 cm) to about 30 inches (about 76.2 cm). In various embodiments, for example only and without limitation, inflatable plyometric box 10 may be produced in heights of about 15 inches (about 38.1 cm), about 20 inches (about 50.8 cm), about 24 inches (about 60.96 cm), and about 30 inches (about 76.2 cm). It will be understood that each of the preceding recited height H dimensions are the height of inflatable plyometric box 10 when first and second inflatable members 12*a*, 12*b* are inflated. For example only and without limitation, inflatable plyometric box 10 may have the preceding recited height H dimensions when first and second inflatable members 12*a*, 12*b* are inflated to a pressure of about 15 psi (about 103.421 kPa).

Inflatable plyometric box 10 may have a length L and width W (see FIG. 2) of a sufficient size to permit a user to land with both feet on the top 13 of inflatable plyometric box 10. Additionally, inflatable plyometric box 10 may have a length L and width W that are substantially equal or equal. As such, the bottom 11 and top 13 of inflatable plyometric box 10 may be substantially square. In certain embodiments, the length L and width W of inflatable plyometric box 10 may be substantially equal or equal to the height H of inflatable plyometric box 10. In other embodiments for example only and without limitation, inflatable plyometric box 10 may have a height H which is greater than its length L and/or width W. In yet other embodiments, however, for example only and without limitation, inflatable plyometric box 10 may have a length L and width W which are different. Thus, inflatable plyometric box 10 may have a length L greater than its width W. As such, the bottom 11 and top 13 of inflatable plyometric box 10 may be substantially rectangular. Additionally, for example only and without limitation, inflatable plyometric box 10 may be shaped like a rectangular prism without departing from the scope of the disclosure.

In various embodiments, for example only and without limitation, inflatable plyometric box 10 may have a length L from about 20 inches (about 50.8 cm) to about 48 inches (about 121.92 cm) (e.g., about 20 inches (about 50.8 cm), about 22 inches (about 55.88 cm), about 24 inches (about 60.96 cm), about 26 inches (about 66.04 cm), about 28 inches (about 71.12 cm), about 30 inches (about 76.2 cm), about 32 inches (about 81.28 cm), about 34 inches (about 86.36 cm), about 36 inches (about 91.44 cm), about 38 inches (about 101.6 cm), about 40 inches (about 101.6 cm), about 42 inches (about 106.68 cm), about 46 inches (about 116.84 cm), about 48 inches (about 121.92 cm)) and may have a width W from about 20 inches (about 50.8 cm) to about 48 inches (about 121.92 cm) (e.g., about 20 inches (about 50.8 cm), about 22 inches (about 55.88 cm), about 24 inches (about 60.96 cm), about 26 inches (about 66.04 cm), about 28 inches (about 71.12 cm), about 30 inches (about 76.2 cm), about 32 inches (about 81.28 cm), about 34 inches (about 86.36 cm), about 36 inches (about 91.44 cm), about 38 inches (about 101.6 cm), about 40 inches (about 101.6 cm), about 42 inches (about 106.68 cm), about 46 inches (about 116.84 cm), about 48 inches (about 121.92 cm)).

In other embodiments, for example only and without limitation, inflatable plyometric box 10 may have a length L from about 24 inches (about 60.96 cm) to about 36 inches (about 91.4 cm) (e.g., about 24 inches (about 60.96 cm), about 26 inches (about 66.04 cm), about 28 inches (about 71.12 cm), about 30 inches (about 76.2 cm), about 32 inches (about 81.28 cm), about 34 inches (about 86.36 cm), about 36 inches (about 91.44 cm)) and may have a width W from about 24 inches (about 60.96 cm) to about 36 inches (about 91.4 cm) (e.g., about 24 inches (about 60.96 cm), about 26 inches (about 66.04 cm), about 28 inches (about 71.12 cm), about 30 inches (about 76.2 cm), about 32 inches (about 81.28 cm), about 34 inches (about 86.36 cm), about 36 inches (about 91.44 cm)). In other embodiments, for example only, inflatable plyometric box 10 has a length L of about 24 inches (about 60.96 cm) and a width W of about 24 inches (about 60.96 cm). In yet other embodiments, for example only and without limitation, inflatable plyometric box 10 has a length L of about 36 inches (about 60.96 cm) and a width W of about 36 inches (about 60.96 cm).

It will be understood that each of the preceding recited length L and width W dimensions are the length L and width W of inflatable plyometric box 10 when first and second inflatable members 12*a*, 12*b* are inflated. For example only and without limitation, inflatable plyometric box 10 may have the preceding recited length L and width W dimensions when first and second inflatable members 12*a*, 12*b* are inflated to a pressure of about 15 psi (about 103.421 kPa).

With continued reference to FIG. 2, in certain embodiments, inflatable plyometric box 10 has a length L which is no more than about 2 times its width W. In other embodiments, in certain embodiments, inflatable plyometric box 10 has a length L which is no more than about 1.5 times its width W. In yet other embodiments, inflatable plyometric box 10 has a length L which is no more than about 1 times its width W.

In various embodiments, first and second inflatable members 12*a*, 12*b* have the same height when inflated to their desired pressures. In other embodiments, for example only and without limitation, first inflatable member 12*a* and second inflatable member 12*b* may have different heights when inflated to their desired pressure (e.g., first inflatable member 12*a* may be shorter or taller than second inflatable member 12*b*). Thus it will be understood that first and second inflatable members 12*a*, 12*b* may have the same or different heights when inflated to their desired pressures, or any combination thereof, without departing from the scope of the disclosure.

For example only and without limitation, inflatable plyometric box 10 has a length L of about 24 inches (about 60.96 cm), a width W of about 24 inches (about 60.96 cm) and a height H of about 24 inches (about 60.96 cm).

As described above in greater detail, the population of drop stich threads 18*a*, 18*b* in first and second inflatable members 12*a*, 12*b*, respectively, make first and second inflatable members 12*a*, 12*b* substantially rigid. Accordingly, when a user jumps upon the central portion of second upper surface 16*b* of second inflatable member 12*b*, inflatable plyometric box 10 supports the user jumping on inflatable plyometric box 10 and is compressed no more than about 5% in height H. Stated differently, one or both of first and second inflatable members 12*a*, 12*b* do not compress such that the height H of inflatable plyometric box 10 is decreased by more than about 5%. That is, when a user jumps upon the central portion of second upper surface 16*b* of second inflatable member 12*b* the single or combined compression of first and second inflatable members 12*a*, 12*b* does not exceed about 5% of the height H of inflatable plyometric box 10. In other embodiments, for example only and without limitation, when a user jumps upon the central portion of second upper surface 16*b* of second inflatable member 12*b*, inflatable plyometric box 10 is compressed no more than about 4% in height H. In other embodiments, for example only and without limitation, when a user jumps upon the central portion of second upper surface 16*b* of second inflatable member 12*b*, inflatable plyometric box 10 is compressed no more than about 3% in height H. In other embodiments, for example only and without limitation, when a user jumps upon the central portion of second upper surface 16*b* of second inflatable member 12*b*, inflatable plyometric box 10 is compressed no more than 2% in height H. In other embodiments, for example only and without limitation, when a user jumps upon the central portion of second upper surface 16*b* of second inflatable member 12*b*, inflatable plyometric box 10 is compressed no more than about 1% in height H. In other embodiments, for example only and without limitation, when a user jumps upon the central portion of second upper surface 16*b* of second inflatable member 12*b*, inflatable plyometric box 10 is compressed no more than about 0.5% in height H.

Additionally, while inflatable plyometric box 10 is shown as having two inflatable members, it will be understood that other embodiments of inflatable plyometric boxes may have one inflatable member or more than two inflatable members stacked upon one another (e.g., 3 inflatable members, 4 inflatable members, 5 inflatable members, 6 inflatable members, 7 inflatable members, 8 inflatable members, 9 inflatable members, 10 inflatable members, or more), without departing from the scope of the disclosure.

Figure 4:
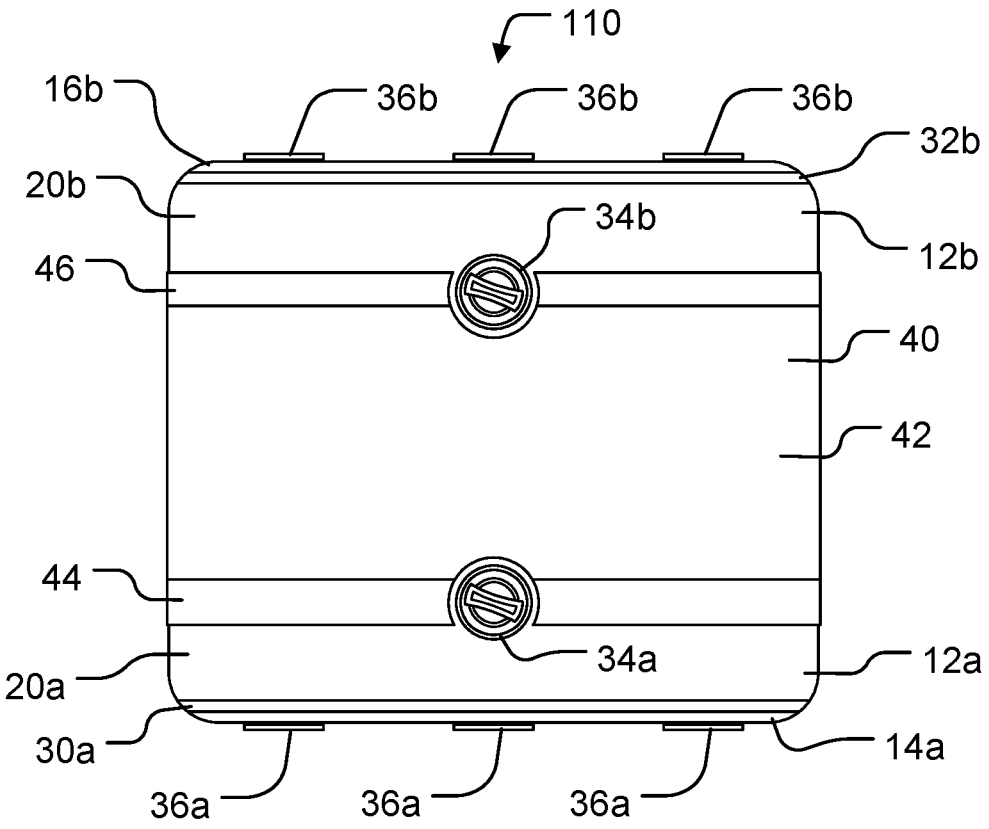
FIG. 4 is a front view of an inflatable plyometric box according to a second embodiment of the disclosure.
Figure 5:
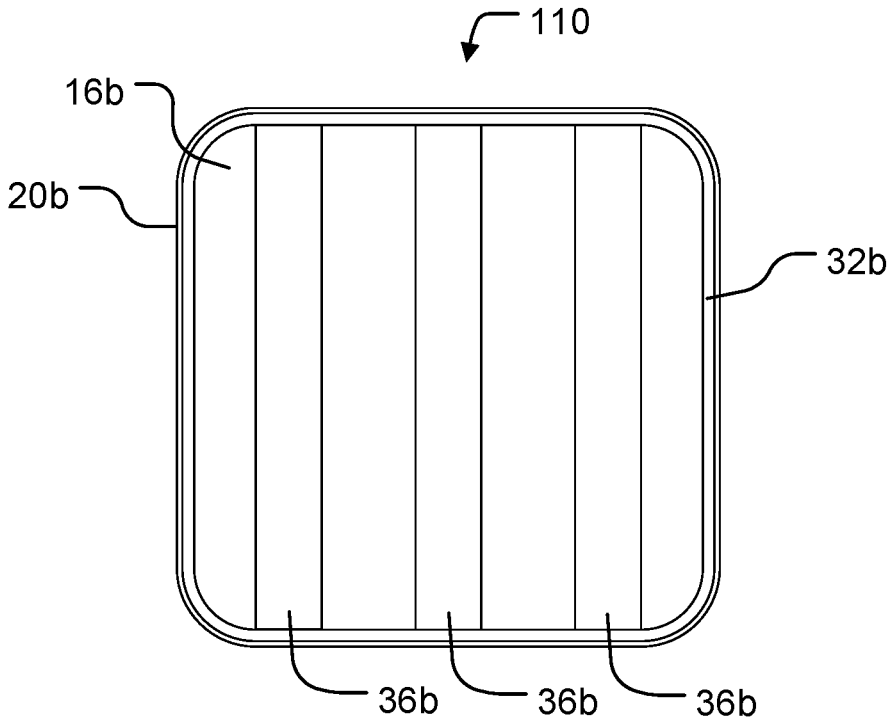
FIG. 5 is a top plan view of an inflatable plyometric box according to the second embodiment of the disclosure.

Another embodiment of an inflatable plyometric box 110 is illustrated in FIGS. 4 and 5 and is described below. Some features of inflatable plyometric box 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Inflatable plyometric box 110 is identical to inflatable plyometric box 10 except that it further includes one or more coupling elements 36*a* affixed to first lower surface 14*a* of first inflatable member 12*a* and one or more coupling elements 36*b* affixed to second upper surface 16*b* of second inflatable member 12*b*. Thus, inflatable plyometric box 110 comprises first inflatable member 12*a*, second inflatable member 12*b* located above first inflatable member 12*a*, and connecting member 40 which is connected to first inflatable member 12*a* and second inflatable member 12*b*.

Coupling elements 36*a*, 36*b* may comprise strips of hook-and-loop style fasteners (e.g., Velcro®-brand fasteners) which may be affixed to first lower surface 14*a* of first inflatable member 12*a* and second upper surface 16*b* of second inflatable member 12*b*. In various embodiments, for example only and without limitation, coupling elements 36*a*, 36*b* may be adhered, fused, sewn and/or otherwise affixed to first lower surface 14*a* of first inflatable member 12*a* and second upper surface 16*b* of second inflatable member 12*b*. While coupling elements 36*a*, 36*b* are described as hook-and-loop style fasteners, it will be understood that other types of fasteners may be used as coupling elements without departing from the scope of the disclosure. For example only and without limitation, in various embodiments, coupling elements may comprise one or more magnets, buckles, slidingly engaging fasteners, or any other type of interlocking fasteners known in the art.

Coupling elements 36*a*, 36*b* allow plyometric box 110 to be coupled to various objects, surfaces, and/or other plyometric boxes. For example, coupling elements 36*a*, 36*b* may fasten with corresponding coupling elements on an additional inflatable or non-inflatable plyometric box to increase the height that a user must jump. Additionally, coupling elements 36*a*, 36*b* may fasten with corresponding coupling elements on a floor in order to securely fasten inflatable plyometric box 110 to the floor such that it does not move during use. Furthermore, coupling elements 36*a*, 36*b* may fasten to a base to increase the stability of inflatable plyometric box 110 (see, e.g., inflatable plyometric box 210 described below).

Additionally, while coupling elements 36*a*, 36*b* are shown on both first lower surface 14*a* of first inflatable member 12*a* and second upper surface 16*b* of second inflatable member 12*b*, in other embodiments of inflatable plyometric box, coupling elements are only included on one side of inflatable plyometric box. That is, for example, an embodiment of inflatable plyometric box may only include coupling elements 36*a* on the first lower surface 14*a* of first inflatable member 12*a*, leaving second upper surface 16*b* of second inflatable member 12*b* with no coupling elements. Alternatively, for example, another embodiment of inflatable plyometric box may only include coupling elements 36*b* on the second upper surface 16*b* of second inflatable member 12*b*, leaving first lower surface 14*a* of first inflatable member 12*a* with no coupling elements. Therefore, coupling elements may optionally be included on one or both sides of inflatable plyometric box.

Figure 6:
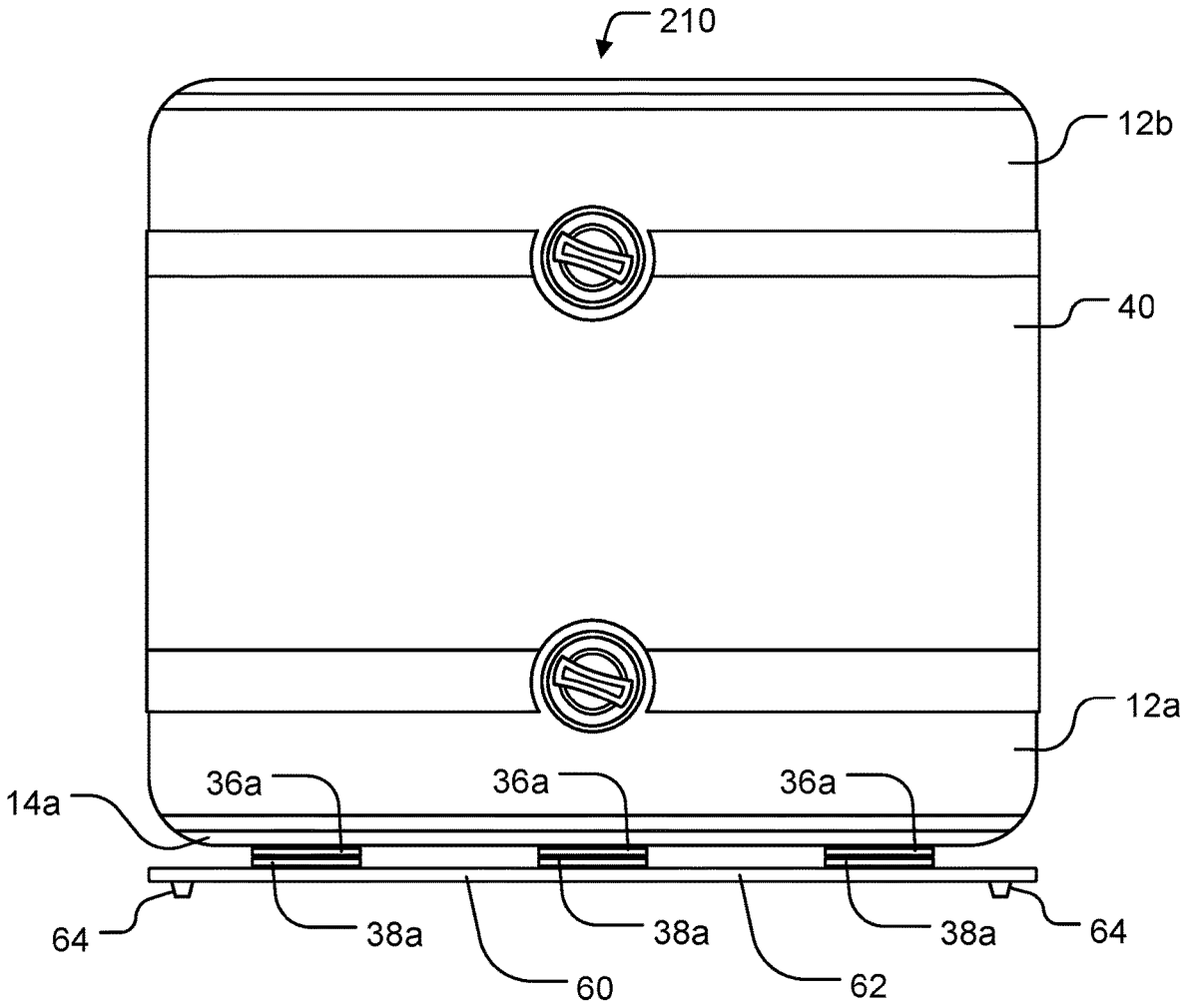
FIG. 6 is a front view of an inflatable plyometric box according to a third embodiment of the disclosure.
Figure 7:
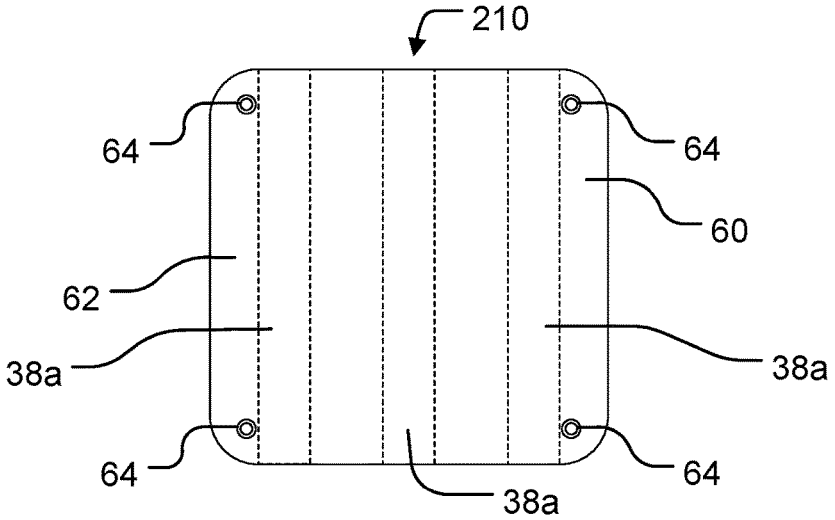
FIG. 7 is a bottom view of an inflatable plyometric box according to the third embodiment of the disclosure.

Another embodiment of an inflatable plyometric box 210 is illustrated in FIGS. 6 and 7 and is described below. Some features of inflatable plyometric box 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Inflatable plyometric box 210 comprises first inflatable member 12*a*, second inflatable member 12*b* located above first inflatable member 12*a*, and connecting member 40 which is connected to first inflatable member 12*a* and second inflatable member 12*b*. Inflatable plyometric box 210 further comprises one or more stabilizing members 60 connected to first lower surface 14*a* of first inflatable member 12*a*. The one or more stabilizing members 60 serve to increase the stability of inflatable plyometric box 210. That is, the one or more stabilizing members 60 reduce or eliminate the possibility of inflatable plyometric box 210 tipping over when a user lands upon inflatable plyometric box 210.

In this embodiment for example only and without limitation, stabilizing member 60 comprises base 62 which is connected to first lower surface 14*a* of first inflatable member 12*a*. Base 62 has substantially the same surface area as first lower surface 14*a* and thus is substantially the same shape as first lower surface 14*a*. In other embodiments, for example only and without limitation, base 62 may have a surface area greater than first lower surface 14*a* such that base 62 extends beyond first lower surface 14*a*. In yet other embodiments, for example only and without limitation, base 62 may have a surface area less than first lower surface 14*a*. Base 62 may be constructed of a rigid material, including but not limited to, plastic, metal, wood, composites (e.g., carbon fiber, Kevlar®, fiberglass), and/or any combination thereof.

Stabilizing member 60 may optionally further include one or more compliance members 64 connected to base 62 opposite first lower surface 14*a*. Thus, when placed on a floor, compliance members 64 contact the floor. Compliance members 64 are able to deform slightly such that inflatable plyometric box 110 can rest stably on an uneven or un-level floor. As shown in FIG. 7, compliance members 64 comprise four bumpers or feet located proximate the corners of base 62.

Similar to inflatable plyometric box 110, inflatable plyometric box 210 includes one or more coupling elements 36*a* affixed to first lower surface 14*a* of first inflatable member 12*a*. Stabilizing member 60 further may include one or more corresponding coupling elements 38*a* affixed to base 62 which fasten to coupling elements 36*a*. Accordingly, stabilizing member 60 may be releasably connected to first lower surface 14*a*. As such, stabilizing member 60 may be removed from inflatable plyometric box 210 when a user desires to transport or store inflatable plyometric box 210. Additionally, in various embodiments, for example only and without limitation, stabilizing member 60 may fold up, thus reducing the size of stabilizing member 60 for transport or storage. Although, stabilizing member 60 is described as being releasably connected to inflatable plyometric box 210, it will be understood that in various embodiments, stabilizing member 60 may be permanently connected to inflatable plyometric box 210 without departing from the scope of the disclosure.

Although not shown, it will be understood that in various embodiments, inflatable plyometric box 210 may further include one or more coupling elements 36*b* affixed to second upper surface 16*b* of second inflatable member 12*b*, as shown in FIGS. 4 and 5, without departing from the scope of the disclosure.

Figure 8:
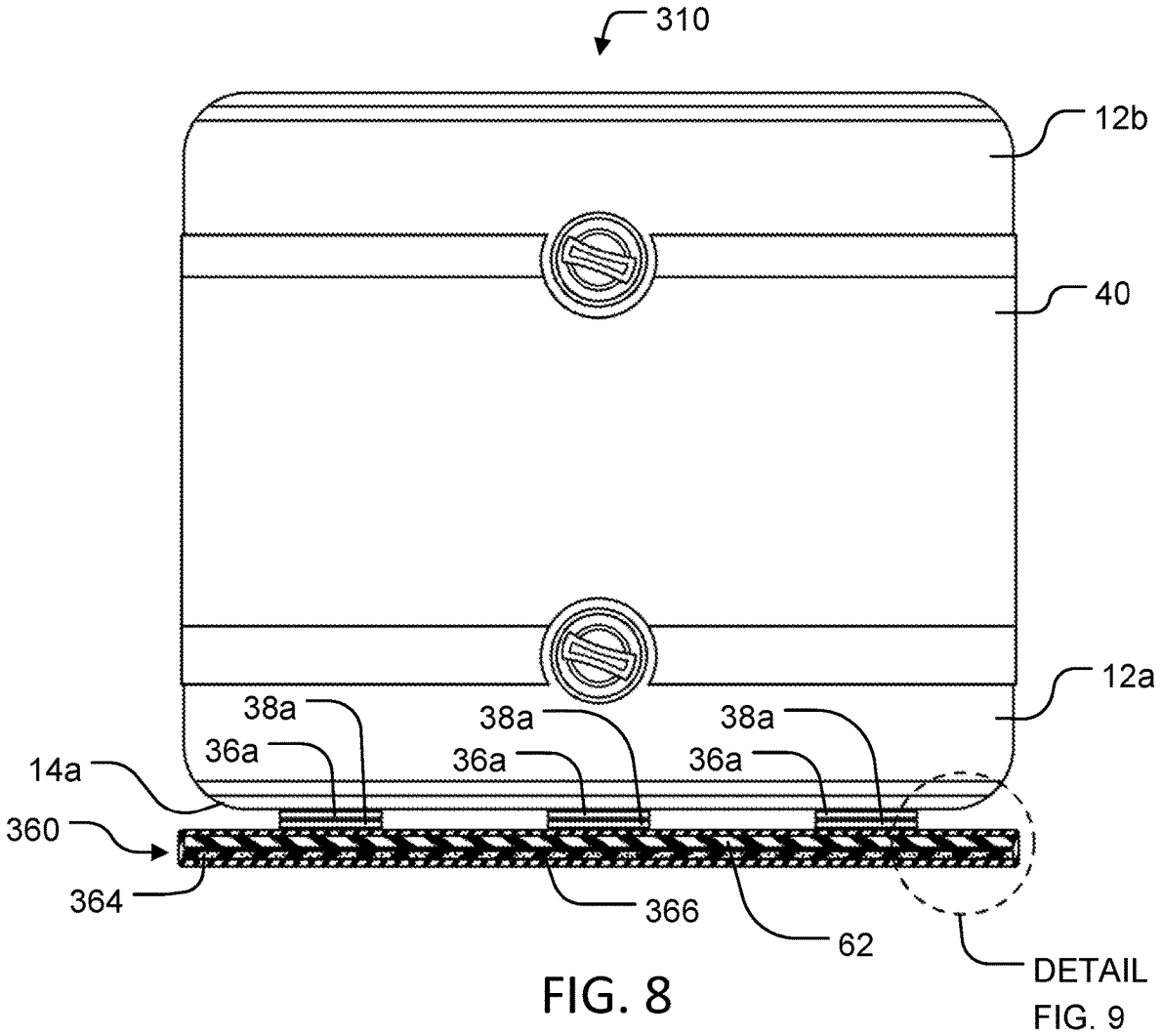
FIG. 8 is a front view of an inflatable plyometric box according to a fourth embodiment of the disclosure.
Figure 9:
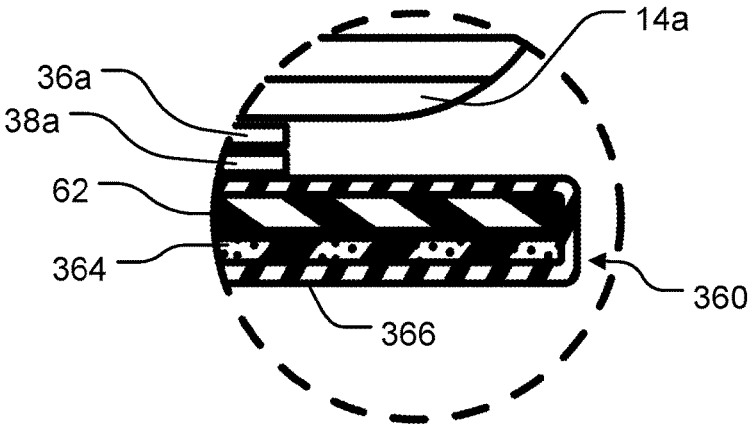
FIG. 9 is an enlarged, fragmentary view of the region in the dashed circle labeled "FIG. 9" in FIG. 8, depicting a cross-sectional view of a portion of an inflatable plyometric box according to the fourth embodiment of the disclosure.

Another embodiment of an inflatable plyometric box 310 is illustrated in FIGS. 8 and 9 and is described below. Some features of inflatable plyometric box 310, 210, 110, and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Inflatable plyometric box 310 is identical to inflatable plyometric box 210, except for stabilizing member 360 which is different from stabilizing member 60. Thus, inflatable plyometric box 310 comprises first inflatable member 12*a*, second inflatable member 12*b* located above first inflatable member 12*a*, and connecting member 40 which is connected to first inflatable member 12*a* and second inflatable member 12*b*. Inflatable plyometric box 310 further comprises stabilizing member 360 connected to first lower surface 14*a* of first inflatable member 12*a*. Stabilizing member 360 serves to increase the stability of inflatable plyometric box 310. That is, stabilizing member 360 reduces or eliminates the possibility of inflatable plyometric box 310 tipping over when a user lands upon inflatable plyometric box 310.

In this embodiment for example only and without limitation, stabilizing member 360 comprises base 62 and compliance member 364 attached or adhered to base 62 opposite first lower surface 14*a*. Compliance member 364 comprises a thin layer of foam rubber or similar compliant material which, when inflatable plyometric box 310 is placed on a floor, compliance member 364 contacts the floor and is able to deform slightly such that inflatable plyometric box 310 can rest stably on an uneven or un-level floor. Stabilizing member 360 may further include a protective covering 366 over base 62 and compliance member 364. This protective covering may be rubber, vinyl, PVC or other material known in the art and may also include an anti-skid or non-slip surface to reduce or eliminate the possibility of inflatable plyometric box 310 moving along the floor during use.

Similar to inflatable plyometric boxes 110 and 210, inflatable plyometric box 310 includes one or more coupling elements 36*a* affixed to first lower surface 14*a* of first inflatable member 12*a*. Stabilizing member 360 further may include one or more corresponding coupling elements 38*a* affixed thereto which fasten to coupling elements 36*a*. Accordingly, stabilizing member 360 may be releasably connected to first lower surface 14*a*. As such, stabilizing member 360 may be removed from inflatable plyometric box 310 when a user desires to transport or store inflatable plyometric box 310. Additionally, in various embodiments, for example only and without limitation, stabilizing member 360 may fold up, thus reducing the size of stabilizing member 360 for transport or storage. Although, stabilizing member 360 is described as being releasably connected to inflatable plyometric box 310, it will be understood that in various embodiments, stabilizing member 360 may be permanently connected to inflatable plyometric box 310 without departing from the scope of the disclosure.

Although not shown, it will be understood that in various embodiments, inflatable plyometric box 310 may further include one or more coupling elements 36*b* affixed to second upper surface 16*b* of second inflatable member 12*b*, as shown in FIGS. 4 and 5, without departing from the scope of the disclosure.

Figure 10:
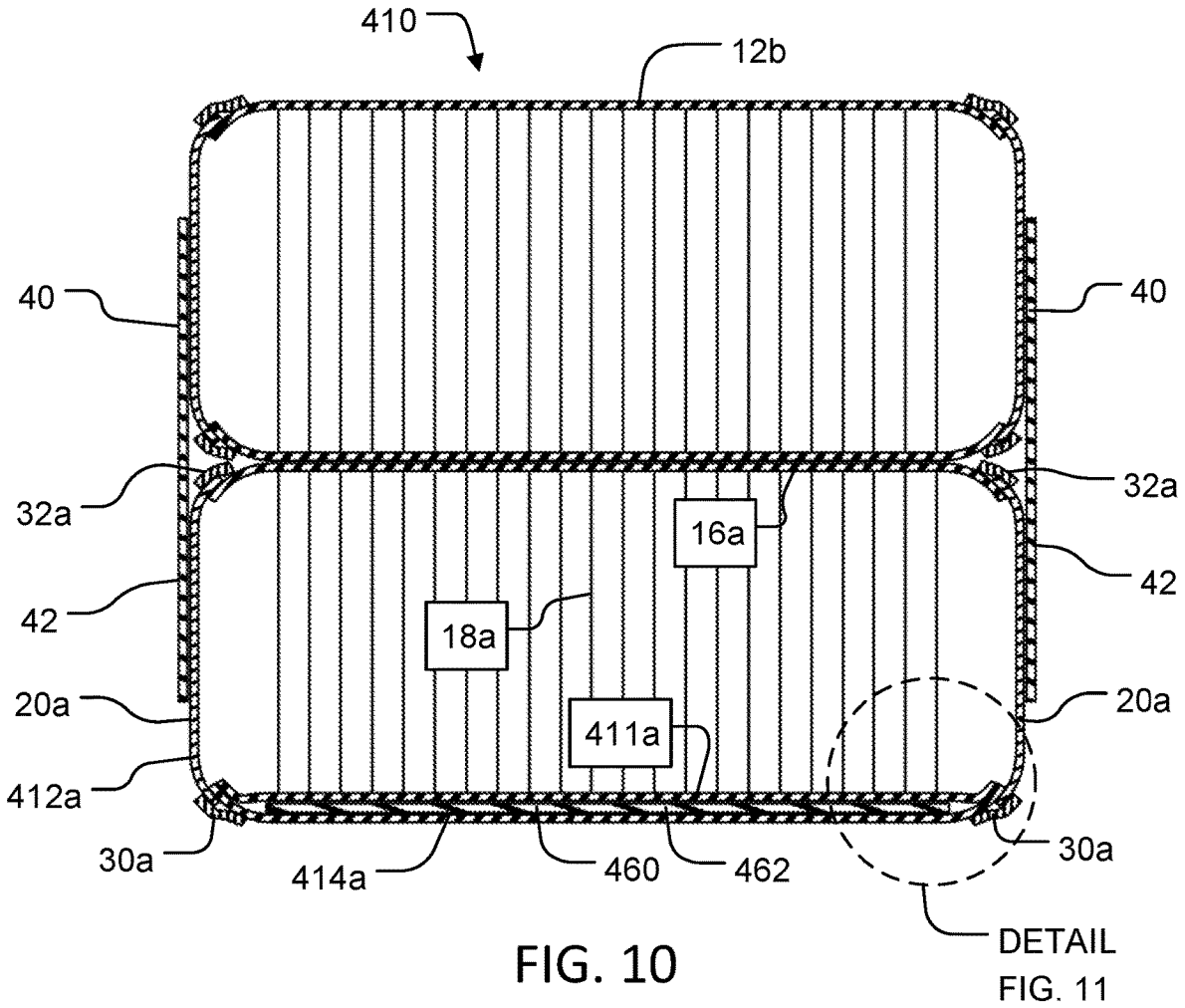
FIG. 10 is similar to FIG. 3, but is a cross-sectional view of an inflatable plyometric box according to a fifth embodiment of the disclosure.
Figure 11:
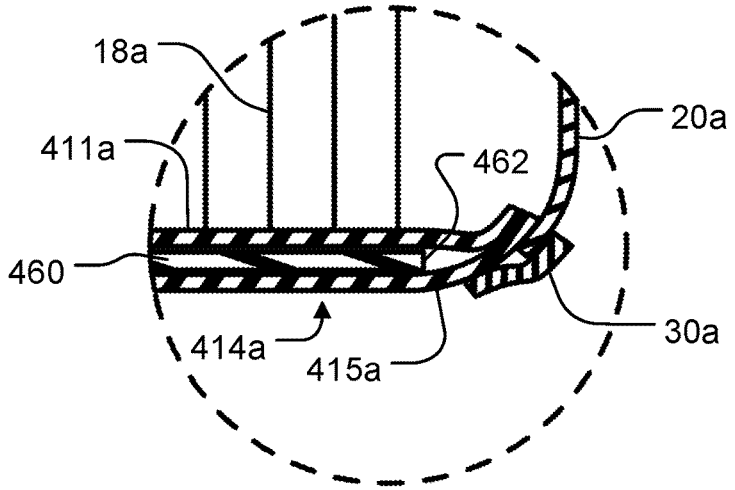
FIG. 11 is an enlarged, fragmentary view of the region in the dashed circle labeled "FIG. 11" in FIG. 10, depicting a cross-sectional view of a portion of an inflatable plyometric box according to a fifth embodiment of the disclosure.

Another embodiment of an inflatable plyometric box 410 is illustrated in FIGS. 10 and 11 and is described below. Some features of inflatable plyometric box 410, 310, 210, 110, and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Inflatable plyometric box 410 which further includes one or more stabilizing members 460 which are integrally formed into inflatable plyometric box 410. Inflatable plyometric box 410 is identical to inflatable plyometric box 10, except for first inflatable member 412*a* which is different from first inflatable member 12*a*. Thus, inflatable plyometric box 410 comprises first inflatable member 412*a*, second inflatable member 12*b* located above first inflatable member 412*a*, and connecting member 40 which is connected to first inflatable member 412*a* and second inflatable member 12*b*.

First inflatable member 412*a* is substantially similar to first inflatable member 12*a* except for the inclusion of a stabilizing member 460 integrally formed into first lower surface 414*a* of first inflatable member 412*a*. That is, first inflatable member 412*a* includes a first lower surface 414*a*, a first upper surface 16*a*, a population of drop stitch threads 18*a* connected to and extending there between, and a first sidewall 20*a* extending around the perimeter of both first lower surface 414*a* and first upper surface 16*a*. Additionally, as described in greater detail elsewhere herein, first inflatable member 412*a* may include first lower and upper strips 30*a*, 32*a*.

Differing from first lower surface 14*a* of inflatable plyometric box 10, first lower surface 414*a* of inflatable plyometric box 410 includes a first lower inner surface 411*a*, a first lower outer surface 415*a*, and a stabilizing member 460 sandwiched there between. Stabilizing member 460 serves to increase the stability of inflatable plyometric box 410. That is, stabilizing member 460 reduces or eliminates the possibility of inflatable plyometric box 410 tipping over when a user lands upon inflatable plyometric box 410.

For example only and without limitation, first lower inner surface 411*a* may be a sheet of PVC or polyester fabric and first lower outer surface 415*a* may be a sheet of PVC or polyester fabric. Stabilizing member 460 comprises base 462. Base 462 may be constructed of a rigid material, including but not limited to, plastic, metal, wood, composites (e.g., carbon fiber, Kevlar®, fiberglass), and/or any combination thereof. Base 462 may be substantially similar in shape to first lower inner and outer surfaces 411*a*, 415*a*; however base 462 may have a surface area slightly less than that of first lower inner and outer surfaces 411*a*, 415*a*, such that the perimeters of first lower inner and outer surfaces 411*a*, 415*a* extend beyond base 462. Base 462 may be adhered on its top side to first lower inner surface 411*a* and adhered on its bottom side to first lower outer surface 415*a*. The perimeter of first lower inner surface 411*a* may then be adhered or fused to the perimeter of first lower outer surface 415*a*, thus fully encapsulating base 462 within first lower inner and outer surfaces 411*a*, 415*a*. By adhering base 462 to both first lower inner and outer surfaces 411*a*, 415*a*, relative movement of base 462 and first lower inner and outer surfaces 411*a*, 415*a* is eliminated. This may increase the stability of inflatable plyometric box 410.

Figure 12:
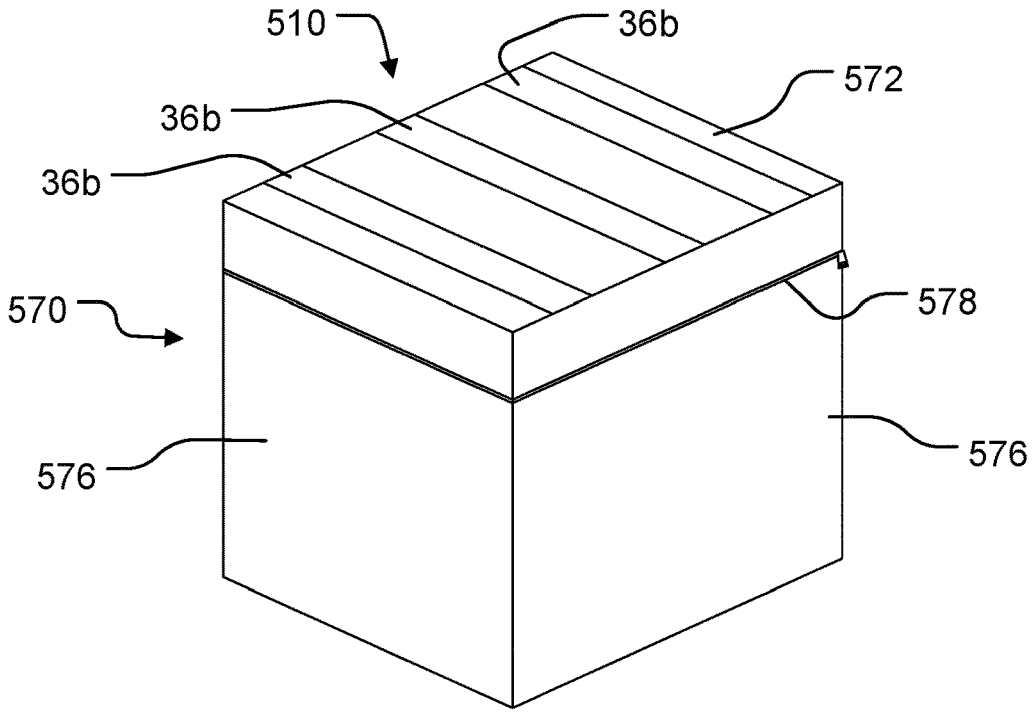
FIG. 12 is an isometric view of an inflatable plyometric box according to a sixth embodiment of the disclosure.
Figure 13:
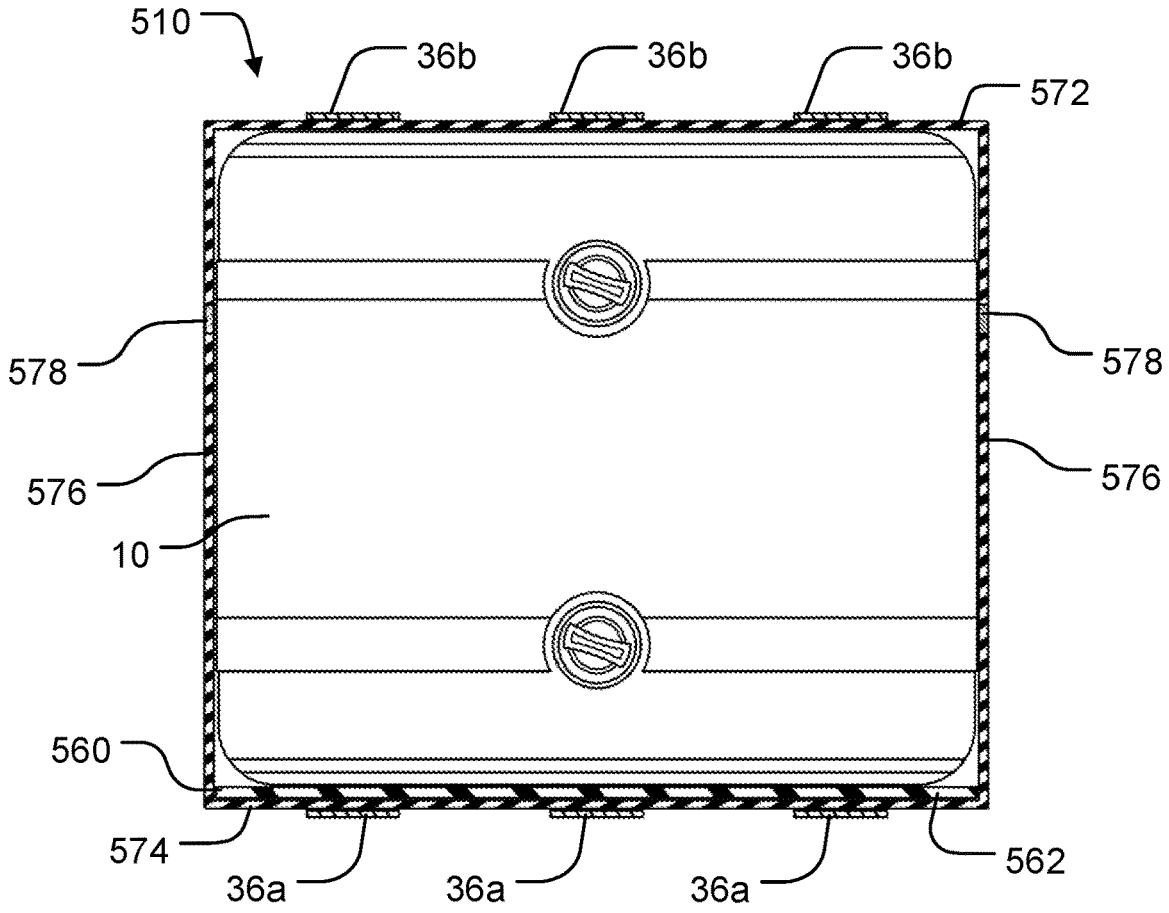
FIG. 13 is similar to FIG. 3, but is a cross-sectional view of an inflatable plyometric box according to the sixth embodiment of the disclosure.

Another embodiment of an inflatable plyometric box 510 is illustrated in FIGS. 12 and 13 and is described below. Some features of inflatable plyometric box 510, 410, 310, 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Inflatable plyometric box 510 comprises inflatable plyometric box 10 which is inside protective cover 570. Protective cover 570 includes a top side 572, a bottom side 574 and a population of side panels 576 connected to the top and bottom sides 572, 574 to define an enclosed space into which inflatable plyometric box 10 may fit. Protective cover 570 may further include a zipper 578 located in one or more of the population of side panels 576 which can be unzipped to permit placing inflatable plyometric box 10 into protective cover 570. Zipper 578 may extend around three sides of protective cover 570; however, it will be understood that zipper 578 may be placed in any location on protective cover 570 which permits inflatable plyometric box 10 into protective cover 570. Additionally, while protective cover 570 is shown as having zipper 578, in various embodiments, for example only and without limitation, zipper 578 may be replaced with buttons and corresponding button holes, snaps, hook-and-loop style fasteners, magnets, buckles, slidingly engaging fasteners, or any other type of interlocking fasteners.

Protective cover 570 further includes a stabilizing member 560 located within protective cover 570 proximate the interior surface of bottom side 574 of protective cover 570. Thus, stabilizing member 560 is shown as being sandwiched between bottom side 574 of protective cover 570 and inflatable plyometric box 10. Stabilizing member 560 comprises base 562. Base 562 may be constructed of a rigid material, including but not limited to, plastic, metal, wood, composites (e.g., carbon fiber, Kevlar®, fiberglass), and/or any combination thereof. In various embodiments, base 562 may be adhered or affixed to the interior surface of bottom side 574 of protective cover 570. In other embodiments, for example only and without limitation, base 562 may be placed inside protective cover 570 against the interior surface of bottom side 574 and inflatable plyometric box 10 is then placed inside protective cover 570 and against base 562. In such embodiments, base 562 is held in place by being sandwiched between bottom side 574 of protective cover 570 and inflatable plyometric box 10. Accordingly, base 562 need not be adhered or affixed to protective cover 570.

Protective cover 570 provides a layer of protection over inflatable plyometric box 10 which can be placed therein. Instead of a user jumping and landing upon second upper surface 16*b* of inflatable plyometric box 10, the user jumps and lands upon protective cover 570. Thus, protective cover 570 may protect inflatable plyometric box 10 therein from wear and/or puncture, thus increasing the useful life of inflatable plyometric box 10.

In various embodiments, protective cover 570 may further optionally include one or more coupling elements 36*a*, 36*b* as described in greater detail elsewhere herein. As shown in FIGS. 12 and 13, for example only and without limitation, coupling elements 36*a*, 36*b* may be affixed to the bottom and top sides 574, 572, respectively.

Figure 14:
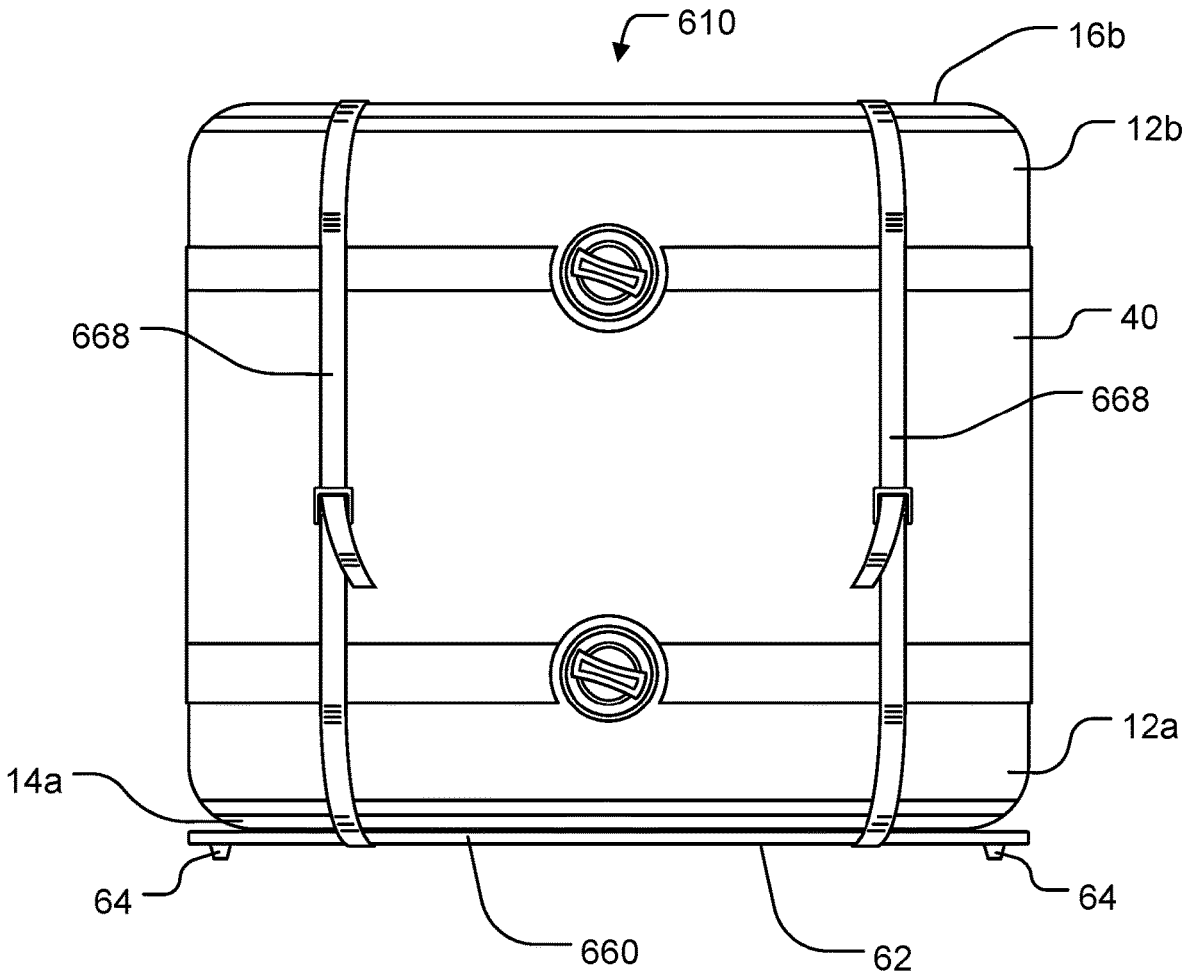
FIG. 14 is a front view of an inflatable plyometric box according to a seventh embodiment of the disclosure.

Another embodiment of an inflatable plyometric box 610 is illustrated in FIG. 14 and is described below. Some features of inflatable plyometric box 610, 510, 410, 310, 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Inflatable plyometric box 610 is identical to inflatable plyometric box 10 except that it further includes stabilizing member 660 attached to first lower surface 14*a* of first inflatable member 12*a*. Thus, inflatable plyometric box 610 comprises first inflatable member 12*a*, second inflatable member 12*b* located above first inflatable member 12*a*, and connecting member 40 which is connected to first inflatable member 12*a* and second inflatable member 12*b*.

As stated previously, inflatable plyometric box 610 includes stabilizing member 660 which serves to increase the stability of inflatable plyometric box 610. That is, stabilizing member 660 reduces or eliminates the possibility of inflatable plyometric box 610 tipping over when a user lands upon inflatable plyometric box 610. In this embodiment for example only and without limitation, stabilizing member 660 comprises base 62 and may optionally include one or more compliance members 64 connected to base 62 opposite first lower surface 14*a*, as described in greater detail elsewhere herein. Stabilizing member 660 further comprises one or more straps 668 which are adapted to attach or affix base 62 to first and second inflatable members 12*a*, 12*b*. Straps 668 extend over second upper surface 16*b* of second inflatable member 12*b*, down along connecting member 40, under base 62 and back up connecting member 40. Straps 668 are tightened to press and hold base 62 against first lower surface 14*a* of first inflatable member. Thus, straps 668 extend around the top of first and second inflatable bases 12*a*, 12*b* and are tightened to securely attach base 62 of stabilizing member 660 to first and second inflatable bases 12*a*, 12*b*.

Although, stabilizing member 660 is shown having base 62 and compliance members 64, it will be understood that in other embodiments for example and without limitation, a stabilizing member 660 may be substantially similar to stabilizing member 360 (see FIGS. 8 and 9) without departing from the scope of the invention. That is, in various embodiments, stabilizing member 660 may include base 62 and a compliance member, like compliance member 364, such as a thin layer of foam rubber or similar compliant material, which is strapped to first and second inflatable members 12*a*, 12*b* using straps 668. Like stabilizing member 360, in various embodiments, stabilizing member 660 may include a protective covering like protective covering 366 which covers base 62 and the compliance member.

Figure 15:
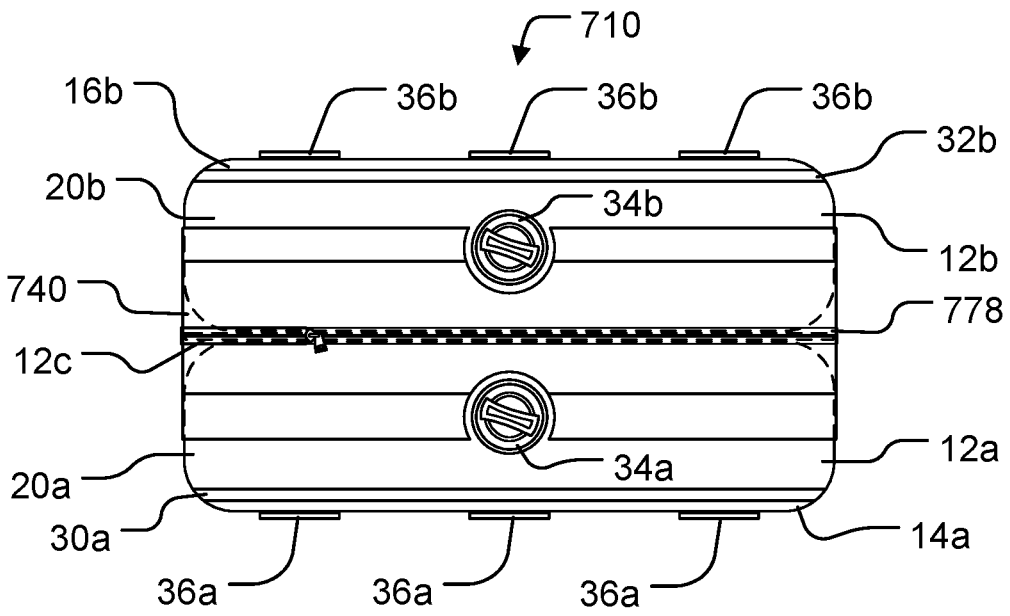
FIG. 15 is a front view of an expandable inflatable plyometric box in a non-expanded state according to an eighth embodiment of the disclosure.
Figure 16:
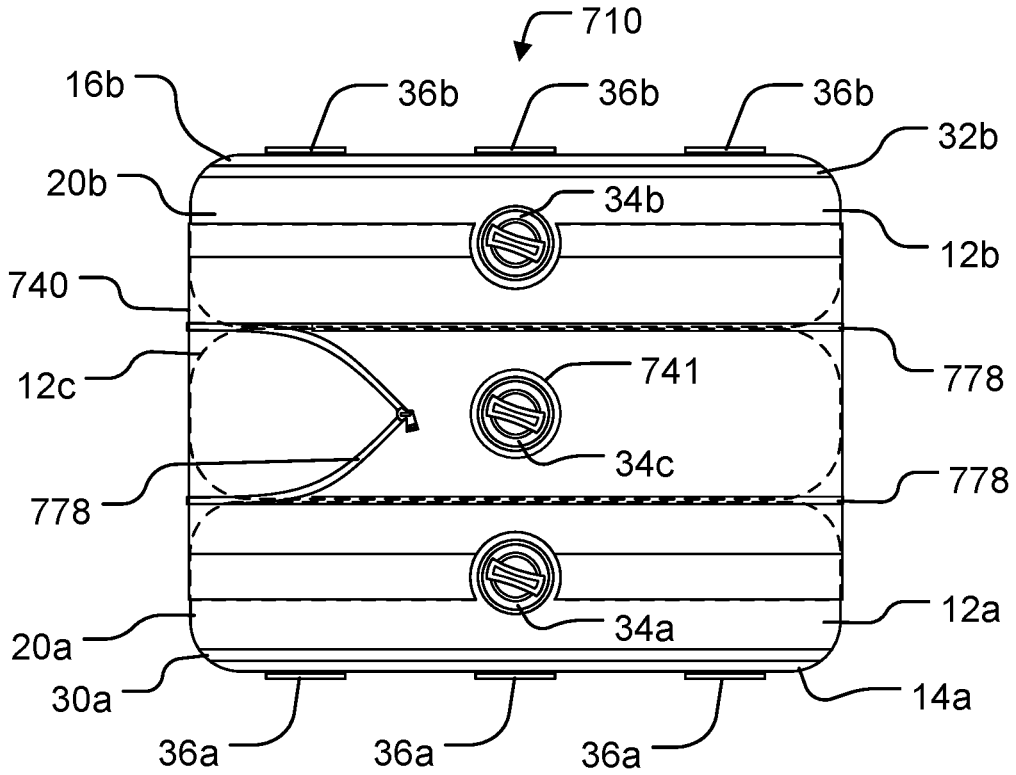
FIG. 16 is a front view of an expandable inflatable plyometric box in an expanded state according to an eighth embodiment of the disclosure.

Another embodiment of an inflatable plyometric box 710 is illustrated in FIGS. 15 and 16 and is described below. Some features of inflatable plyometric box 710, 610, 510, 410, 310, 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Inflatable plyometric box 710 is an expandable inflatable plyometric box which includes three inflatable members stacked upon one another, wherein the middle or third inflatable member may be inflated or deflated to change the height of inflatable plyometric box. Therefore, a user may use a single inflatable plyometric box 710 and expand it to different heights as desired without needing two separate plyometric boxes at two different heights. FIG. 15 shows the third inflatable member of inflatable plyometric box 710 deflated such that inflatable plyometric box 710 is in a non-expanded state and FIG. 16 shows the third inflatable member of inflatable plyometric box 710 inflated such that inflatable plyometric box 710 is in an expanded state.

Inflatable plyometric box 710 thus includes a first inflatable member 12*a*, a second inflatable member 12*b*, a third inflatable member 12*c* and a connecting member 740 which is connected to first inflatable member 12*a* and second inflatable member 12*b*. Third inflatable member 12*c* has substantially similar or identical construction as first and second inflatable members 12*a*, 12*b* as described in greater detail elsewhere herein. Like first and second inflatable members 12*a*, 12*b*, third inflatable member 12*c* has an enclosed interior or chamber which is adapted to be airtight and hold air (or any gas) at a desired pressure. Additionally, third inflatable member 12*c* incorporates drop stitch technology which allows third inflatable member 12*c* to hold air (or any gas) at higher pressures and provides a high degree of rigidity to third inflatable member 12*c*. Again, like first and second inflatable members 12*a*, 12*b*, third inflatable member 12*c* has an inflation valve 34*c* through which air (or any gas) may be directed to inflate third inflatable member 12*c*.

As shown in FIGS. 15 and 16, connecting member 740 of inflatable plyometric box 710 includes a zipper 778 which extends around the sides of connecting member 740. Connecting member 740 and zipper 778 function the same as the expandable sections of expandable luggage as known in the art. The user closes or zips zipper 778 when they desire to use inflatable plyometric box 710 at a first, shorter height and the user opens or unzips zipper 778 when they desire to use inflatable plyometric box 710 at a second, taller height. Therefore, opening and closing zipper 778 enables expansion and contraction of connecting member 740. Connecting member 740 includes a hole 741 through which inflation valve 34*c* of third inflatable member 12*c* can be accessed for inflating third inflatable member 12*c*.

As shown in FIG. 15, third inflatable member 12*c* is deflated, first and second inflatable members 12*a*, 12*b* are inflated to the desired pressure, and zipper 778 is closed. In this configuration, first and second inflatable members 12*a*, 12*b* are held against the deflated third inflatable member 12*c* by connecting member 740. Thus, connecting member 740 prevents relative movement between first and second inflatable members 12*a*, 12*b* when first and second inflatable members 12*a*, 12*b* are inflated to the desired pressure. That is, connecting member 740 prevents first and second inflatable members 12*a*, 12*b* from moving side-to-side (or laterally) relative to one another when inflated to the desired pressure. Additionally, connecting member 740 prevents first and second inflatable members 12*a*, 12*b* from moving away from one another when inflated to the desired pressure. Inflatable plyometric box 710 is thus is at a first, shorter height and can jumped on by a user engaging in physical activity or exercise.

As shown in FIG. 16, zipper 778 is opened or unzipped and all three of first, second and third inflatable members 12*a*, 12*b*, 12*c* are inflated to the desired pressure. In this configuration, first and second inflatable members 12*a*, 12*b* are held against the inflated third inflatable member 12*c* by connecting member 740. Thus, connecting member 740 prevents relative movement between first, second and third inflatable members 12*a*, 12*b*, 12*c* when first, second and third inflatable members 12*a*, 12*b*, 12*c* are inflated to the desired pressure. That is, connecting member 740 prevents first, second and third inflatable members 12*a*, 12*b*, 12*c* from moving side-to-side (or laterally) relative to one another when inflated to the desired pressure. Additionally, connecting member 740 prevents first, second and third inflatable members 12*a*, 12*b*, 12*c* from moving away from one another when inflated to the desired pressure. Inflatable plyometric box 710 is thus is at a second, taller height and can jumped on by a user engaging in physical activity or exercise.

In various embodiments, inflatable plyometric box 710 may further optionally include one or more coupling elements 36*a*, 36*b* as described in greater detail elsewhere herein without departing from the scope of the present disclosure.

Although not shown, it will be understood that inflatable plyometric box 710 may optionally include any of the stabilizing members 60, 360, 660 described herein without departing from the scope of the disclosure. Additionally, in various embodiments, inflatable plyometric box 710 may include a built-in stabilizing member similar to stabilizing member 460 of inflatable plyometric box 410, without departing from the scope of the disclosure.

In various embodiments, first, second and third inflatable members 12*a*, 12*b*, 12*c* are identical. For example only and without limitation, first, second and third inflatable members 12*a*, 12*b*, 12*c* may all have the same height when inflated to their desired pressures. In other embodiments, for example only and without limitation, first and second inflatable members 12*a*, 12*b* may have the same height when inflated to their desired pressures and third inflatable member 12*c* may have a different height when inflated to its desired pressure (e.g., third inflatable member 12*c* may be shorter or taller than first and second inflatable members 12*a*, 12*b*). In yet other embodiments, for example only and without limitation, first and third inflatable members 12*a*, 12*c* may have the same height when inflated to their desired pressures and second inflatable member 12*b* may have a different height when inflated to its desired pressure (e.g., second inflatable member 12*b* may be shorter or taller than first and third inflatable members 12*a*, 12*c*). In yet other embodiments, for example only and without limitation, second and third inflatable members 12*b*, 12*c* may have the same height when inflated to their desired pressures and first inflatable member 12*a* may have a different height when inflated to its desired pressure (e.g., first inflatable member 12*a* may be shorter or taller than second and third inflatable members 12*b*, 12*c*). In yet other embodiments, for example only and without limitation, first, second and third inflatable members 12*a*, 12*b*, 12*c* may each have different heights when inflated to their desired pressures. Thus it will be understood that each of first, second and third inflatable members 12*a*, 12*b*, 12*c* may have the same or different heights when inflated to their desired pressures, or any combination thereof, without departing from the scope of the disclosure.

Additionally, while inflatable plyometric box 710 is shown as having three inflatable members, it will be understood that other embodiments of inflatable plyometric boxes may have one inflatable member, two inflatable members, or more than three inflatable members stacked upon one another (e.g., 4 inflatable members, 5 inflatable members, 6 inflatable members, 7 inflatable members, 8 inflatable members, 9 inflatable members, 10 inflatable members, or more), without departing from the scope of the disclosure.

Figure 17:
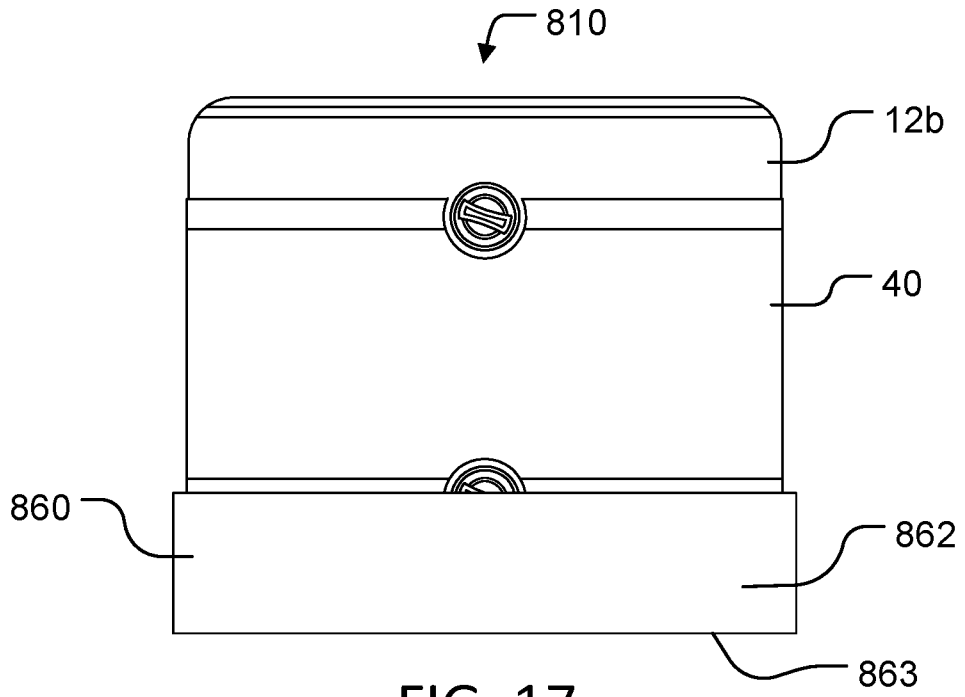
FIG. 17 is a front view of an inflatable plyometric box according to a ninth embodiment of the disclosure.
Figure 18:
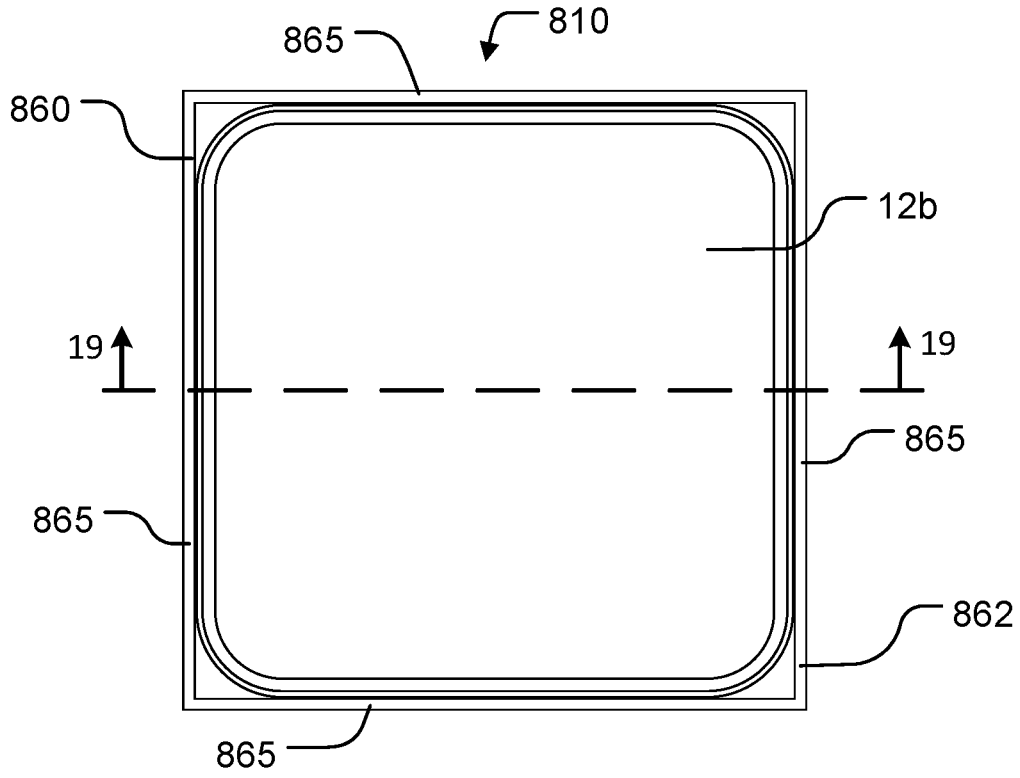
FIG. 18 is a top plan view of an inflatable plyometric box according to the ninth embodiment of the disclosure.
Figure 19:
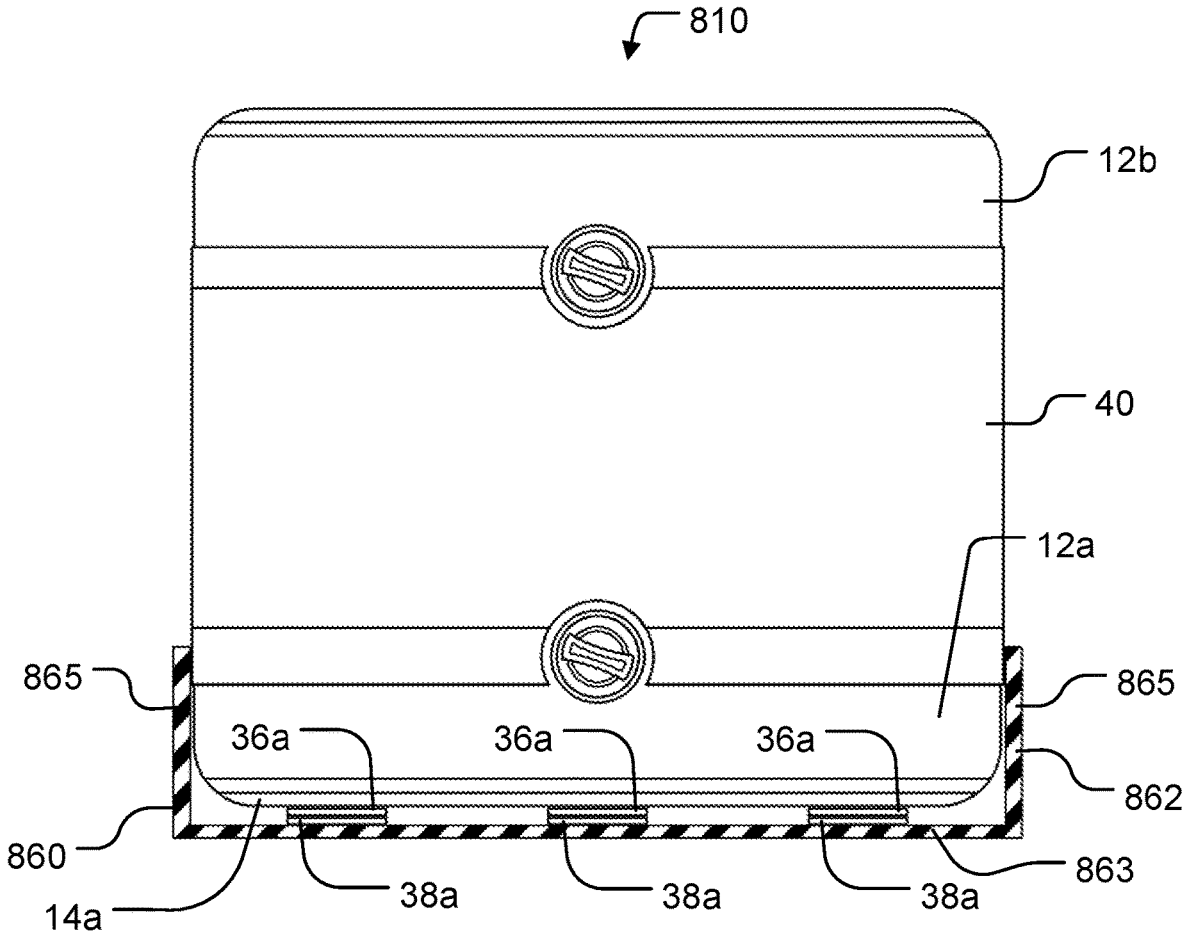
FIG. 19 is a partial cross-sectional view of the inflatable plyometric box of FIG. 18, taken along line 19-19 in FIG. 18.

Another embodiment of an inflatable plyometric box 810 is illustrated in FIGS. 17, 18 and 19 and is described below. Some features of inflatable plyometric box 810, 710, 610, 510, 410, 310, 210, 110, and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Inflatable plyometric box 810 is identical to inflatable plyometric box 210, except for stabilizing member 860 which is different from stabilizing member 60. Thus, inflatable plyometric box 810 comprises first inflatable member 12*a*, second inflatable member 12*b* located above first inflatable member 12*a*, and connecting member 40 which is connected to first inflatable member 12*a* and second inflatable member 12*b*. Inflatable plyometric box 810 further comprises stabilizing member 860 connected to first lower surface 14*a* of first inflatable member 12*a*. Stabilizing member 860 serves to increase the stability of inflatable plyometric box 810. That is, stabilizing member 860 reduces or eliminates the possibility of inflatable plyometric box 810 tipping over when a user lands upon inflatable plyometric box 810.

In this embodiment for example only and without limitation, stabilizing member 860 comprises box 862 having a bottom 863 and four sides 865 extending upward from bottom 863. Box 862 has an open top side such that inflatable plyometric box 810 can be inserted into box 862. Sides 865 of box 862 are shorter in height than the height of inflatable plyometric box 810. In various embodiments, for example only and without limitation, sides 865 of box 862 have a height less than or equal to about half the height of inflatable plyometric box 810. In other embodiments, for example only and without limitation, sides 865 of box 862 have a height less than or equal to about a quarter of the height of inflatable plyometric box 810. In yet other embodiments, for example only and without limitation, sides 865 of box 862 have a height less than or equal to about an eighth of the height of inflatable plyometric box 810. In various embodiments, for example only and without limitation, sides 865 of box 862 have a height of about 12 inches (about 30.48 cm) or less. In other embodiments, for example only and without limitation, sides 865 of box 862 have a height of about 6 inches (about 15.24 cm) or less.

The dimensions of box 862 are such that when inflatable plyometric box 810 is inflated to its desired gas pressure, inflatable plyometric box 810 may have a friction fit inside sides 865 of box 862. Thus, when inflatable plyometric box 810 is inflated to its desired gas pressure, inflatable plyometric box 810 fits snugly inside box 862.

Similar to inflatable plyometric boxes 110 and 210, inflatable plyometric box 810 includes one or more coupling elements 36*a* affixed to first lower surface 14*a* of first inflatable member 12*a*. Stabilizing member 860 further may include one or more corresponding coupling elements 38*a* affixed thereto which fasten to coupling elements 36*a*. Accordingly, stabilizing member 860 may be releasably connected to first lower surface 14*a*. As such, stabilizing member 860 may be removed from inflatable plyometric box 810 when a user desires to transport or store inflatable plyometric box 810. Additionally, in various embodiments, for example only and without limitation, stabilizing member 860 may fold up, thus reducing the size of stabilizing member 360 for transport or storage. In such embodiments, sides 865 may fold down and bottom 863 may also fold. Although, stabilizing member 860 is described as being releasably connected to inflatable plyometric box 810, it will be understood that in various embodiments, stabilizing member 860 may be permanently connected to inflatable plyometric box 810 without departing from the scope of the disclosure.

Although not shown, it will be understood that in various embodiments, inflatable plyometric box 810 may further include one or more coupling elements 36*b* affixed to second upper surface 16*b* of second inflatable member 12*b*, as shown in FIGS. 4 and 5, without departing from the scope of the disclosure.

Additionally, although not shown, it will be understood that in various embodiments, inflatable plyometric box 810 may further include one or more and compliance members (such as for example only compliance members 64 and 364 shown in FIGS. 6-7 and 8-9) attached or adhered to bottom 863 of box 862 opposite first lower surface 14*a* (i.e., opposite the direction that sides 865 extend).

Figure 20:
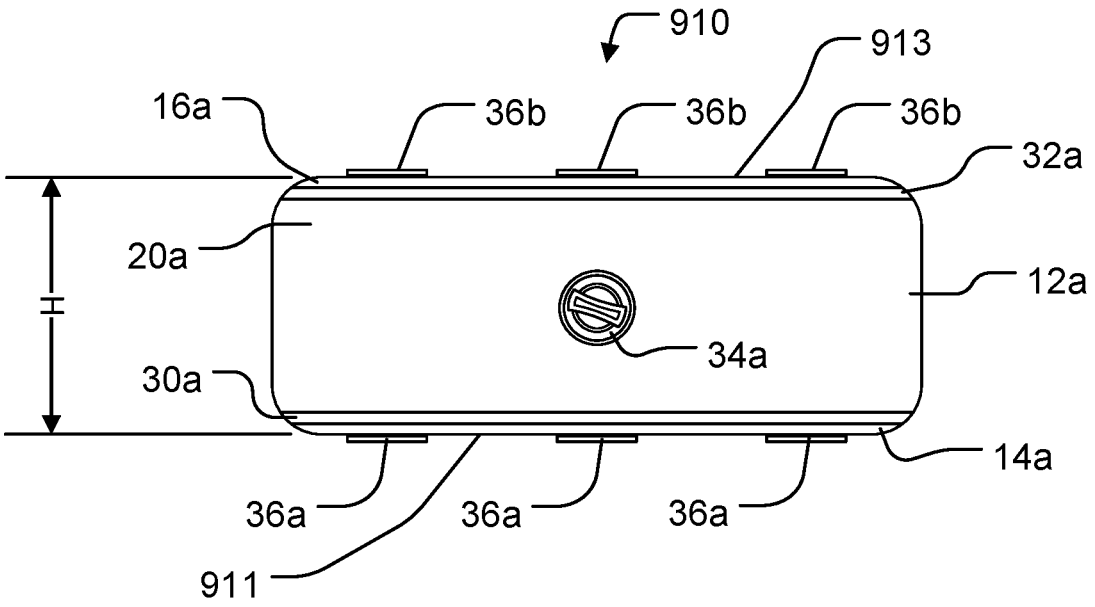
FIG. 20 is a front view of an inflatable plyometric box according to a tenth embodiment of the disclosure.

Another embodiment of an inflatable plyometric box 910 is illustrated in FIG. 20 and is described below. Some features of inflatable plyometric box 910, 810, 710, 610, 510, 410, 310, 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Inflatable plyometric box 910 comprises a single inflatable member 12*a*. Thus, while other embodiments of inflatable plyometric boxes described herein have included two or more inflatable members, inflatable plyometric box 910 comprises only one inflatable member which is identical to first inflatable member 12*a*.

In various embodiments, inflatable plyometric box 910 may further optionally include one or more coupling elements 36*a*, 36*b* as described in greater detail elsewhere herein without departing from the scope of the present disclosure.

Although not shown, it will be understood that inflatable plyometric box 910 may optionally include any of the stabilizing members 60, 360, 660 described herein without departing from the scope of the disclosure. Additionally, in various embodiments, inflatable plyometric box 910 may include a built-in stabilizing member similar to stabilizing member 460 of inflatable plyometric box 410, without departing from the scope of the disclosure.

Inflatable plyometric box 910 may be made to any desired height H (see FIG. 20). For example only and without limitation, various embodiments of inflatable plyometric box 910 may have a height from about 6 inches (about 15.24 cm) to about 48 inches (about 121.92 cm) (e.g., about 6 inches (about 15.24 cm), about 12 inches (about 30.48 cm), about 15 inches (about 38.1 cm), about 18 inches (about 45.72 cm), about 20 inches (about 50.8 cm), about 24 inches (about 60.96 cm), about 30 inches (about 76.2 cm), about 36 inches (about 91.44 cm), about 40 inches (about 101.6 cm), about 42 inches (about 106.68), about 48 inches (about 121.92 cm)). In certain embodiments, for example only and without limitation, inflatable plyometric box 910 may have a height equal to or greater than about 15 inches (about 38.1 cm). In other embodiments, for example only and without limitation, inflatable plyometric box 910 may have a height equal to or greater than about 20 inches (about 50.8 cm). In other embodiments, for example only and without limitation, inflatable plyometric box 910 may have a height equal to or greater than about 24 inches (about 60.96 cm). In yet other embodiments, for example only and without limitation, inflatable plyometric box 910 may have a height equal to or greater than about 30 inches (about 76.2 cm). In yet other embodiments, for example only and without limitation, inflatable plyometric box 910 may have a height equal to or greater than about 48 inches (about 121.92 cm). In yet other embodiments, for example only and without limitation, inflatable plyometric box 910 may have a height from about 15 inches (about 38.1 cm) to about 30 inches (about 76.2 cm). In various embodiments, for example only and without limitation, inflatable plyometric box 910 may be produced in heights of about 15 inches (about 38.1 cm), about 20 inches (about 50.8 cm), about 24 inches (about 60.96 cm), and about 30 inches (about 76.2 cm). It will be understood that each of the preceding recited height H dimensions are the height of inflatable plyometric box 910 when first inflatable member 12*a* is inflated. For example only and without limitation, inflatable plyometric box 910 may have the preceding recited height H dimensions when first inflatable member 12*a* is inflated to a pressure of about 15 psi (about 103.421 kPa).

Inflatable plyometric box 910 may have a length L and width W (see FIG. 21) of a sufficient size to permit a user to land with both feet on the top 913 of inflatable plyometric box 910. Additionally, inflatable plyometric box 910 may have a length L and width W that are substantially equal or equal. As such, the bottom 911 and top 913 of inflatable plyometric box 910 may be substantially square. In certain embodiments, the length L and width W of inflatable plyometric box 910 may be substantially equal or equal to the height H of inflatable plyometric box 910. In other embodiments for example, inflatable plyometric box 910 may have a height H which is greater than its length L and/or width W. In yet other embodiments, however, for example only and without limitation, inflatable plyometric box 910 may have a length L and width W which are different. Thus, inflatable plyometric box 910 may have a length L greater than its width W. As such, the bottom 911 and top 913 of inflatable plyometric box 910 may be substantially rectangular. Additionally, for example only and without limitation, inflatable plyometric box 910 may be shaped like a rectangular prism without departing from the scope of the disclosure.

In various embodiments, for example only and without limitation, inflatable plyometric box 910 may have a length L from about 20 inches (about 50.8 cm) to about 48 inches (about 121.92 cm) (e.g., about 20 inches (about 50.8 cm), about 22 inches (about 55.88 cm), about 24 inches (about 60.96 cm), about 26 inches (about 66.04 cm), about 28 inches (about 71.12 cm), about 30 inches (about 76.2 cm), about 32 inches (about 81.28 cm), about 34 inches (about 86.36 cm), about 36 inches (about 91.44 cm), about 38 inches (about 101.6 cm), about 40 inches (about 101.6 cm), about 42 inches (about 106.68 cm), about 46 inches (about 116.84 cm), about 48 inches (about 121.92 cm)) and may have a width W from about 20 inches (about 50.8 cm) to about 48 inches (about 121.92 cm) (e.g., about 20 inches (about 50.8 cm), about 22 inches (about 55.88 cm), about 24 inches (about 60.96 cm), about 26 inches (about 66.04 cm), about 28 inches (about 71.12 cm), about 30 inches (about 76.2 cm), about 32 inches (about 81.28 cm), about 34 inches (about 86.36 cm), about 36 inches (about 91.44 cm), about 38 inches (about 101.6 cm), about 40 inches (about 101.6 cm), about 42 inches (about 106.68 cm), about 46 inches (about 116.84 cm), about 48 inches (about 121.92 cm)).

In other embodiments, for example only and without limitation, inflatable plyometric box 910 may have a length L from about 24 inches (about 60.96 cm) to about 36 inches (about 91.4 cm) (e.g., about 24 inches (about 60.96 cm), about 26 inches (about 66.04 cm), about 28 inches (about 71.12 cm), about 30 inches (about 76.2 cm), about 32 inches (about 81.28 cm), about 34 inches (about 86.36 cm), about 36 inches (about 91.44 cm)) and may have a width W from about 24 inches (about 60.96 cm) to about 36 inches (about 91.4 cm) (e.g., about 24 inches (about 60.96 cm), about 26 inches (about 66.04 cm), about 28 inches (about 71.12 cm), about 30 inches (about 76.2 cm), about 32 inches (about 81.28 cm), about 34 inches (about 86.36 cm), about 36 inches (about 91.44 cm)). In other embodiments, for example only, inflatable plyometric box 910 has a length L of about 24 inches (about 60.96 cm) and a width W of about 24 inches (about 60.96 cm). In yet other embodiments, for example only and without limitation, inflatable plyometric box 910 has a length L of about 36 inches (about 60.96 cm) and a width W of about 36 inches (about 60.96 cm).

It will be understood that each of the preceding recited length L and width W dimensions are the length L and width W of inflatable plyometric box 910 when first inflatable member 12*a* is inflated. For example only and without limitation, inflatable plyometric box 910 may have the preceding recited length L and width W dimensions when first inflatable member 12*a* is inflated to a pressure of about 15 psi (about 103.421 kPa).

Figure 21:
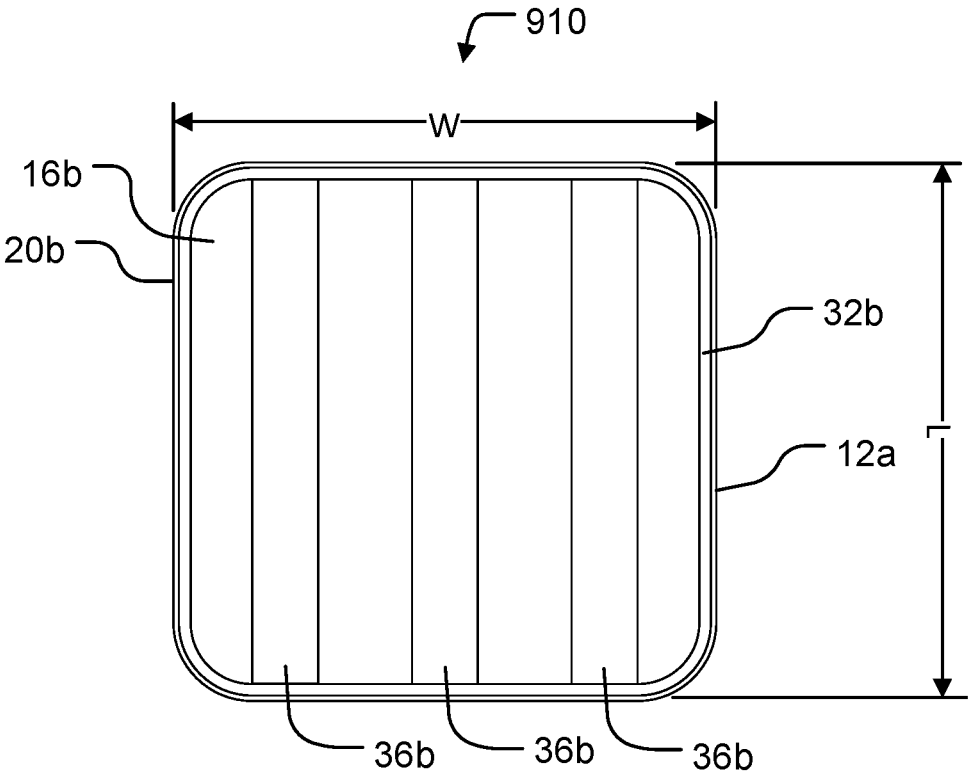
FIG. 21 is a top plan view of an inflatable plyometric box according to the tenth embodiment of the disclosure.

With continued reference to FIG. 21, in certain embodiments, inflatable plyometric box 910 has a length L which is no more than about 2 times its width W. In other embodiments, in certain embodiments, inflatable plyometric box 910 has a length L which is no more than about 1.5 times its width W. In yet other embodiments, inflatable plyometric box 910 has a length L which is no more than about 1 times its width W.

As described above in greater detail, the population of drop stich threads 18*a* in first inflatable member 12*a* make first inflatable member 12*a* substantially rigid. Accordingly, when a user jumps upon the central portion of first upper surface 16*a* of first inflatable member 12*a*, inflatable plyometric box 910 supports the user jumping on inflatable plyometric box 910 and is compressed no more than about 5% in height H. Stated differently, first inflatable member 12*a* does not compress such that the height H of inflatable plyometric box 910 is decreased by more than about 5%. That is, when a user jumps upon the central portion of first upper surface 16*a* of first inflatable member 12*a*, the compression of first inflatable member 12*a* does not exceed about 5% of the height H of inflatable plyometric box 910. In other embodiments, for example only and without limitation, when a user jumps upon the central portion of first upper surface 16*a* of first inflatable member 12*a*, inflatable plyometric box 910 is compressed no more than about 4% in height H. In other embodiments, for example only and without limitation, when a user jumps upon the central portion of first upper surface 16*a* of first inflatable member 12*a*, inflatable plyometric box 910 is compressed no more than about 3% in height H. In other embodiments, for example only and without limitation, when a user jumps upon the central portion of first upper surface 16*a* of first inflatable member 12*a*, inflatable plyometric box 910 is compressed no more than about 2% in height H. In other embodiments, for example only and without limitation, when a user jumps upon the central portion of first upper surface 16*a* of first inflatable member 12*a*, inflatable plyometric box 910 is compressed no more than about 1% in height H. In other embodiments, for example only and without limitation, when a user jumps upon the central portion of first upper surface 16*a* of first inflatable member 12*a*, inflatable plyometric box 910 is compressed no more than about 0.5% in height H.

Figure 22:
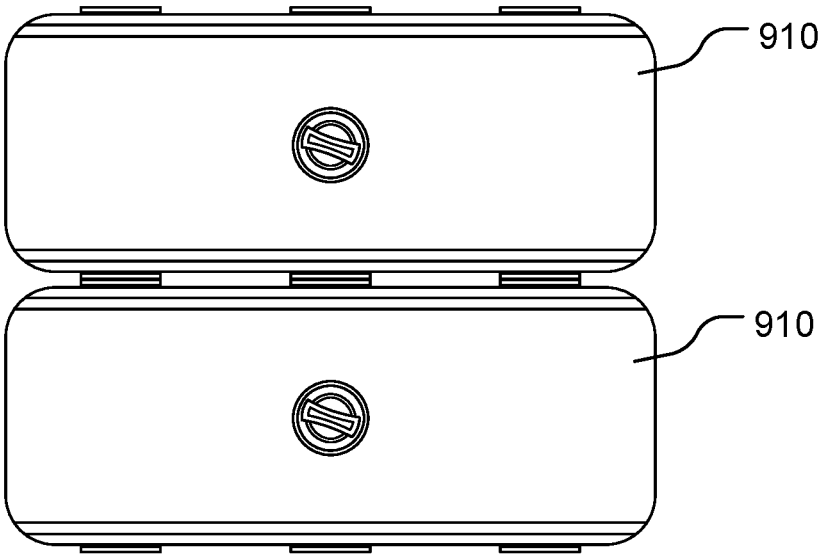
FIG. 22 is a front view of two inflatable plyometric boxes according to the tenth embodiment of the disclosure stacked upon each other.

As shown in FIG. 22, multiple inflatable members 12*a* may be stacked upon one another and connected, for example via coupling elements 36*a*, 36*b* to increase the height that a user has to jump.

Although the first, second and third inflatable members described herein with respect to various embodiments of the inflatable plyometric boxes are described as each first, second and third inflatable member having an inflation valve, it will be understood that in various embodiments, the first, second and/or third inflatable members may be in fluid communication with each other. That is, air (or any gas) may travel freely between each of the inflatable members. In such embodiments, the inflatable plyometric box has a single inflation valve and each inflatable member may be inflated through that single inflation valve.

FIGS. 23-43 depict other embodiments of inflatable plyometric boxes 1010, 1110, 1210, 1310, 1410. Some features of the inflatable plyometric boxes 10, 110, 210, 310, 410, 510, 610, 710, 810, 910, 1010, 1110, 1210, 1310, 1410 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

The inflatable plyometric boxes 1010, 1110, 1210, 1310, and 1410 can include one or more of a first inflatable member 1012*a*, 1112*a*, 1212*a*, 1312*a*; a second inflatable member 1012*b*, 1112*b*, 1212*b*, 1312*b* located above the first inflatable member 1012*a*, 1112*a*, 1212*a*, 1312*a*, 1412*a* and a connecting member (e.g., connecting member 1040) which is connected to first inflatable member 1012*a*, 1112*a*, 1212*a*, 1312*a* and second inflatable member 1012*b*, 1112*b*, 1212*b*, 1312*b*. The connecting member (e.g., connecting member 1040) secures or connects first inflatable member 1012*a*, 1112*a*, 1212*a*, 1312*a* to second inflatable member 1012*b*, 1112*b*, 1212*b*, 1312*b*. First and second inflatable members 1012*a*, 1112*a*, 1212*a*, 1312*a*, 1412*a*, 1012*b*, 1112*b*, 1212*b*, 1312*b* are substantially similar or identical and each have an enclosed interior or chamber which is adapted to be airtight and hold air (or any gas) at a desired pressure. As is described more fully below, each of first and second inflatable members 1012*a*, 1112*a*, 1212*a*, 1312*a*, 1412*a*, 1012*b*, 1112*b*, 1212*b*, 1312*b* incorporate drop stitch technology which allows first and second inflatable members 1012*a*, 1112*a*, 1212*a*, 1312*a*, 1412*a*, 1012*b*, 1112*b*, 1212*b*, 1312*b* to hold air (or any gas) at higher pressures and provides a high degree of rigidity to each of first and second inflatable members 1012*a*, 1112*a*, 1212*a*, 1312*a*, 1412*a*, 1012*b*, 1112*b*, 1212*b*, 1312*b* when first and second inflatable members 1012*a*, 1112*a*, 1212*a*, 1312*a*, 1412*a*, 1012*b*, 1112*b*, 1212*b*, 1312*b* are inflated. The inflatable plyometric box 1010, 1110, 1210, 1310 is described herein with second inflatable member 1012*b*, 1112*b*, 1212*b*, 1312*b* being on top of first inflatable member 1012*a*, 1112*a*, 1212*a*, 1312*a*. Thus, part of first inflatable member 1012*a*, 1112*a*, 1212*a*, 1312*a* is proximate to and forms the bottom side of inflatable plyometric box 1010, 1110, 1210, and 1310 and part of second inflatable member 1012*b*, 1112*b*, 1212*b*, 1312*b* is proximate to and forms the top side of inflatable plyometric box 1010, 1110, 1210, 1310. However, with first and second inflatable members 1012*a*, 1112*a*, 1212*a*, 1312*a*, 1012*b*, 1112*b*, 1212*b*, 1312*b* being substantially similar or identical, inflatable plyometric box 1010, 1110, 1210, 1310 may be used right side up or upside down. Thus, inflatable plyometric box 1010, 1110, 1210, 1310 may be used with first inflatable member 1012*a*, 1112*a*, 1212*a*, 1312*a* on top of second inflatable member 1012*b*, 1112*b*, 1212*b*, 1312*b*.

Additionally, while inflatable plyometric boxes 10, 1010, 1110, 1210, 1310 are shown as having two inflatable members, it will be understood that other embodiments of inflatable plyometric boxes may have one inflatable member or more than two inflatable members stacked upon one another (e.g., 1 inflatable member, 3 inflatable members, 4 inflatable members, 5 inflatable members, 6 inflatable members, 7 inflatable members, 8 inflatable members, 9 inflatable members, 10 inflatable members, or more), without departing from the scope of the disclosure. For example, the inflatable plyometric box 1410 may have one inflatable member 1412*a*.

FIGS. 23-43 illustrate various examples of stabilizing members 1060, 1160, 1260, 1360, and 1460. The stabilizing members 1060, 1160, 1260, 1360, 1460 can include one or more features of the stabilizing members 60, 360, 460, 560, 660, and 860 as previously described herein. The stabilizing member 1060, 1160, 1260, 1360, 1460 can include a base 1062, 1162, 1262, 1362, and 1462 as shown in FIGS. 23-43 respectively. The base 1062, 1162, 1262, 1362, 1462 can interface with the inflatable plyometric box 1010, 1110, 1210, 1310, 1410 such as the first lower surface (e.g., first lower surface 14*a* as shown in the example of FIG. 3 and other examples herein) of a first inflatable member 1012*a*, 1112*a*, 1212*a*, 1312*a*. An upper surface of the stabilizing members 1060, 1160, 1260, 1360, and 1460 can have a contoured shape, such as a shape that corresponds with the shape of the first lower surface of the first inflatable member 1012*a*, 1112*a*, 1212*a*, 1312*a*, 1412*a*. In an example, the countered shape can align the stabilizing member 1060, 1160, 1260, 1360, 1460 with the inflatable plyometric box 1010, 1110, 1210, 1310, 1410. In a further example, the contoured shape can center the plyometric box 1010, 1110, 1210, 1310, 1410 on the respective stabilizing members 1060, 1160, 1260, 1360, 1460. In some instances, the stabilizing members 1060, 1160, 1260, 1360, 1460 can be coupled to the inflatable plyometric box 1010, 1110, 1210, 1310, 1410 such as removably coupled as described further herein. Stabilizing members 1060, 1160, 1260, 1360, 1460 may be constructed of a rigid material, including but not limited to, plastic, metal, wood, composites (e.g., carbon fiber, Kevlar®, fiberglass), and/or any combination thereof.

Figure 23:
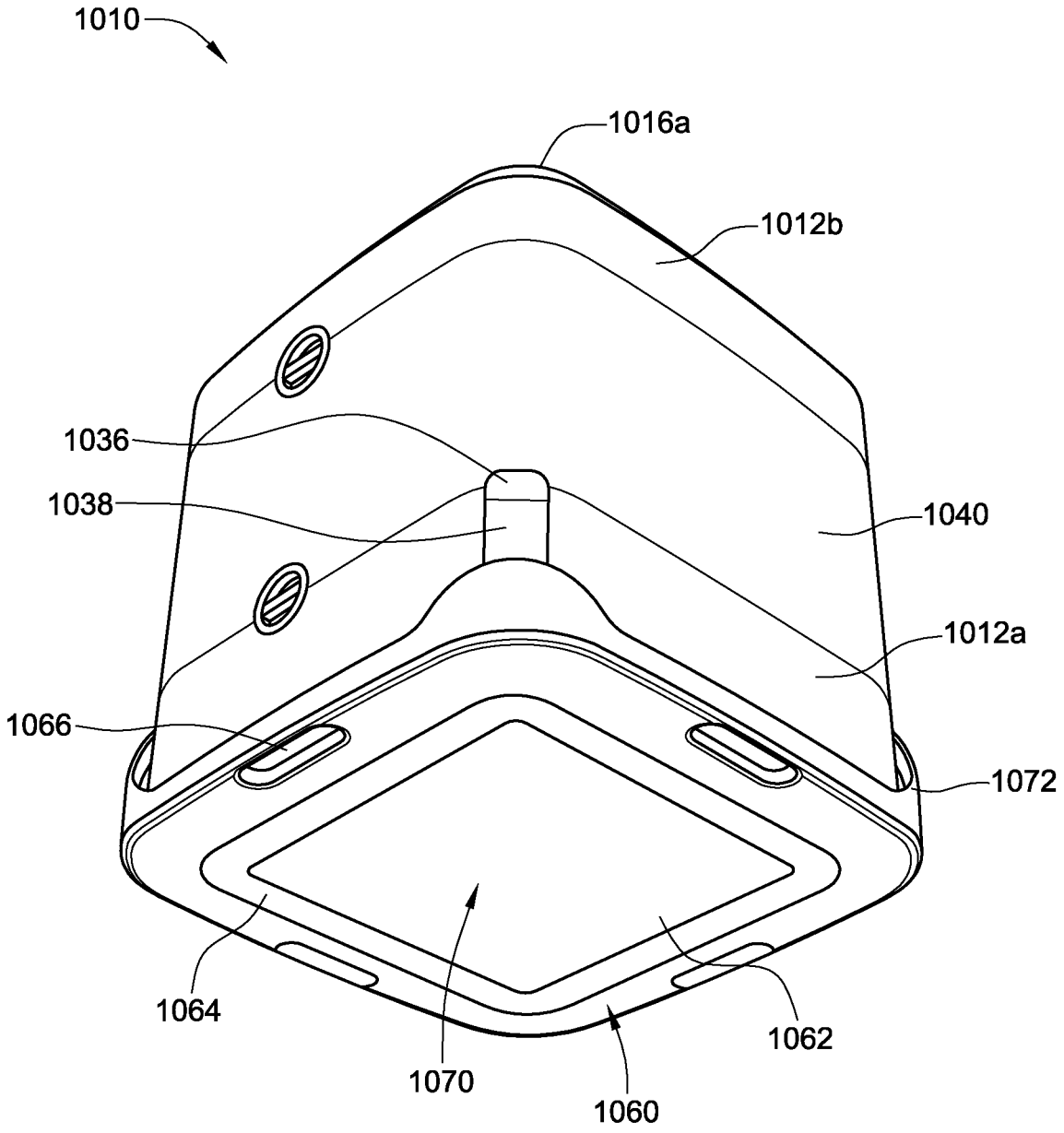
FIG. 23 is a perspective view of an inflatable plyometric box coupled to a stabilizing member, according to an eleventh embodiment of the disclosure.
Figure 24:
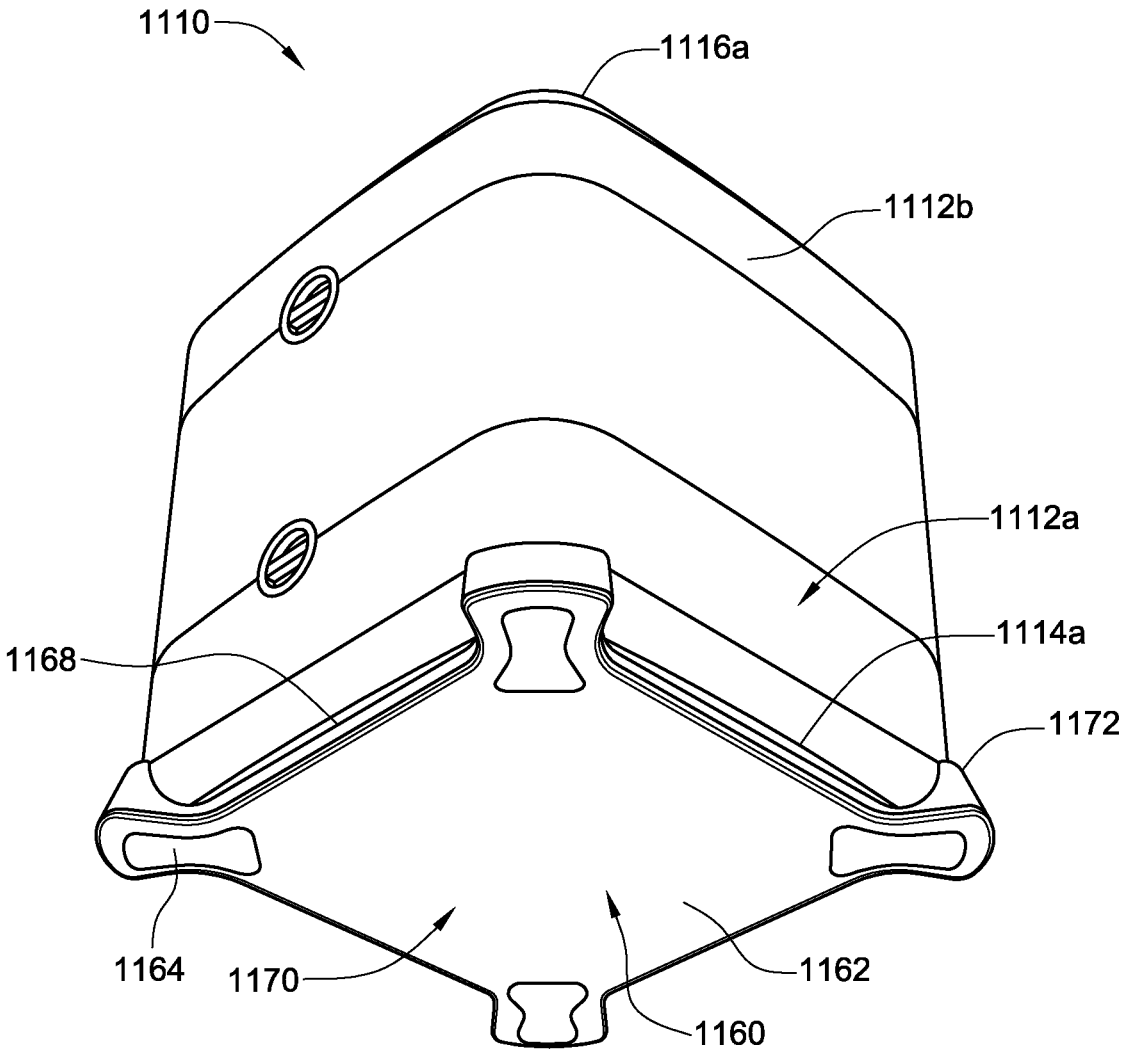
FIG. 24 is a perspective view of an inflatable plyometric box coupled to a stabilizing member, according to a twelfth embodiment of the disclosure.
Figure 27:
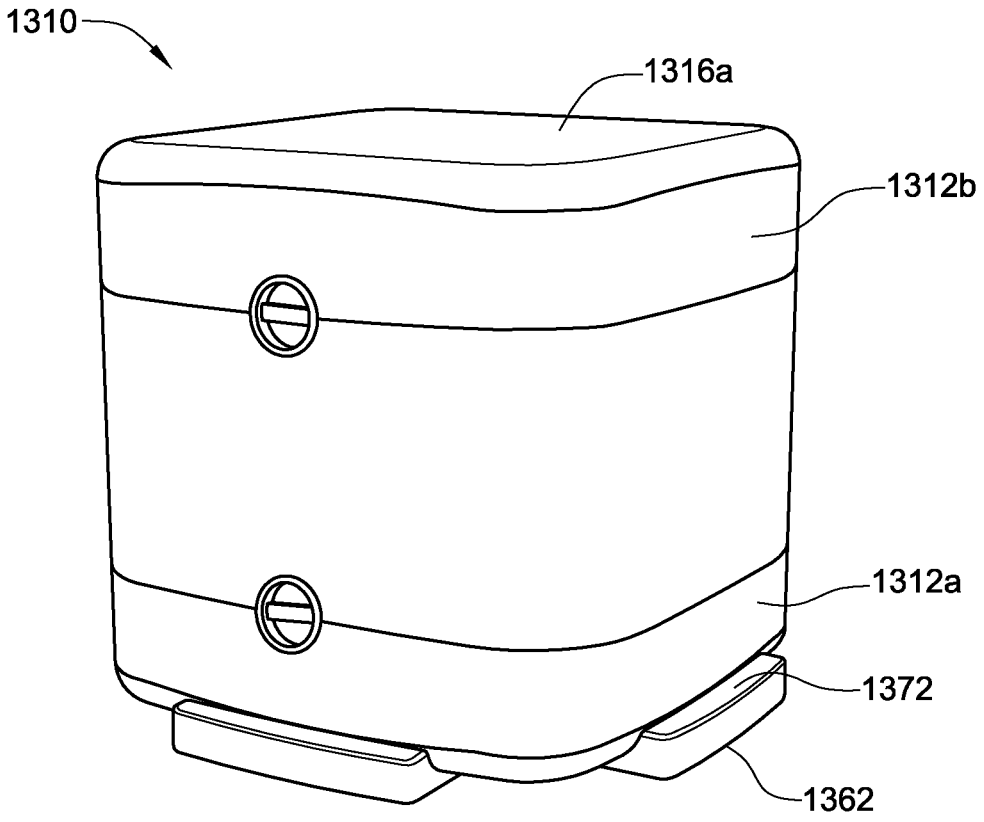
FIG. 27 is a lower perspective view of an inflatable plyometric box coupled to a stabilizing member, according to a fourteenth embodiment of the disclosure.
Figure 28:
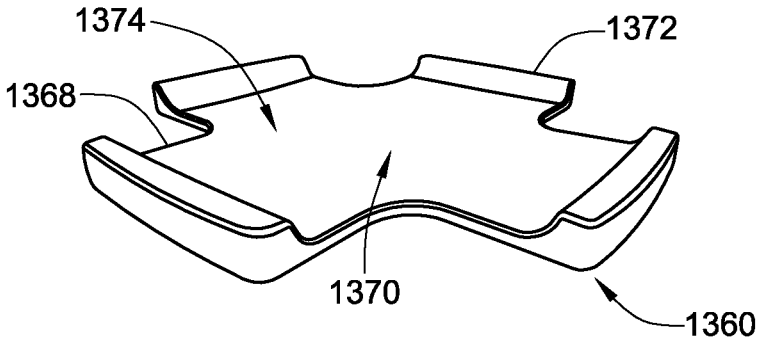
FIG. 28 is an upper perspective view of the stabilizing member, according to the fourteenth embodiment of the disclosure.

In some examples, the length and width of the stabilizing members 1060, 1160, 1260, 1360, 1460 (e.g., the length and width along the first lower surface of the first inflatable member 1012*a*, 1112*a*, 1212*a*, 1312*a*, 1412*a*) can be larger the than the length and width of the first lower surface (e.g., lower surface of the first inflatable member 1012*a*, 1112*a*, 1212*a*, 1312*a*, 1412*a*), as shown in the examples of FIGS. 23-25 and 27-43. In other examples the stabilizing members 1060, 1160, 1260, and 1360 can be smaller than the length or width of the plyometric box 1010, 1110, 1210, 1310 in some dimensions as also shown in FIGS. 24 and 27. The stabilizing members 1060, 1160, 1260, and 1360 can include a substantially rectangular shape having one or more cutouts 1168, 1368 at the corners (as shown in the examples of FIGS. 27-28) or along the sides (as shown in the example of FIG. 24). In an example the stabilizing members 1060, 1160, 1260, and 1360 can include a cross shape or an x-shape extended from a center portion 1070, 1170 1270, 1370 (e.g., rectangular center portion) of the stabilizing members 1060, 1160, 1260, 1360. For instance, one or more corners or sides of the stabilizing member 1060, 1160, 1260, 1360 can be extended from the center portion 1070, 1170 1270, 1370 of the stabilizing member 1060, 1160, 1260, 1360.

Figure 25:
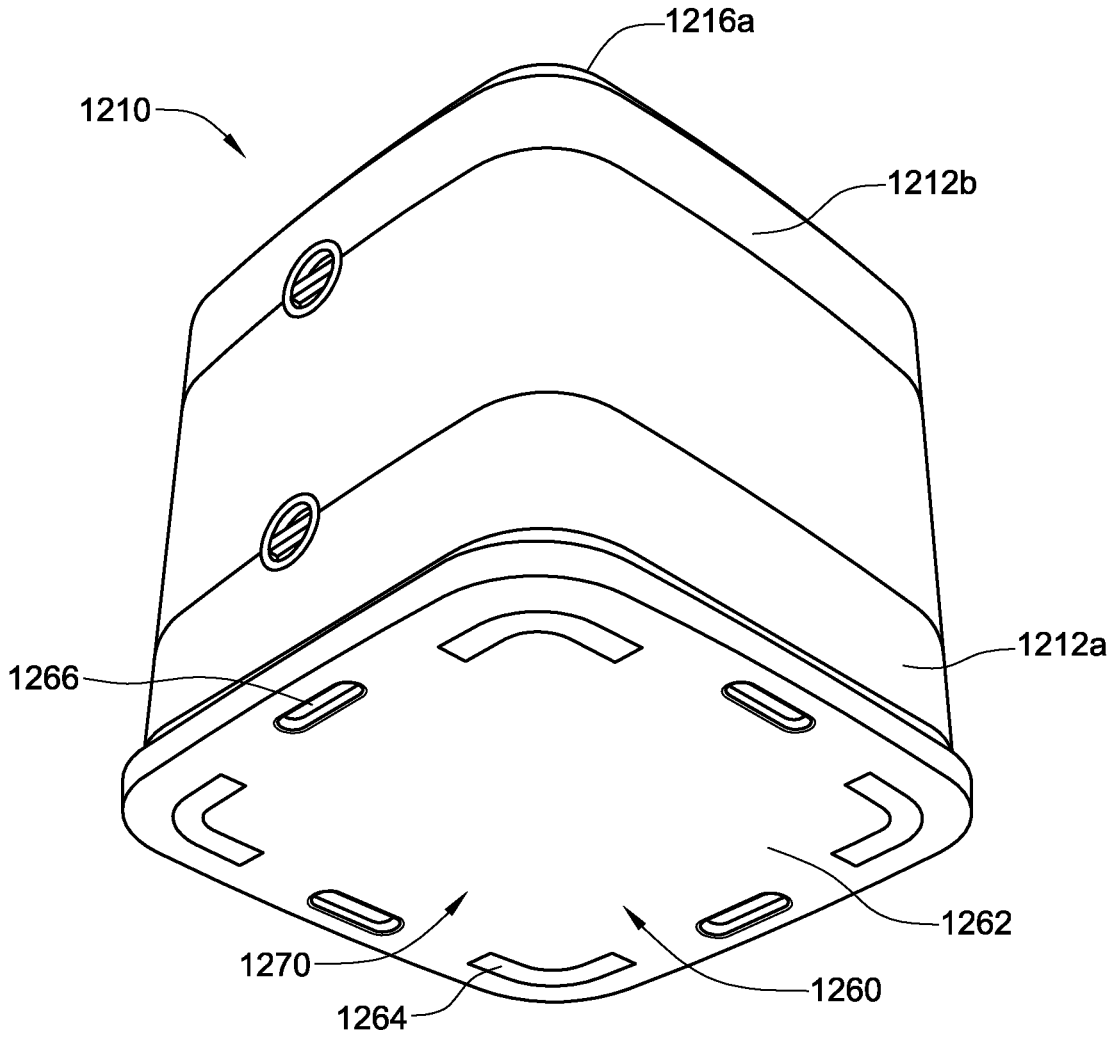
FIG. 25 is a lower perspective view of an inflatable plyometric box coupled to a stabilizing member, according to a thirteenth embodiment of the disclosure.
Figure 26:
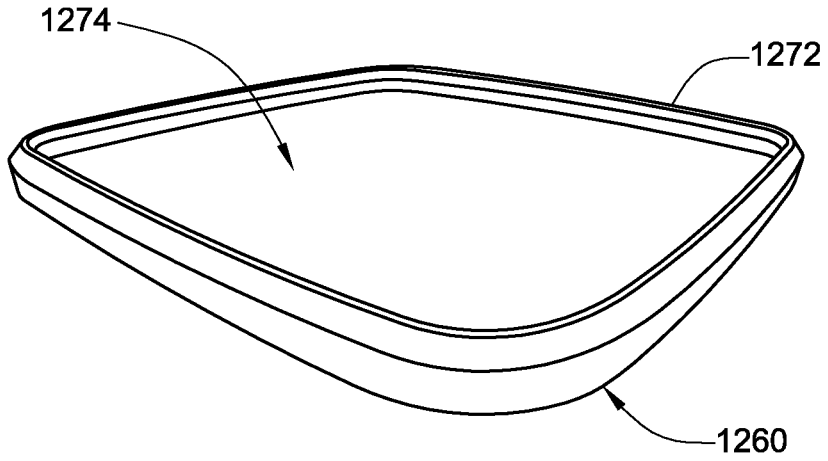
FIG. 26 is an upper perspective view of the stabilizing member, according to the thirteenth embodiment of the disclosure.

The stabilizing members 1060, 1160, 1260, 1360, and 1460 can include respective raised portions 1072, 1172, 1272, 1372, 1472 above an upper surface 1274, 1374, 1474 of the stabilizing members 1060, 1160, 1260, 1360, and 1460. For instance, the raised portion 1072, 1172, 1272, 1372, 1472 can include a ridge along the upper surface 1274, 1374 that is configured to engage the inflatable plyometric box 1010, 1110, 1210, 1310, 1410 such as the first lower surface (e.g., first lower surface 1114*a*), the side surface of the inflatable member 1012*a*, 1112*a*, 1212*a*, 1312*a*, 1412*a* or a combination thereof. In the examples of FIGS. 23-24, the raised portion 1072, 1172 can include a flange disposed from one or more corners of the stabilizing member 1060, 1160, such as each of the four corners of the stabilizing member 1060, 1160. In another example, the raised portion 1272 can include a ridge extended along a perimeter of the upper surface as depicted in FIGS. 25-26. FIG. 23 illustrates an example including the raised portion 1072 extended along the perimeter of the upper surface and a flange disposed from the corners of the base 1062.

In some examples, the stabilizing member 1060, 1160, 1260, 1360 can include a pad 1064, 1164, 1264, 1464 to increase friction between the stabilizing member 1060, 1160, 1260, 1360 and the floor or the ground. In various examples, the pad 1064, 1164, 1264, 1464 can be coupled to the stabilizing member 1060, 1160, 1260, 1360, 1460 by means including, but not limited to, co-molding, insert molding, fastening (e.g., screws or snap-fits), adhering, or other. In some examples, the pad 1064, 1164, 1264, 1464 can be removably coupled. Accordingly, the pad 1064, 1164, 1264, 1464 can be detached or replaceable. In some examples, the pad 1064, 1164, 1264, 1464 can be a gripping element. For instance, the pad 1064, 1164, 1264, 1464 can be constructed from an elastomer, can be infused with grit, or the like.

In another example, the pad 1064, 1164, 1264, 1464 may optionally further include one or more compliance members connected to the base 1062, 1162, 1262, 1362 opposite first lower surface (e.g., lower surface 1114*a*). Thus, when placed on a floor, the pad 1064, 1164, 1264, 1464 can contact the floor. The pad 1064, 1164, 1264, 1464 is able to deform slightly such that inflatable plyometric box 1010, 1110, 1210, 1310, 1464 can rest stably on an uneven or un-level floor.

As shown in the examples of FIGS. 23, 25, and 28-41, the stabilizing member 1060, 1160, 1260, 1360, 1460 can include one or more handholds 1066, 1266, 1466. The handholds 1066, 1266, 1466 can be used for transporting, positioning, or tethering the stabilizing member 1060, 1260, 1460 or the inflatable plyometric box 1010, 1210. In some examples, the handholds 1066, 1266, 1466 can include apertures located through the stabilizing member 1060, 1260, 1460 (see for example aperture 1467 in FIGS. 31, 33, 34, and 38).

The stabilizing member 1060, 1160, 1260, 1360, 1460 can be permanently or removably attached to the inflatable plyometric box 1010, 1110, 1210, 1310, 1410 such as the first inflatable member 1012*a*, 1112*a*, 1212*a*, 1312*a*, 1412*a* of the inflatable plyometric box 1010, 1110, 1210, 1310, 1410. As shown in the example of FIG. 23, the inflatable plyometric box 1010 can include one or more coupling elements 1036. The coupling elements 1036 can interface and fasten to one or more corresponding coupling elements 1038 attached to the stabilizing member 1060, 1160, 1260, 1360. In an example the coupling elements 1036 can be affixed to the first inflatable member 1012*a*, the connecting member 1040, protective cover (e.g., protective cover 570), or other feature of the inflatable plyometric box 1010, 1110, 1210, 1310.

Accordingly, stabilizing member 1060, 1160, 1260, 1360 may be releasably connected to the inflatable plyometric box 1010, 1110, 1210, 1310 when a user desires to transport or store inflatable plyometric box 1010, 1110, 1210, 1310. Additionally, in various embodiments, for example only and without limitation, stabilizing member 1060, 1160, 1260, 1360, 1460 may fold up, thus reducing the size of stabilizing member 1060, 1160, 1260, 1360, 1460 for transport or storage. Although, stabilizing member 1060, 1160, 1260, 1360, 1460 is described as being releasably connected to inflatable plyometric box 1010, 1110, 1210, 1310, 1410, it will be understood that in various embodiments, stabilizing member 1060, 1160, 1260, 1360, 1460 may be permanently connected to inflatable plyometric box 1010, 1110, 1210, 1310, 1460 without departing from the scope of the disclosure.

Coupling elements 1036, 1038 may comprise strips of hook-and-loop style fasteners (e.g., Velcro®-brand fasteners) which may be affixed to first lower surface (e.g., first lower surface 1114*a*) of first inflatable member (e.g., first inflatable member 1012*a*, 1112*a*, 1212*a*, 1312*a*) or the second upper surface 1016*b*, 1116*a*, 1216*a*, 1316*a* of the second inflatable member 1012*b*, 1112*b*, 1212*b*, 1312*b*. In various embodiments, for example only and without limitation, coupling elements 1036 may be adhered, fused, sewn and/or otherwise affixed to the first inflatable member 1012*a*, 1112*a*, 1212*a*, 1312*a* or the second upper surface 1016*b*, 1116*a*, 1216*a*, 1316*a* of second inflatable member 1012*b*, 1112*b*, 1212*b*, 1312*b*. While coupling elements 1036, 1038 are described as hook-and-loop style fasteners, it will be understood that other types of fasteners may be used as coupling elements without departing from the scope of the disclosure. For example only and without limitation, in various embodiments, coupling elements may comprise one or more magnets, buckles, slidingly engaging fasteners, or any other type of interlocking fasteners known in the art.

With reference to FIGS. 29-43, additional details of an embodiment of the stabilizing member 1460 are described. As shown in FIGS. 29-43, the inflatable plyometric box 1410 is shown with a single inflatable member 1412*a* coupled to the stabilizing member 1460. In some embodiments, the inflatable plyometric box 1410 may include more than one inflatable member as described herein. The stabilizing member 1460 is a reconfigurable stabilizing member or base for the inflatable plyometric box 1410, wherein the stabilizing member may be reconfigured between an unfolded position and a folded position. In some embodiments, the inflatable member 1412*a* may be deflated and stored within the folded up stabilizing member 1460. The stabilizing member 1460 can be used as a carrying case for the inflatable member 1412*a*.

The base 1462 of the stabilizing member 1460 may be rectangular or square in shape and may include four sides, such as a first side 3000, a second side 3002, a third side 3004, and a fourth side 3006. The first side 3000 may be parallel and opposite to the second side 3002. The third side 3004 may be parallel and opposite to the fourth side 3006. The first side 3000 and the second side 3002 may be perpendicular to the third side 3004 and the fourth side 3006. The base 1462 may include four corners, such as a first corner 3008, a second corner 3010, a third corner 3012, and a fourth corner 3014. In some embodiments, the first corner 3008, the second corner 3010, the third corner 3012, and the fourth corner 3014 are rounded corners.

The stabilizing member 1460 further includes the base 1462 having two or more base portions coupled together by one or more hinges, wherein the two or more base portions are configured to rotate with respect to each other about the one or more hinges. For example, the base 1462 of the stabilizing member 1460 includes a first base portion 3016, a second base portion 3018, and a third base portion 3020. The first base portion 3016 is coupled to the second base portion 3018 by a first hinge 3022 and the second base portion 3018 is coupled to the third base portion 3018 by a second hinge 3024.

The first hinge 3022 and the second hinge 3024 may be parallel to one another. The first hinge 3022 and the second hinge 3024 may be parallel to the first side 3000 and the second side 3002 of the base 1462 and may be perpendicular to the third side 3004 and the fourth side 3006 of the base 1462. In some embodiments, the first hinge 3022 and the second hinge 3024 may extend from the third side 3004 to the fourth side 3006. The first hinge 3022 and the second hinge 3024 are spaced apart a distance D. The distance D is sufficient to permit the first base portion 3016 and the third base portion 3020 to fold up without interfering with each other.

Figure 30:
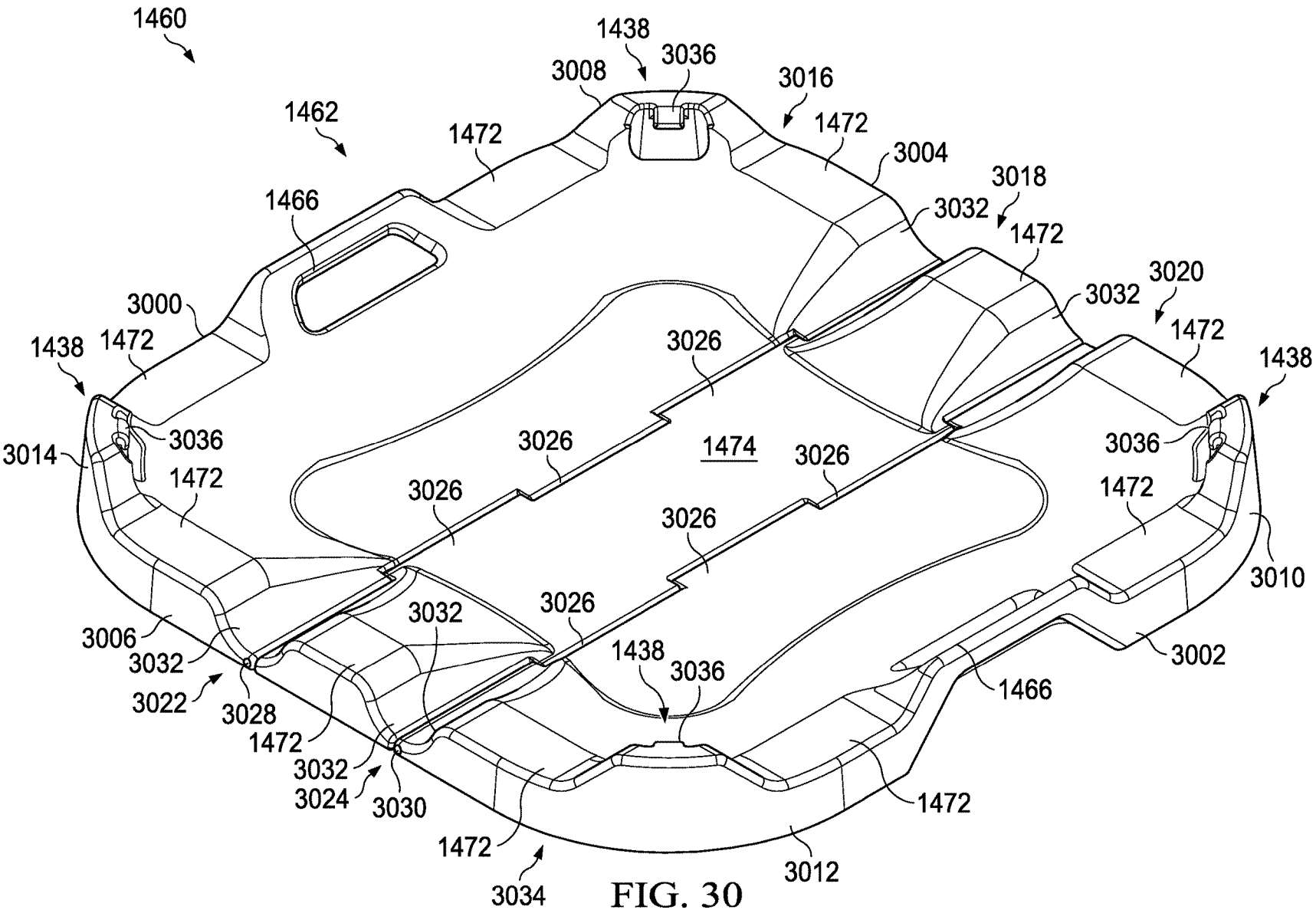
FIG. 30 is an upper isometric view of the stabilizing member in an unfolded position, according to the fifteenth embodiment of the disclosure.
Figure 31:
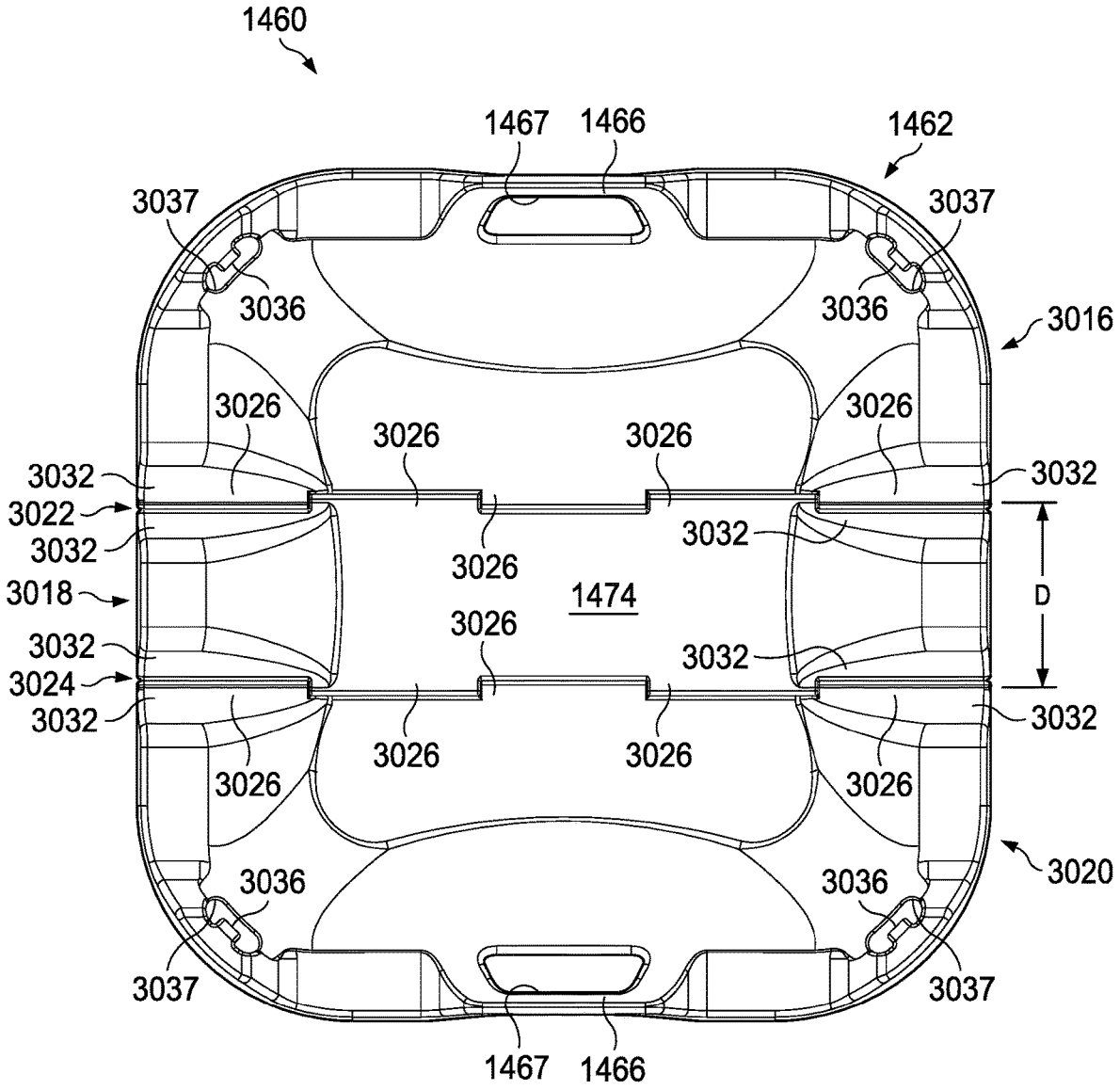
FIG. 31 is a top plan view of the stabilizing member in an unfolded position, according to the fifteenth embodiment of the disclosure.

The first hinge 3022 may include one or more knuckles 3026 and a first hinge pin 3028 extending therethrough. The second hinge 3024 may include one or more knuckles 3026 and a second hinge pin 3030 extending therethrough. As shown in FIGS. 30 and 31, in some embodiments the first base portion 3016, the second base portion 3018, and the third base portion 3020 may include the one or more knuckles 3026. In some embodiments, the knuckles 3026 may be integrally formed with one or more of the first base portion 3016, the second base portion 3018, and the third base portion 3020. The first hinge pin 3028 extends through one or more knuckles 3026 of the first base portion 3016 and the second base portion 3018. The second hinge pin 3030 extends through one or more knuckles 3026 of the second base portion 3018 and the third base portion 3020. The first hinge pin 3028 may couple the first base portion 3016 to the second base portion 3018 and the second hinge pin 3030 may couple the second base portion 3018 to the third base portion 3020.

The first hinge 3022 and the second hinge 3024 are configured to allow the stabilizing member 1460 to be reconfigured between a first position, such as an unfolded position (shown in FIGS. 29-35), and a second position, such as a folded position (shown in FIGS. 36-41). The first base portion 3016 and the third base portion 3020 fold up toward as shown by arrows A in FIG. 32. The stabilizing member 1460 may fold up, thus reducing the size of stabilizing member 1460 for transport or storage.

Figure 32:
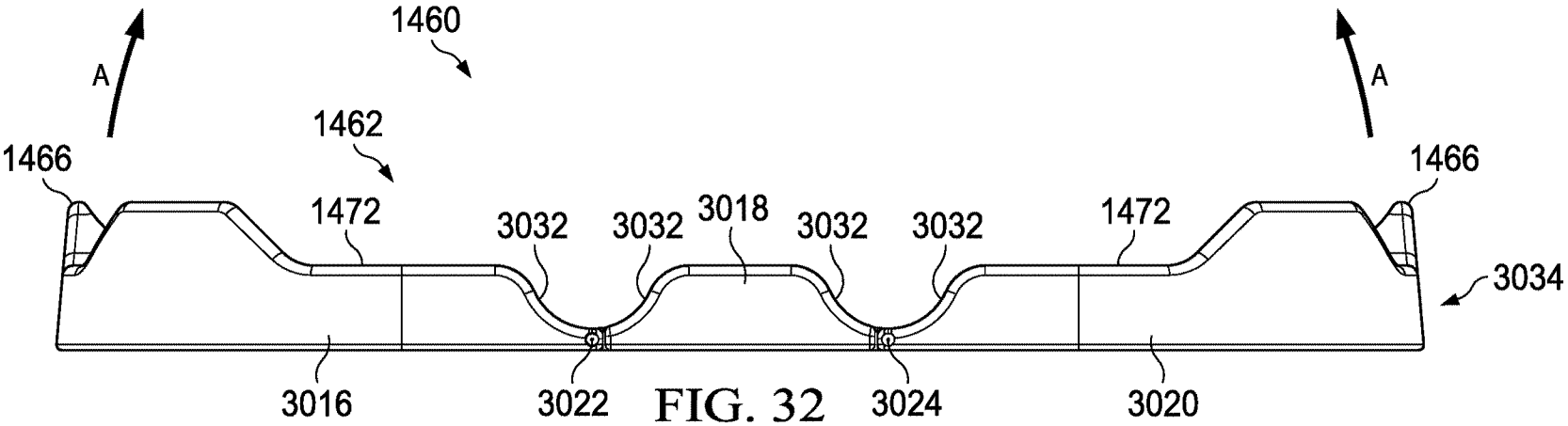
FIG. 32 is a front view of the stabilizing member in an unfolded position, according to the fifteenth embodiment of the disclosure. The stabilizing member may appear identical from both the front and the rear.
Figure 33:
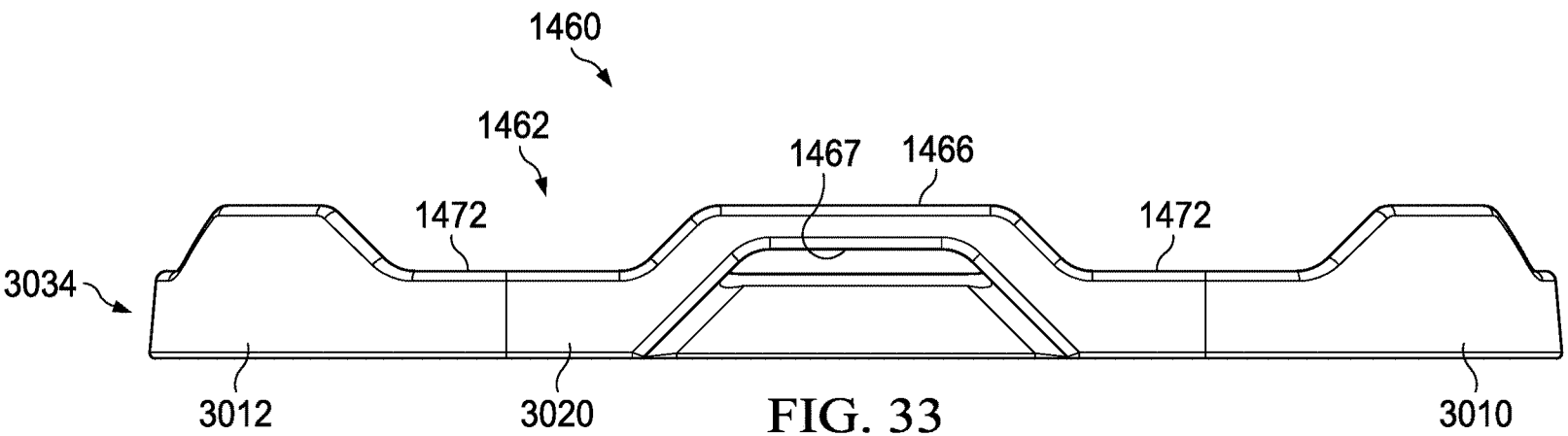
FIG. 33 is a side view of the stabilizing member in an unfolded position, according to the fifteenth embodiment of the disclosure. The stabilizing member may appear identical from both the right side and the left side.

In some embodiments, each of the base portions, such as the first base portion 3016, the second base portion 3018, and the third base portion 3020, may include a recess 3032. The recesses 3032 may be located proximate the terminal ends of the hinges 3022, 3024. The recesses 3032 extend through the raised portion 1472 of the base 1462. The recesses 3032 may have a curved shape; however, the recesses may have other shapes in other embodiments, such as for example, a chamfered shape. As shown in FIG. 32, the recesses 3032 may cooperate to form a semicircular recess. The recesses 3032 are sized to allow the first base portion 3016 and the third base portion 3020 to fold up without interference with the second base portion 3018.

The base 1462 may include a perimeter wall 3034 extending around the sides 3000, 3002, 3004, 3006 and the corners 3008, 3010, 3012, 3014. In some embodiments, the perimeter wall 3034 may be tapered such that the base 1462 is wider at the bottom of the base 1462 than at the top of the base 1462. As shown in FIGS. 29-31, 34, 36, 38, and 39, the stabilizing member 1460 includes two handholds 1466 disposed on opposite sides of the base 1462. For example, one handhold 1466 may be located on the first side 3000 of the base 1462 and a second handhold 1466 may be located on the second side 3002. The handholds 1466 may extend parallel to the first hinge 3022 and the second hinge 3024. In some embodiments, the stabilizing member 1460 may include less than two handholds 1466 or more than two handholds 1466. A user may use the handholds 1466 to move the first base portion 3016 and the third base portion 3020 to fold and unfold the stabilizing member 1460. In some embodiments, the handholds 1466 and the corners 3008, 3010, 3012, 3014 may be higher than the raised portion 1472 with respect to the bottom of the base 1462. Additionally, various elements of the stabilizing member 1460 provide an aesthetically pleasing shape, such as, for example, the shape of the handholds 1466, the shape of the raised portion 1472, and the curved shape of the recesses 3032.

Figure 36:
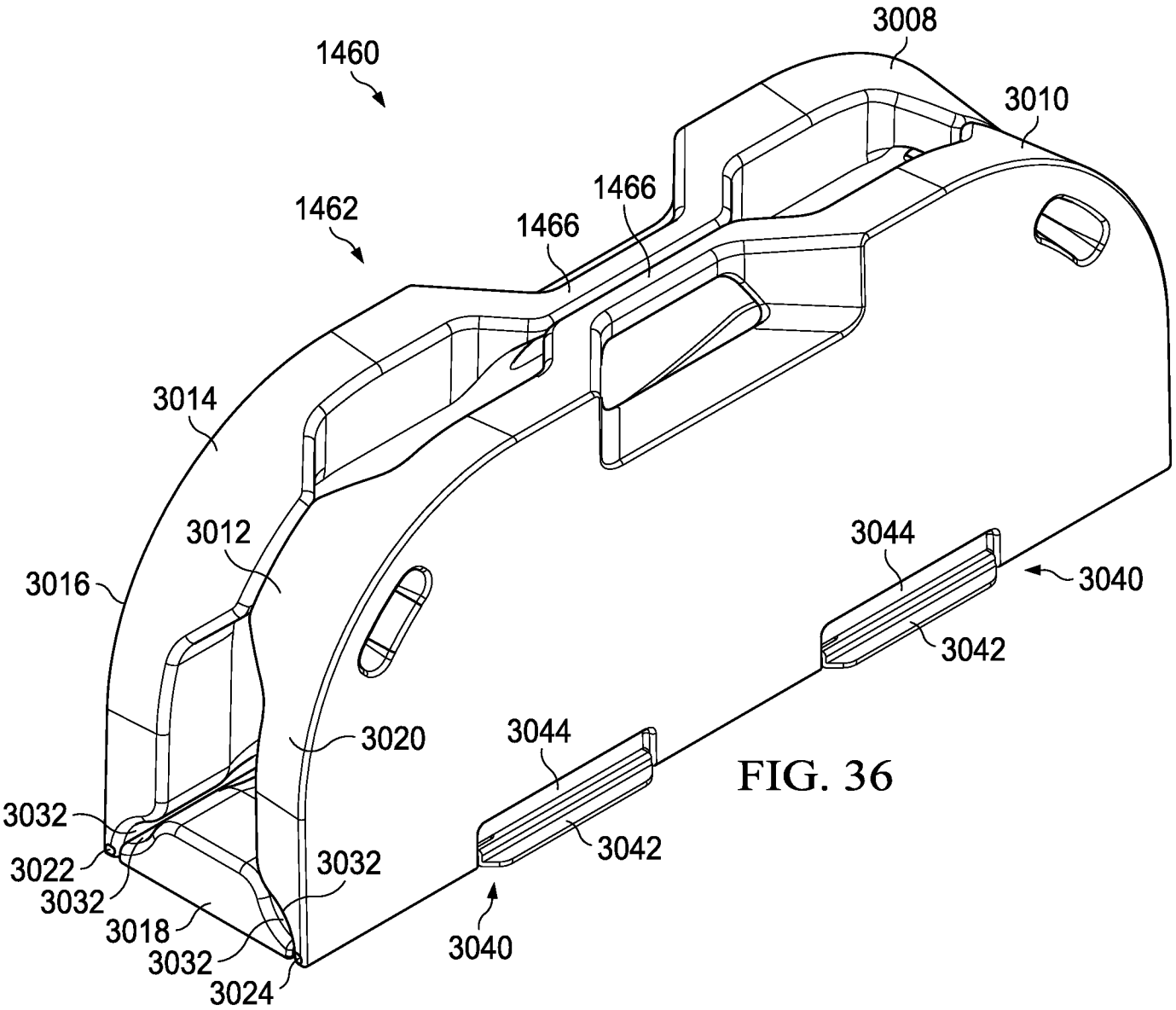
FIG. 36 is an upper isometric view of the stabilizing member in a folded position, according to the fifteenth embodiment of the disclosure.
Figure 37:
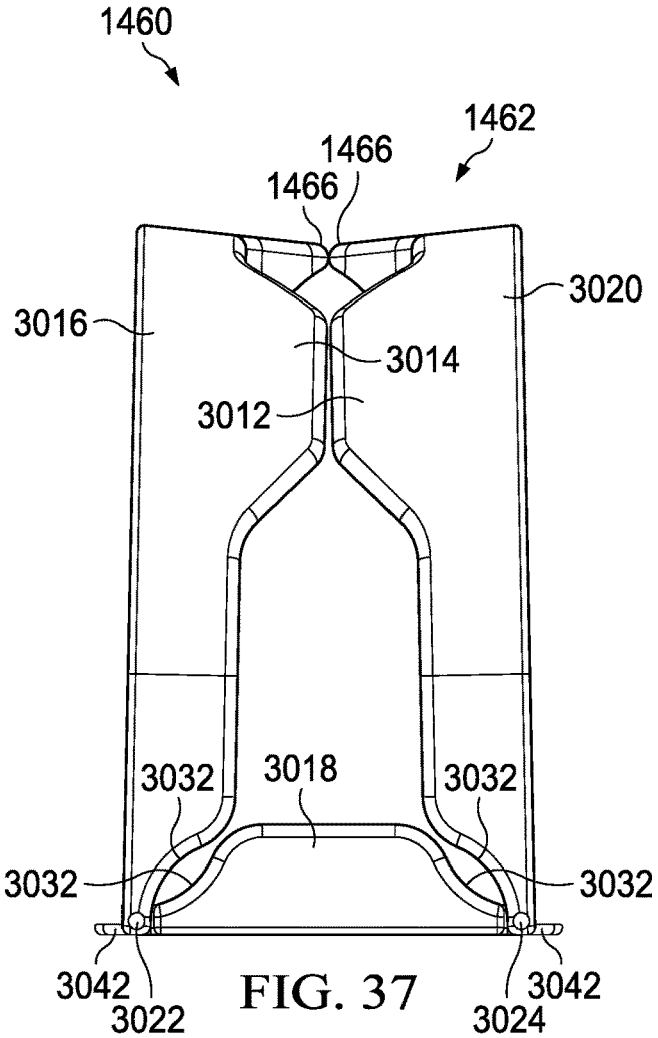
FIG. 37 is a front view of the stabilizing member in a folded position, according to the fifteenth embodiment of the disclosure. The stabilizing member may appear identical from both the front and the rear.
Figure 38:
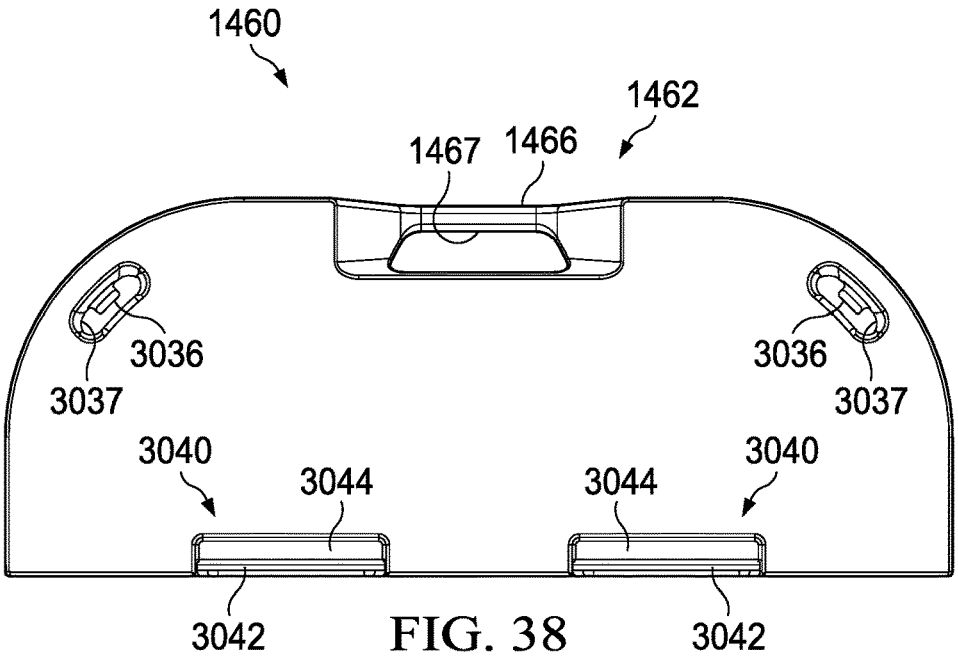
FIG. 38 is a side view of the stabilizing member in a folded position, according to the fifteenth embodiment of the disclosure. The stabilizing member may appear identical from both the right side and the left side.
Figure 39:
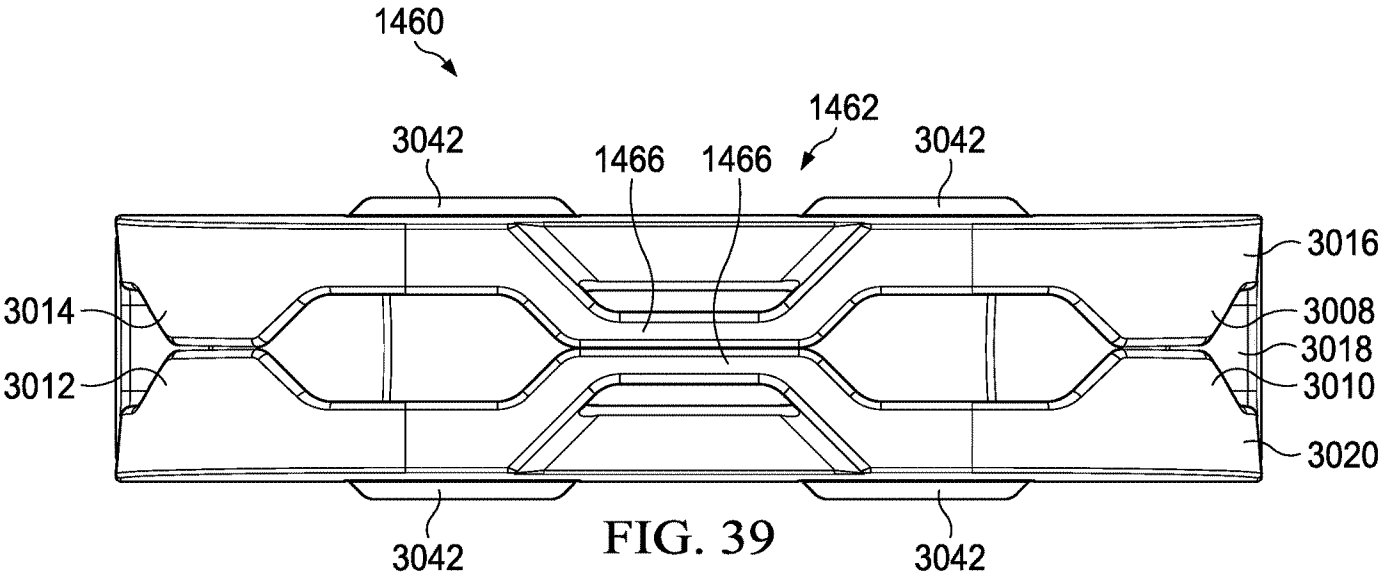
FIG. 39 is a top plan view of the stabilizing member in a folded position, according to the fifteenth embodiment of the disclosure.
Figure 40:
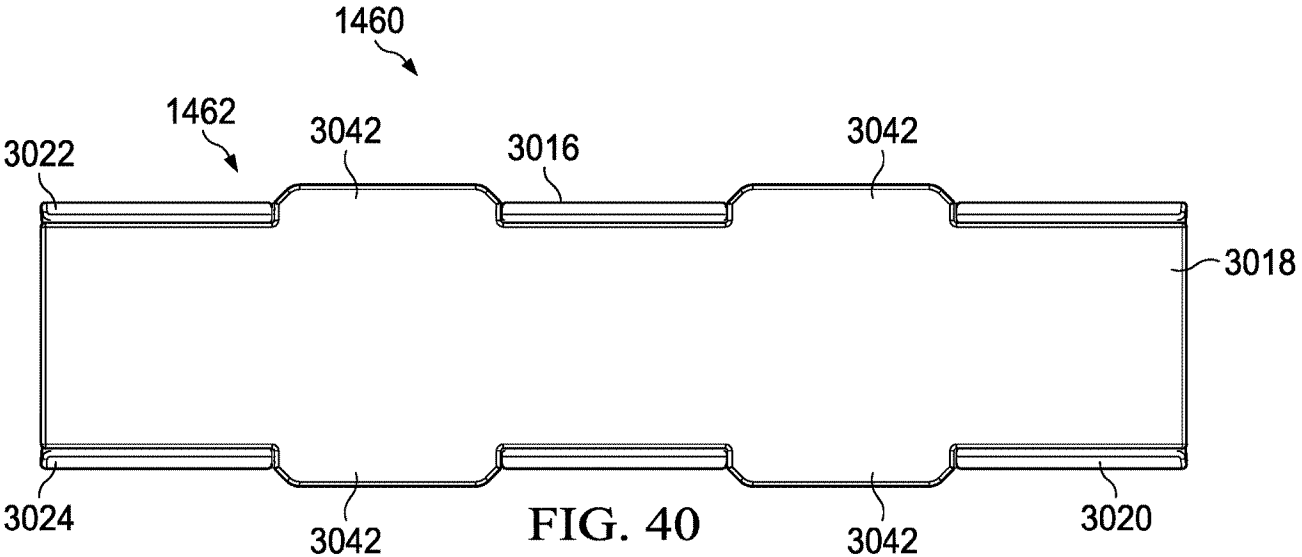
FIG. 40 is a bottom view of the stabilizing member in an unfolded position, according to the fifteenth embodiment of the disclosure.
Figure 41:
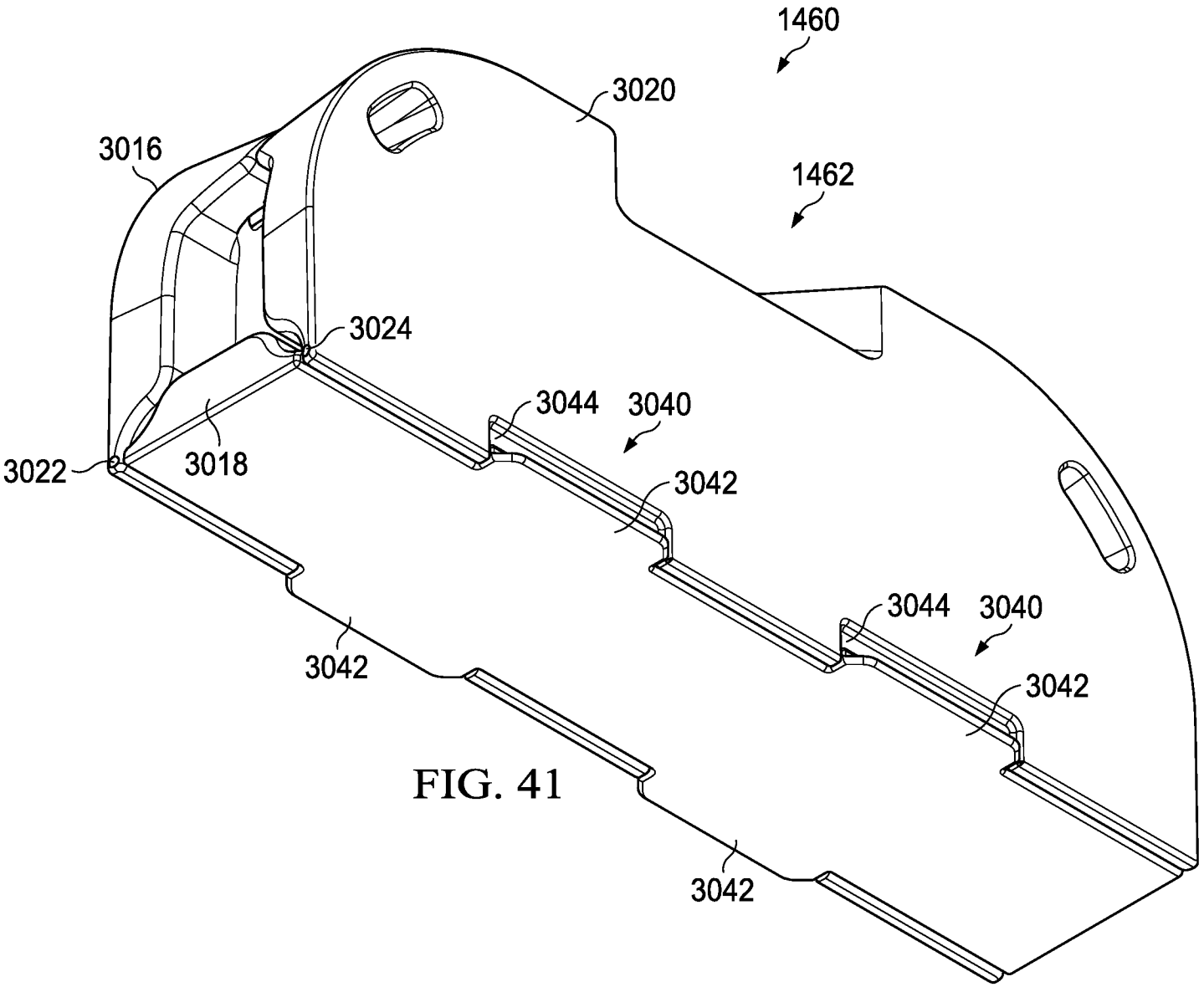
FIG. 41 is a bottom isometric view of the stabilizing member in a folded position, according to the fifteenth embodiment of the disclosure.

When the first base portion 3016 and the third base portion 3020 are in the second (e.g., folded) position, the first base portion 3016 and the third base portion 3020 are proximate to one another. As shown in FIGS. 36, 37, and 39, when the stabilizing member 1460 is folded the first corner 3008, the fourth corner 3014, and the handhold 1466 on the first base portion 3016 may be proximate to the second corner 3010, the third corner 3012, and the handhold 1466 on the third base portion 3020, respectively. In some embodiments, one or more of the first corner 3008, the fourth corner 3014, and the handhold 1466 on the first base portion 3016 may contact the second corner 3010, the third corner 3012, and the handhold 1466 on the third base portion 3020, respectively, when the stabilizing member 1460 is folded. When the stabilizing member 1460 is in the folded position, a user may carry the stabilizing member 1460 using the handholds 1466. For example, the handholds 1466 may be configured to permit a user to grasp both handholds 1466 with a single hand.

Figure 29:
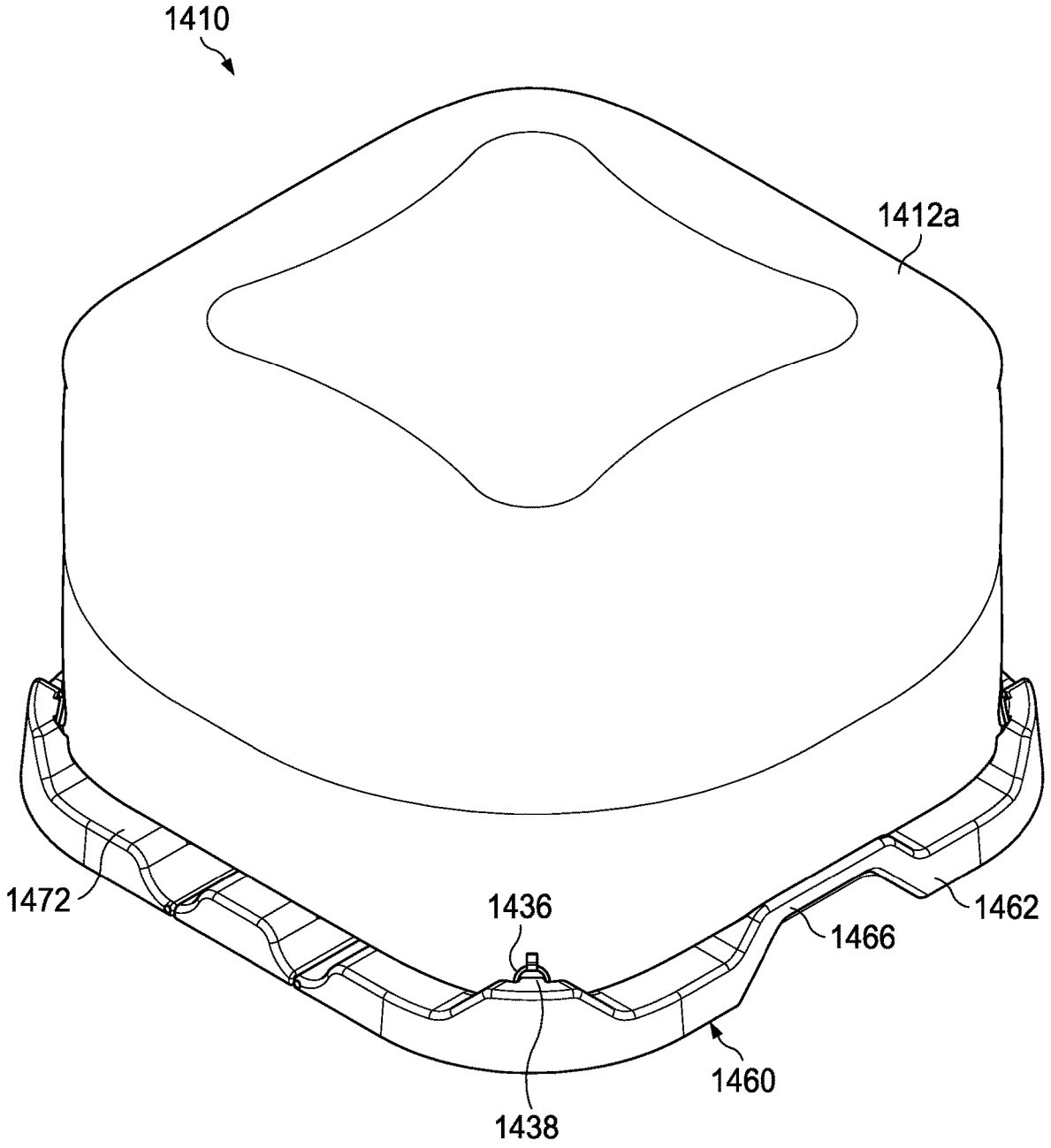
FIG. 29 is an upper isometric view of an inflatable plyometric box coupled to a stabilizing member, according to a fifteenth embodiment of the disclosure.
Figure 42:
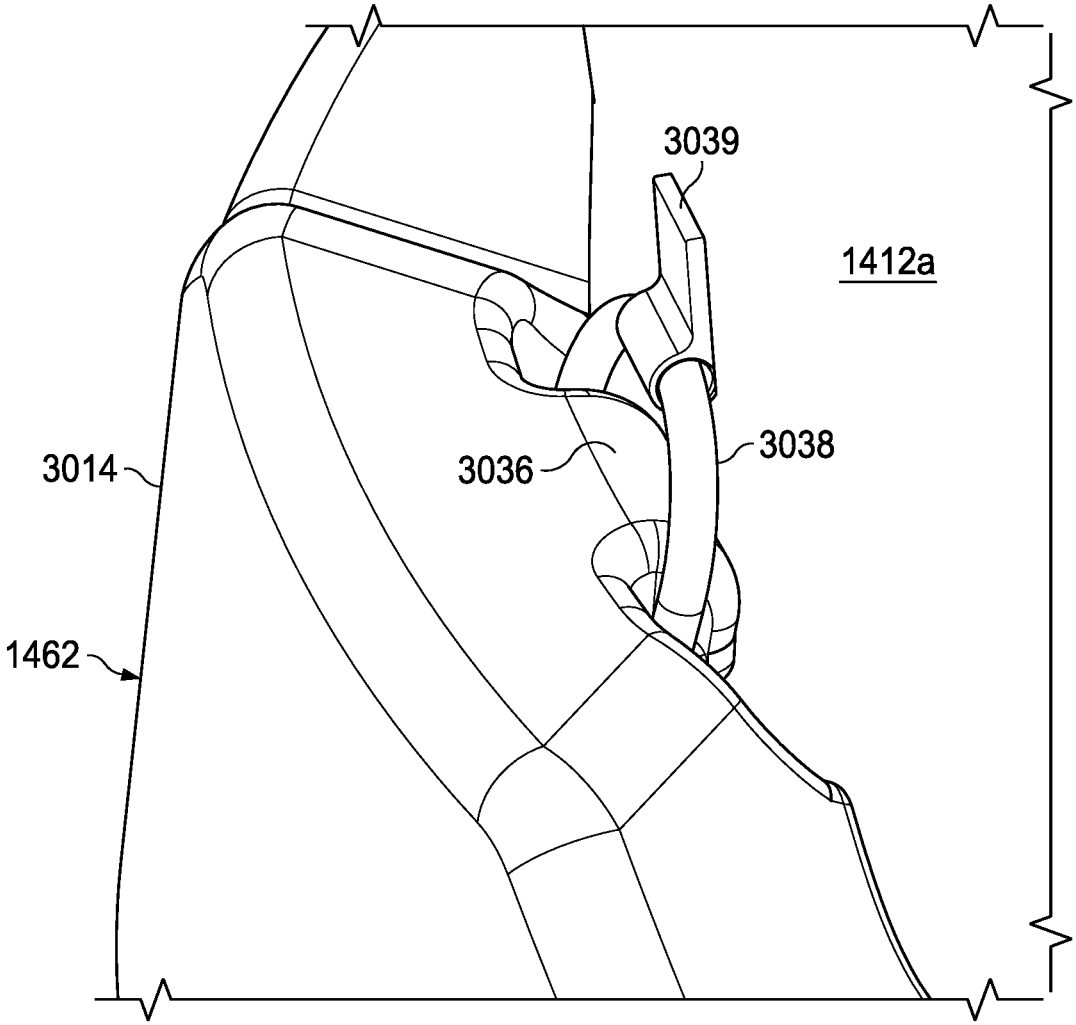
FIG. 42 is a detail isometric view of the stabilizing member in an unfolded position, according to the fifteenth embodiment of the disclosure.
Figure 43:
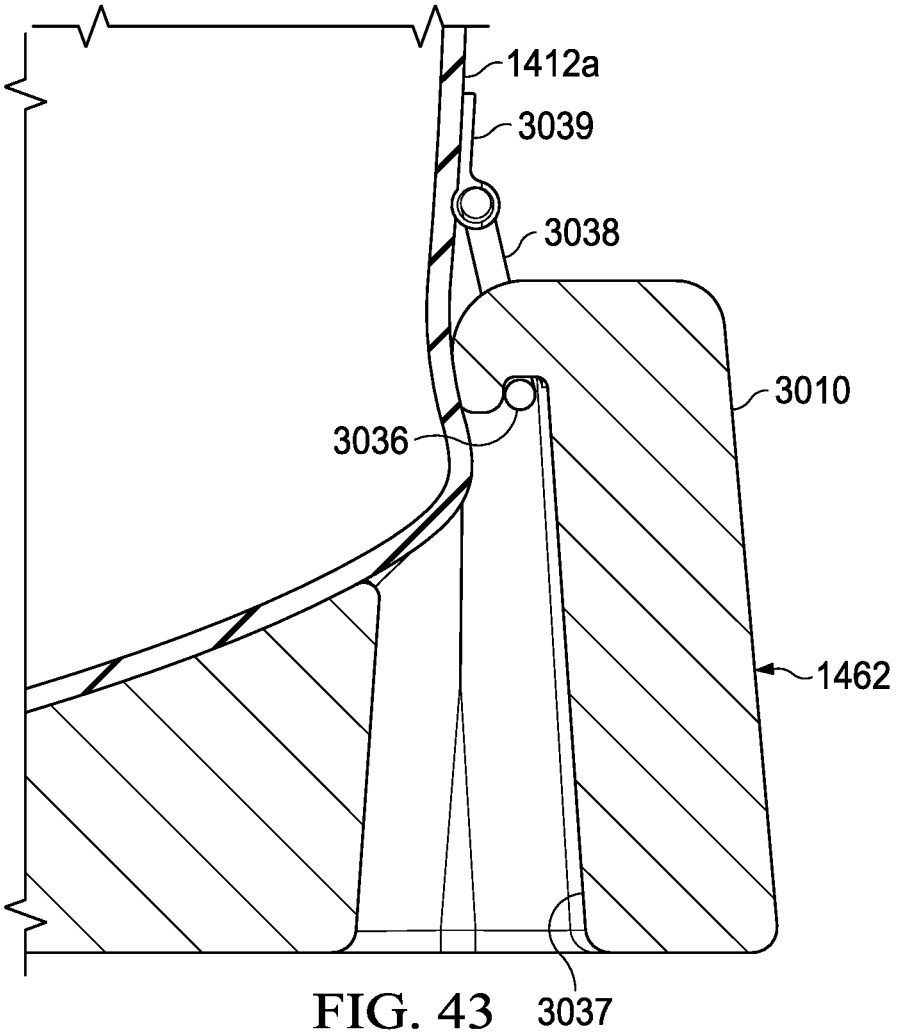
FIG. 43 is a detail cross-sectional view of the inflatable member coupled to the stabilizing member in an unfolded position, according to the fifteenth embodiment of the disclosure.

The stabilizing member 1460 includes a coupling element 1438 at one or more of the corners 3008, 3010, 3012, and 3014 of the base 1462. In some embodiments, the coupling elements 1438 are hooks 3036. The hooks 3036 may face toward the bottom of the base 1462. As shown in FIGS. 29, 42, and 43, the coupling elements 1436 of the inflatable member 1412*a* include a ring 3038, such as a D-ring, and a strap 3039 coupling the ring 3038 to the inflatable member 1412*a*. The rings 3038 are configured to be received in the hooks 3036. The rings 3038 on the inflatable member 1412*a* may be hooked onto the hooks 3036 of the stabilizing member 1460 and the inflatable member 1412*a* may be inflated. As the inflatable member 1412*a* is inflated, the rings 3038 may be pulled upward and will be tightly retained in the hooks 3036. The hooks 3036 are configured to resist an upward force exerted by the rings 3038. The one or more hooks 3036 are configured to receive the one or more rings 3038 on the inflatable member 1412*a* to releasably couple the inflatable member 1412*a* to the stabilizing member 1460.

As shown in FIGS. 31, 34, 35, and 38, the base 1462 may include an aperture 3037 proximate to one or more of the first corner 3008, the second corner 3010, the third corner 3012, and the fourth corner 3014. The apertures 3037 may extend from the top of the base 1462 to the bottom of the base 1462. The hooks 3036 may extend at least partially over the apertures 3037. The apertures 3037 may increase the accessibly of the rings 3038 to the hooks 3036.

Figure 34:
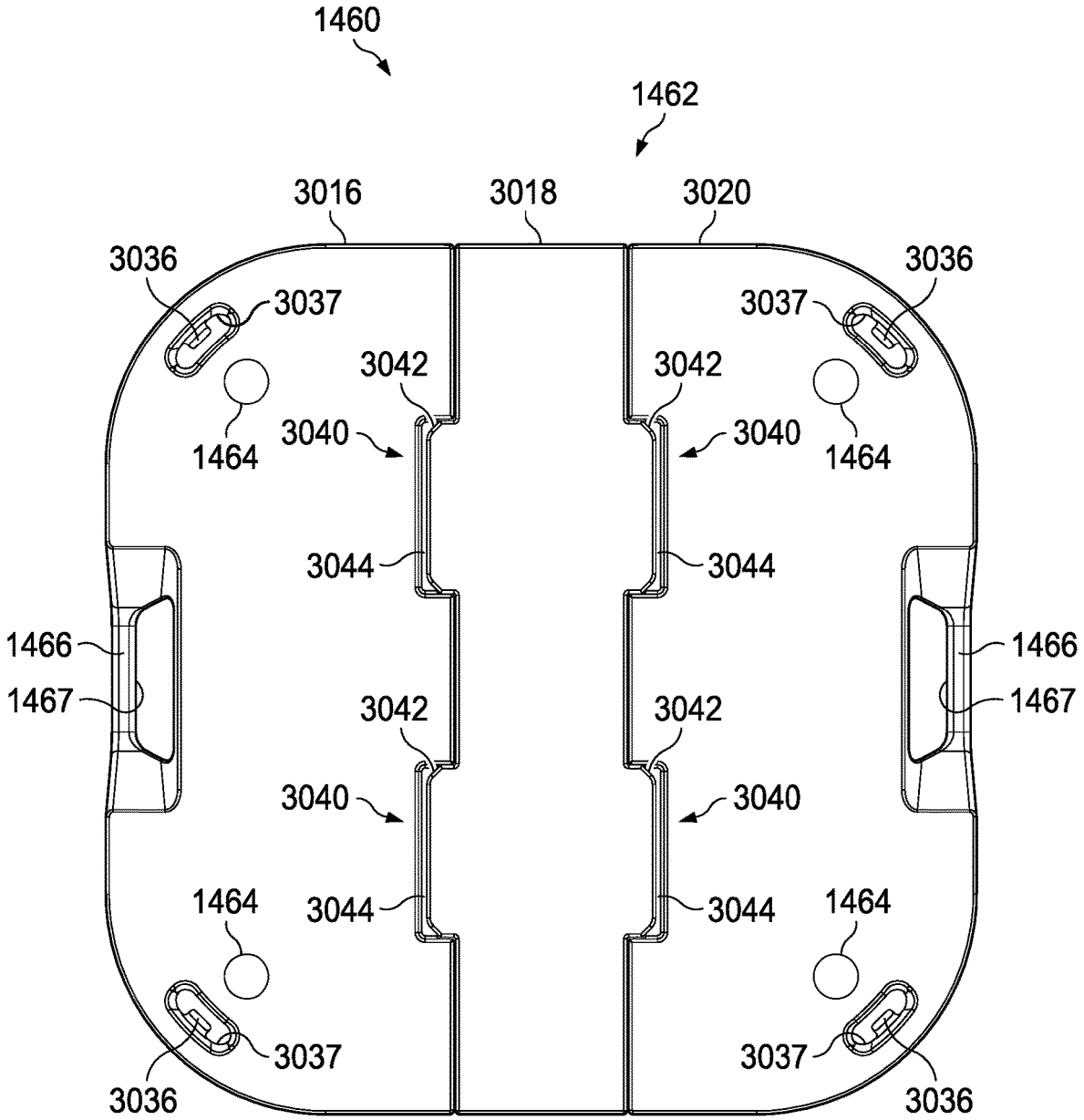
FIG. 34 is a bottom view of the stabilizing member in an unfolded position, according to the fifteenth embodiment of the disclosure.
Figure 35:
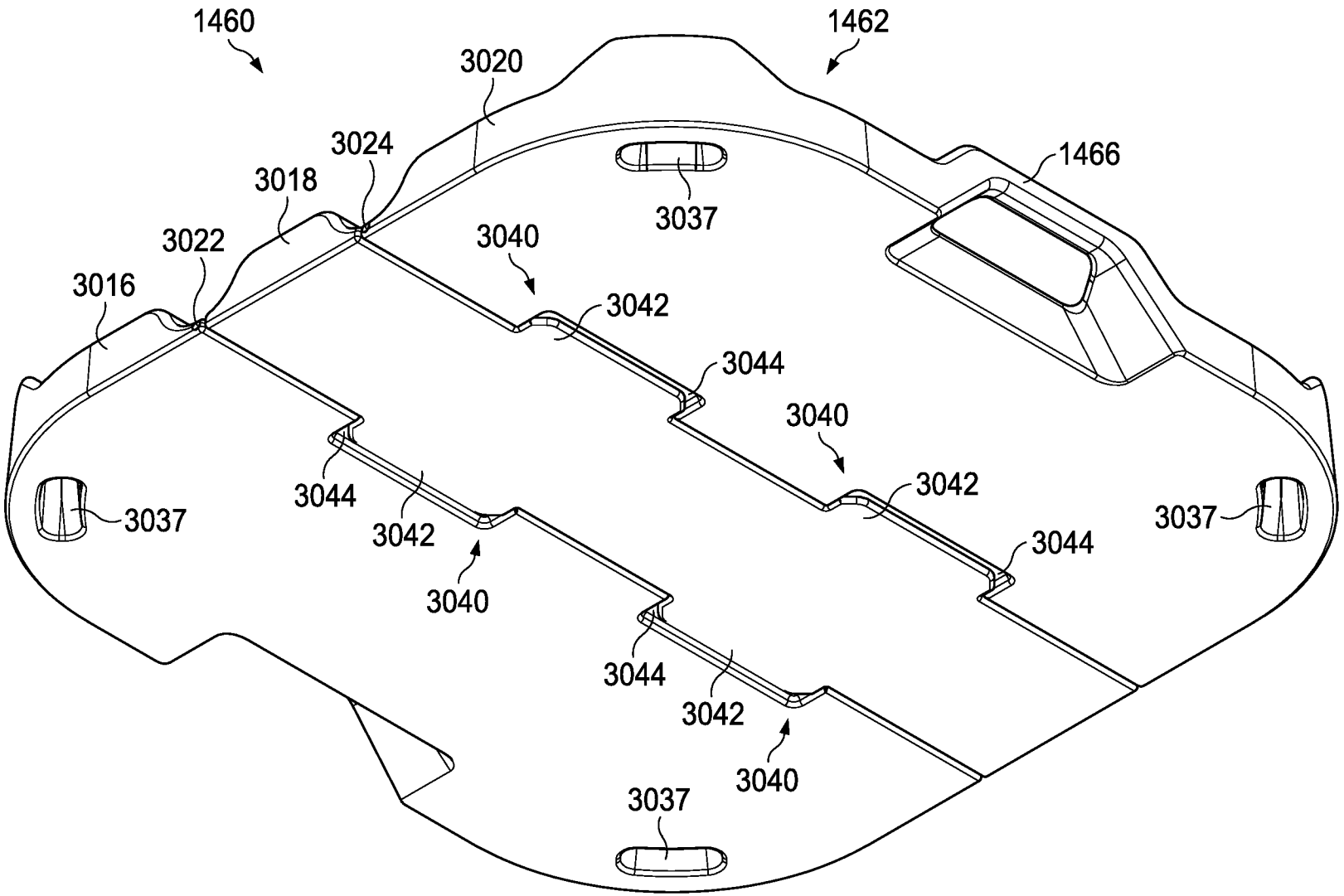
FIG. 35 is a bottom isometric view of the stabilizing member in an unfolded position, according to the fifteenth embodiment of the disclosure.

As shown in FIGS. 34-41, the stabilizing member 1460 may include one or more stops 3040 configured to limit rotation of the first base portion 3016 and the third base portion 3020 with respect to the second base portion 3018. The stops 3040 may be located on the bottom side of the base 1462. In some embodiments, each stop 3040 may include a tab 3042 and a recess 3044. When the first base portion 3016 is rotated from the folded position (see FIGS. 36-41) to the unfolded position (see FIGS. 29-34), the tab 3042 will come into contact with the recess 3044 to prevent further rotation or unfolding of the first base portion 3016. When the third base portion 3020 is rotated from the folded position (see FIGS. 36-41) to the unfolded position (see FIGS. 29-34), the tab 3042 will come into contact with the recess 3044 to prevent further rotation or unfolding of the third base portion 3020. When the stabilizing member 1410 is in the unfolded position, the tabs 3042 overlap the recesses 3032. In some embodiments, for example, as shown in FIGS. 34-36, the tabs 3042 may be on the second base portion 3018 and the recesses 3044 may be on the first base portion 3016 and the third base portion 3020. In some embodiments, one or more of the first base portion 3016 and the third base portion 3020 may have one or more tabs 3042 and the second base portion 3018 may have one or more recesses 3044. In some embodiments, the stabilizing member may have four stops 3040. For example, the second base portion 3018 may have four tabs 3042, the first base portion 3016 may have two recesses 3044, and the third base portion 3020 may have two recesses 3044. In some embodiments, the stabilizing member 1460 may have less than four stops 3040. In some embodiments, the stabilizing member 1460 may have more than four stops 3040.

Although several embodiments of an apparatus, system, and/or method in accordance with present teachings have been described above with a certain degree of particularity, those skilled in the art could make numerous alterations to the disclosed embodiments without departing from the scope of this disclosure. All directional references (e.g., upper, lower, upward, downward, left, right, leftward, rightward, top, bottom, above, below, vertical, horizontal, clockwise and counterclockwise) are only used for identification purposes to aid the reader's understanding of the disclosed embodiments, and do not create limitations, particularly as to the position, orientation, or use of the disclosed embodiments. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not as limiting. Changes in detail or structure may be made without departing from the present teachings as defined in the appended claims.

Various embodiments are described herein to various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment," or "in an embodiment", or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the disclosure described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "rear," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the disclosure described herein are, for example, capable of operation in other orientations than those illustrated or otherwise described herein.

All numbers expressing measurements and so forth used in the specification and claims are to be understood as being modified in all instances by the term "about."

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. An inflatable plyometric box, comprising:

an inflatable member configured to be inflated to a pressure, comprising:

a lower surface;

an upper surface; and drop stitch threads connected to and extending between the lower surface and the upper surface; and a stabilizing member configured to be releasably coupled to the lower surface of the inflatable member, wherein the stabilizing member is configured to fold.

2. The inflatable plyometric box of claim 1, wherein the stabilizing member comprises a base having two or more base portions coupled together by one or more hinges, wherein the two or more base portions are configured to rotate with respect to each other about the one or more hinges.

3. The inflatable plyometric box of claim 1, wherein the stabilizing member comprises one or more hooks configured to receive a ring on the inflatable member to releasably couple the inflatable member to the stabilizing member.

4. The inflatable plyometric box of claim 1, wherein the stabilizing member comprises:

a base comprising:

a first base portion;

a second base portion;

a third base portion; and a first hinge; and a second hinge;

wherein the first base portion is coupled to the second base portion by the first hinge and the second base portion is coupled to the third base portion by the second hinge.

5. The inflatable plyometric box of claim 4, wherein the base includes:

a first side;

a second side parallel and opposite to the first side;

a first handhold on the first side; and a second handhold on the second side.

6. The inflatable plyometric box of claim 4, wherein the base includes one or more corners and a coupling element at one or more of the corners.

7. The inflatable plyometric box of claim 6, wherein the coupling element is a hook configured to receive a ring on the inflatable member to releasably couple the inflatable member to the stabilizing member.

8. The inflatable plyometric box of claim 1, wherein the stabilizing member is configured to store the inflatable member when the inflatable member is deflated and the stabilizing member is in a folded position.

9. A stabilizing member for use with an inflatable member of an inflatable plyometric box, the stabilizing member comprising:

a base comprising:

a first base portion;

a second base portion;

a third base portion; and a first hinge; and a second hinge;

wherein the first base portion is coupled to the second base portion by the first hinge and the second base portion is coupled to the third base portion by the second hinge.

10. The stabilizing member of claim 9, wherein the first base portion is configured to rotate with respect to the second base portion between a first position and a second position and the third base portion is configured to rotate with respect to the second base portion between a first position and a second position.

11. The stabilizing member of claim 10, wherein the first base portion is configured to be proximate to the second base portion when the first base portion and the second base portion are in the second position.

12. The stabilizing member of claim 9, wherein the stabilizing member comprises one or more hooks configured to receive a ring on the inflatable member to releasably couple the inflatable member to the stabilizing member.

13. The stabilizing member of claim 9, wherein the base further comprises one or more stops configured to limit rotation of at least one of the first base portion and the third base portion with respect to the second base portion.

14. The stabilizing member of claim 9, wherein the base includes:

a first side;

a second side parallel and opposite to the first side;

a first handhold on the first side; and a second handhold on the second side.

15. The stabilizing member of claim 14 wherein the first handhold is parallel to the first hinge and the second handhold is parallel to the second hinge.

16. The stabilizing member of claim 9, wherein the base includes one or more corners and a coupling element at one or more of the corners.

17. The stabilizing member of claim 16, wherein the coupling element is a hook configured to receive a ring on the inflatable member to releasably couple the inflatable member to the stabilizing member.

18. The stabilizing member of claim 9, wherein the base further comprises a perimeter wall, wherein the perimeter wall is tapered such that the base is wider at a bottom of the base than at a top of the base.

19. An inflatable plyometric box, comprising:

an inflatable member configured to be inflated to a pressure, the inflatable member comprising one or more rings; and a foldable stabilizing member comprising:

a base having two or more base portions coupled together by one or more hinges, wherein the two or more base portions are configured to rotate with respect to each other about the one or more hinges; and one or more hooks configured to receive the one or more rings on the inflatable member to releasably couple the inflatable member to the foldable stabilizing member.

20. The inflatable plyometric box of claim 19, wherein the two or more base portions are configured to rotate with respect to one another between a first position and a second position.

* * * * *